US005616446A

United States Patent [19]

Miura et al.

[11] Patent Number: 5,616,446

[45] Date of Patent: Apr. 1, 1997

[54] SILVER HALIDE PHOTOGRAPHIC LIGHT-SENSITIVE MATERIAL

[75] Inventors: Norio Miura; Tawara Komamura; Seiji Hidaka; Takeo Arai, all of Hino, Japan

[73] Assignee: Konica Corporation, Tokyo, Japan

[21] Appl. No.: 534,859

[22] Filed: Sep. 26, 1995

[30] Foreign Application Priority Data

Sep. 29, 1994 [JP] Japan ..... 6-235480
Mar. 27, 1995 [JP] Japan ..... 7-067935

[51] Int. Cl.[6] ..... G03C 7/305; G03C 1/43

[52] U.S. Cl. ..... 430/219; 430/223; 430/264; 430/553; 430/555; 430/557; 430/558; 430/544; 430/957

[58] Field of Search ..... 430/544, 957, 430/219, 223, 264, 553, 555, 557, 558, 543

[56] References Cited

U.S. PATENT DOCUMENTS

| | | | |
|---|---|---|---|
| 1,574,944 | 3/1926 | Sheppard | 430/603 |
| 1,602,592 | 10/1926 | Sheppard | 430/603 |
| 1,623,499 | 4/1927 | Sheppard et al. | 430/599 |
| 3,297,446 | 1/1967 | Dunn | 96/107 |
| 3,297,447 | 1/1967 | McVeigh | 96/109 |
| 3,320,069 | 5/1967 | Illingsworth | 96/107 |
| 3,342,605 | 9/1967 | McCrossen et al. | 96/94 |
| 3,408,196 | 10/1968 | McVeigh | 96/108 |
| 3,408,197 | 10/1968 | McVeigh | 96/108 |
| 3,420,670 | 1/1969 | Milton | 96/109 |
| 3,425,835 | 2/1969 | Johnson et al. | 96/94 |
| 3,442,653 | 5/1969 | Dunn | 96/108 |
| 3,469,987 | 9/1969 | Owens et al. | 96/102 |
| 3,482,981 | 12/1969 | van Lare | 96/106 |
| 3,485,634 | 12/1969 | Owen et al. | 96/102 |
| 3,585,195 | 6/1971 | Heseltine et al. | 260/240.65 |
| 3,591,385 | 7/1971 | Evans | 96/107 |
| 3,658,546 | 4/1972 | van Doorselaer et al. | 96/100 |
| 3,660,101 | 5/1972 | Owens et al. | 96/120 |
| 3,674,478 | 7/1972 | Grasshoff et al. | 96/3 |
| 3,772,031 | 11/1973 | Berry et al. | 96/108 |
| 4,248,962 | 2/1981 | Lau | 430/382 |
| 4,269,929 | 5/1981 | Nothnagle | 430/264 |
| 4,409,323 | 10/1983 | Sato et al. | 430/544 |
| 4,414,304 | 11/1983 | Dickerson | 430/353 |
| 4,425,425 | 1/1984 | Abbott et al. | 430/502 |
| 4,425,426 | 1/1984 | Abbott et al. | 430/502 |
| 4,439,520 | 3/1984 | Kofron et al. | 430/434 |
| 4,477,563 | 10/1984 | Ichijima et al. | 430/544 |
| 4,629,683 | 12/1986 | Itoh et al. | 430/219 |
| 4,845,020 | 7/1989 | Itoh et al. | 430/219 |
| 5,026,628 | 6/1991 | Begley et al. | 430/957 |
| 5,229,248 | 7/1993 | Sanpei et al. | 430/264 |

FOREIGN PATENT DOCUMENTS

| | | | |
|---|---|---|---|
| 2059945 | 3/1987 | Japan | 430/957 |

*Primary Examiner*—Lee C. Wright
*Attorney, Agent, or Firm*—Finnegan, Henderson, Farabow, Garrett & Dunner, L.L.P.

[57] ABSTRACT

Disclosed is a silver halide photographic light-sensitive material comprising a support having on one side thereof hydrophilic colloid layers including a silver halide emulsion layer, wherein at least one of the hydrophilic colloid layers contains a redox compound having at least one carbonyl group, wherein said redox compound is capable of being oxidized with an oxidized product of a developing agent in a photographic processing so as to release a development inhibitor, and wherein said redox compound satisfies the following Formulae 1 through 3:

Formula 1 development inhibitor releasing rate (%) under a condition (A)≧4.5,

Formula 2 development inhibitor releasing rate (%) under a condition (B)<15.0,

Formula 3 development inhibitor releasing rate (%) under a condition (A)>development inhibitor releasing rate (%) under condition (B).

8 Claims, No Drawings

SILVER HALIDE PHOTOGRAPHIC LIGHT-SENSITIVE MATERIAL

FIELD OF THE INVENTION

The present invention relates to a silver halide photographic light-sensitive material and a processing method and, particularly to a black-and-white silver halide photographic light-sensitive material and a processing method therefor and particularly to a black-and-white silver halide photographic light-sensitive material for graphic plate-making and a processing method therefore.

In a photographic light-sensitive material for graphic plate-making, generally, photographic technologies capable of reproducing an ultra-hard image are known in order to use a dot image due to photographic properties. Of these, a photographic light-sensitive material containing a hydrazine derivative as shown in U.S. Pat. No. 4,269,929 is known. In addition, in graphic plate-making operations, a process to reproduce a dot image with high fidelity is contained. In order to prepare an excellent printing material, it is necessary to reproduce on a light-sensitive material for plate making a dot targeted with high fidelity. Recently, in the field of graphic plate-making, improvement in terms of dot quality has been demanded. For example, in the case of extremely fine printing of 600 or more lines/inch and a method called FM screening composed of uniformly minimum-sized point in a random pattern, it is necessary to reproduce fine points of 25 μm or less. In these technologies, it is necessary to reproduce fine dot points targeted with high fidelity when a contact operation wherein an image is exposed to light by the use of an image outputting machine loading a laser light-source such as an Ar laser, a HeNe laser and a semi-conductor laser or a dot image document to be transmitted is exposed to light by the use of a printer.

In a photographic plate-making process, there is a process which converts a continuous tone document to a dot image. For this process, a technology capable of reproducing a ultra-hard image is desired. Therefore, a method using a hydrazine derivative as described in Japanese Patent Application Open to Public Inspection (hereinafter, referred to as Japanese Patent O.P.I. Publication) No. 106244/1981 is used. Due to this method, an ultra-hard and high sensitivity photographic properties are obtained. However, its infectious development property is too strong. Therefore, in photographing a dot image, portions which are clear as the white background of the dots tend to be blackened. As a result, it has a shortcoming in terms of image quality wherein dot tones become extremely short and the reproducibility of the original document is degraded.

In order to improve reproducibility, it is insufficient to only reproduce optical information which the light-sensitive material received with high fidelity. A mechanism to inhibit development of only large point portions or clear portions of the thin lines of characters only selectively has been necessary.

As in the above-mentioned attempt, methods which release a development inhibitor in a silver imagewisely from a redox compound such as hydrazine derivatives disclosed in Japanese Patent O.P.I. Publication Nos. 213847/1986, 260153/1987 and 136839/1992 and hydroquinone derivatives disclosed in Japanese Patent O.P.I. Publication Nos. 438/1992, 563/1992, 6548/1992 and 6551/1992, are known.

However, the redox reactivity of the above-mentioned compounds tends to depend upon pH of the developing solution. When a light-sensitive material is processed with a developing solution having relatively low pH (pH=11 or less) and when a hydrazine derivative is used in combination as a contrast increasing agent, an ultra hard image can be obtained. However, specifically in a method which reproduces fine dots of 25 μm or less described as above, shortcomings easily occurs in that dot quality was deteriorated, reproducibility of fine dots was deteriorated and a problem which caused a black spot wherein unexposed portions were blackened pebbly (pepper fog).

SUMMARY OF THE INVENTION

Accordingly, an object of the present invention is to provide a silver halide photographic light-sensitive material wherein dot quality is difficult to deteriorate, dot reproducibility is difficult to deteriorate and the problem which causes pebble blackened portions, called black spots in unexposed portions (pepper fog) and a processing method therefor. Another object of the present invention is to provide a silver halide photographic light-sensitive material capable of obtaining a stable and ultra-hard image even with a developing solution having relatively low pH (pH=11 or less) and capable of obtaining a wide dot tone reproduction region and a processing method therefor.

The above-mentioned objects of the present invention were attained by the following constitutions:

Item (1) A silver halide photographic light-sensitive material comprising a support provided thereon with at least one silver halide emulsion layer, wherein at least one carbonyl group is contained, all of the following formulas (i) through (iii) are satisfied and at least one kind of a redox compound oxidized by a developing agent oxidized product in photographic processing and capable of releasing a development inhibitor.

(i) [Development inhibitor releasing rate under condition (A) (%)]≧4.5

(ii) [Development inhibitor releasing rate under condition (B) (%)]<15.0

(iii) [Development inhibitor releasing rate under condition (A) (%)]>[Development inhibitor releasing rate under condition (B) (%)]

Condition (A): Under a constant temperature of 35° C., 5 parts of a 50 μM methanol - acetonitrile (1:1) solution of a compound capable of releasing a development inhibitor and 1 part of an aqueous 100 mM hydrogen peroxide solution are mixed. To the mixture, 2 parts of carbonate buffer of pH of 10.2 is added, and then, after 30 seconds, 1 part of methanol solution of a 100 mM acetic acid is added.

Condition (B): Under a constant temperature of 35° C., 5 parts of a 50 μM methanol - acetonitrile (1:1) solution of a compound capable of releasing a development inhibitor and 1 part of distilled water are mixed. To the mixture, 2 parts of carbonate buffer of pH of 10.2 is added, and then, after 30 seconds, 1 part of methanol solution of a 100 mM acetic acid is added.

Development inhibitor releasing rate (%)=(Concentration of a development inhibitor measured/Concentration of the development inhibitor when released 100%)×100

Item (2) The silver halide photographic light-sensitive material described in Item (1) above, wherein a redox compound capable of releasing the above-mentioned development inhibitor satisfies the following Item (iv).

(iv) {[Development inhibitor releasing rate under the above-mentioned condition (A) (%)]/[Development inhibitor releasing rate under the above-mentioned condition (B) (%)]≧1.5

(3) The silver halide photographic light-sensitive material described in Item (1) or (2) above, wherein a redox compound capable of releasing the above-mentioned development inhibitor is represented by the following Formulas 1 through 6.

Formula 1

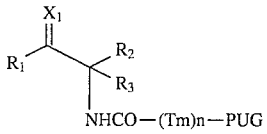

Formula 2

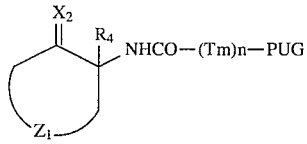

Formula 3

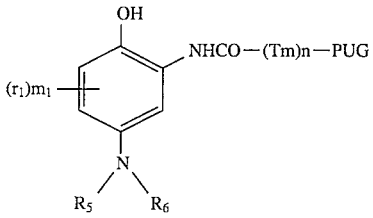

Formula 4

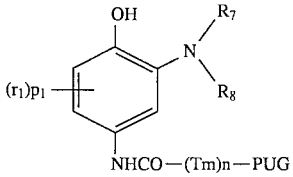

Formula 5

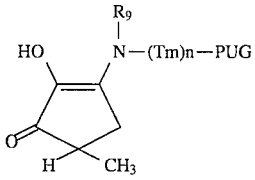

Formula 6

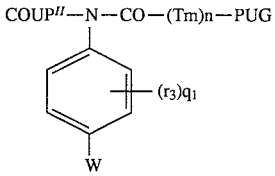

wherein $R_1$ represents an alkyl group, an aryl group or a heterocyclic group; $R_2$ and $R_3$ each represents a hydrogen atom, an acyl group, a carbamoyl group, a cyano group, a nitro group, a sulfonyl group, an aryl group, an oxalyl group, a heterocyclic group, an alkoxycarbonyl group or an aryloxycarbonyl group; $R_4$ represents a hydrogen atom; $R_5$ through $R_9$ each represents a hydrogen atom, an alkyl group, an aryl group or a heterocyclic group; $r^1$, $r^2$ and $r^3$ each represents a substituent capable of substituting on a benzene ring; $X_1$ and $X_2$ each represents O or NH; $Z_1$ represents an atom group necessary to form a 5-membered to 6-membered heterocyclic group; W represents $N(R_{10})R_{11}$ or OH; $R_{10}$ and $R_{11}$ each represents a hydrogen atom, an alkyl group, an aryl group or a heterocyclic group; COUP represents a coupler residue capable of causing a coupling reaction with an oxidation product of an aromatic group primary amine developing agent; H represents a coupling position of a coupler; Tm represents a timing group; $m_1$ and $p_1$ each represents an integer of 0 to 3; $q_1$ represents an integer of 0 to 3; n represents 0 or 1; and PUG represents a development inhibitor.

Item (4) The silver halide photographic light-sensitive material comprising a support provided thereon with at least one silver halide emulsion layer, at least one kind of hydrazine derivative in aforesaid silver halide emulsion layer and/or its adjacent layer and at least one kind of redox compound capable of releasing a development inhibitor due to being oxidized into at least one hydrophilic colloidal layer, wherein aforesaid redox compound is a redox compound described in Items (1), (2) or (3).

Item (5) A processing method of a silver halide photographic light-sensitive material comprising a support provided thereon with at least one silver halide emulsion layer, wherein aforesaid silver halide photographic light-sensitive material is subjected to photographic processing with a developing solution whose pH is 11 or less, at least one layer on the aforesaid silver halide photographic emulsion layer side, all of the following Items (i) through (iii) are satisfied and at least one kind of redox compounds oxidized by an oxidized product of a developing agent in photographic processing and capable of releasing a development inhibitor.

(i) [Development inhibitor releasing rate under condition (A) (%)]≧4.5

(ii) [Development inhibitor releasing rate under condition (B) (%)]<15.0

(iii) [Development inhibitor releasing rate under condition (A) (%)]>[Development inhibitor releasing rate under condition (B) (%)]

Condition (A): Under a constant temperature of 35° C., 5 parts of a 50 μM methanol - acetonitrile (1:1) solution of a compound capable of releasing a development inhibitor and 1 part of an aqueous 100 mM hydrogen peroxide solution are mixed. To the mixture, 2 parts of carbonate buffer of pH of 10.2 is added, and then, after 30 seconds, 1 part of methanol solution of a 100 mM acetic acid is added.

Condition (B): Under a constant temperature at 35° C., 5 parts of a 50 μM methanol - acetonitrile (1:1) solution of a compound capable of releasing a development inhibitor and 1 part of distilled water are mixed. To the mixture, 2 parts of carbonate buffer of pH of 10.2 is added, and then, after 30 seconds, 1 part of methanol solution of a 100 mM acetic acid is added.

Development inhibitor releasing rate (%)=(Density of a development inhibitor measured/Density of the development inhibitor when released 100%)×100

Item (6) The processing method of a silver halide photographic light-sensitive material described in Item (5) above, wherein a redox compound capable of releasing the above-mentioned development inhibitor satisfies the following item (iv).

(iv) {[Development inhibitor releasing rate under the above-mentioned condition (A) (%)]/[Development inhibitor releasing rate under the above-mentioned condition (B) (%)]≧1.5

Item (7) The processing method of a silver halide photographic light-sensitive material described in Item (5) or (6) above, wherein a redox compound capable of releasing the above-mentioned development inhibitor is represented by the following Formulas 1 through 6.

Formula 1

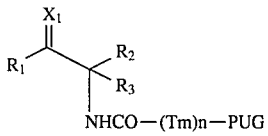

Formula 2

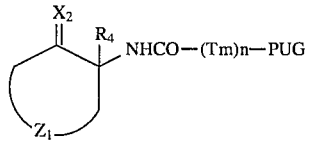

Formula 3

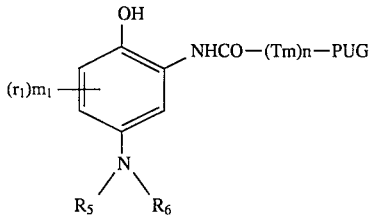

Formula 4

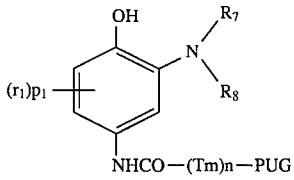

Formula 5

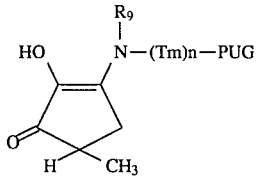

Formula 6

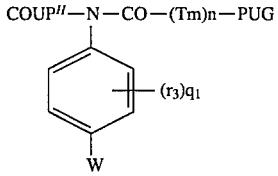

wherein $R_1$ represents an alkyl group, an aryl group or a heterocyclic group; $R_2$ and $R_3$ each represents a hydrogen atom, an acyl group, a carbamoyl group, a cyano group, a nitro group, a sulfonyl group, an aryl group, an oxalyl group, a heterocyclic group, an alkoxycarbonyl group or an aryloxycarbonyl group; $R_4$ represents a hydrogen atom; $R_5$ through $R_9$ each represents a hydrogen atom, an alkyl group, an aryl group or a heterocyclic group; $r^1$, $r^2$ and $r^3$ each represents a substituent capable of substituting on a benzene ring; $X_1$ and $X_2$ each represents O or NH; $Z_1$ represents an atom group necessary to form a 5- or 6-membered heterocyclic group; W represents $N(R_{10})R_{11}$ or OH; $R_{10}$ and $R_{11}$ each represents a hydrogen atom, an alkyl group, an aryl group or a heterocyclic group; COUP represents a coupler residue capable of causing a coupling reaction with an oxidation product of an aromatic group primary amine developing agent; H represents a coupling position of a coupler; Tm represents a timing group; $m_1$ and $p_1$ each represents an integer of 0 to 3; $q_1$ represents an integer of 0 to 3; n represents 0 or 1; and PUG represents a development inhibitor.

Item (8) The processing method of the silver halide photographic light-sensitive material comprising a support provided thereon with at least one silver halide emulsion layer, at least one kind of hydrazine derivative in aforesaid silver halide emulsion layer and/or its adjacent layer and at least one kind of redox compound capable of releasing a development inhibitor due to being oxidized into at least one hydrophilic colloidal layer, wherein aforesaid redox compound is a redox compound described in Items (5), (6) or (7).

Hereunder, the present invention is explained practically.

In the present invention, the development inhibitor releasing rate can be measured by the following method.

Under condition (A), to a solution of a compound of the present invention, hydrogen peroxide is added as a substituent for oxidization product of a developing agent. The resulting mixture is conditioned to an alkaline solution whose pH is 10.2. Thirty seconds after, acetic acid is added, and then, the reaction is stopped. The density of the released inhibitor was determined by high speed liquid chromatography. It was determined by comparing a peak area to an inhibitor solution having the already-known density. The development inhibitor releasing rate (%) under condition (A) is calculated by (density of the inhibitor measured/density of the inhibitor when released 100%).

Under condition (B), in the same manner as in condition (A) except that hydrogen peroxide was not used at all as a substituent for an oxidation product of a developing agent, the development inhibitor releasing rate (%) under condition (B) is calculated. The development inhibitor releasing rate (%) under condition (B) represents a rate wherein the development inhibitor is released by means of a nucleophilic reaction without being oxidized by an oxidized product of the developing agent.

When photographic processing is conducted with a developing solution whose pH is 11 or less, A (%) is preferably 4.5 or more, and more preferably 10 or more. B (%) is preferably 15 or less, and more preferably 10 or less. In addition, A (%)/B (%) is necessary to be not less than 1, and preferably 1.5 or more.

Next, a redox compound capable of releasing a development inhibitor by being oxidized will be explained.

Redox compounds contain hydroquinones, cathecols, nahpthohydroquinones, aminophenols, pyrazolidones, hydrazines and reductones as a redox group.

Preferable redox compound are represented by the above-mentioned Formulas 1, 2, 3, 4, 5 or 6.

The redox compound can be contained in an emulsion layer, a hydrophilic colloidal layer adjacent to the emulsion layer and a hydrophilic colloidal layer through an intermediate layer.

The redox compounds can be added after being dissolved in alcohols such as methanol and ethanol, glycols such as ethylene glycol, triethylene glycol and propylene glycol, ether, dimethylformamide, dimethylsulfooxide, tetrahydrofuran, esters such as ethyl acetate and ketones such as acetone and methylethylketone. These solutions are added to gelatin in advance for removing a solvent, and then, they can be added after dispersing the redox compound in a solid state. In addition, those which are difficult to be dissolved can be dispersed arbitrarily by high speed impeller dispersion, sand mill dispersion, supersonic dispersion and ball mill dispersion wherein the average particle size is from 0.01 to 6 μm. For dispersion, an anion and nonion surface activator, a viscosity increasing agent and latex can be added for dispersing. The addition amount is $10^{-6}$ to $10^{-1}$ mol and preferably $10^{-4}$ to $10^{-2}$ mol per mol of silver halide.

Next, the redox compounds represented by the above-mentioned Formulas 1, 2, 3, 4, 5 or 6 (below).

Formula 1

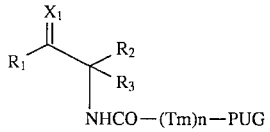

Formula 2

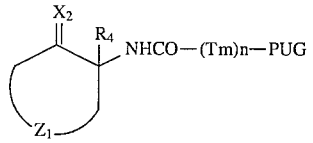

Formula 3

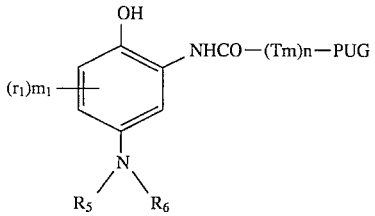

Formula 4

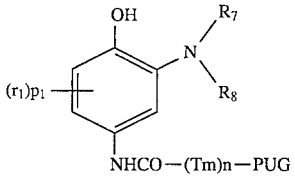

Formula 5

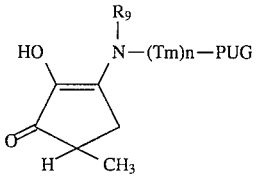

Formula 6

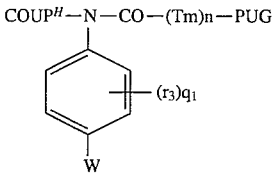

wherein $R_1$ represents an alkyl group, an aryl group or a heterocyclic group; $R_2$ and $R_3$ each represents a hydrogen atom, an acyl group, a carbamoyl group, a cyano group, a nitro group, a sulfonyl group, an aryl group, an oxalyl group, a heterocyclic group, an alkoxycarbonyl group or an aryloxycarbonyl group; $R_4$ represents a hydrogen atom; $R_5$ through $R_9$ each represents a hydrogen atom, an alkyl group, an aryl group or a heterocyclic group; $r^1$, $r^2$ and $r^3$ each represents a substituent capable of substituting on a benzene ring; $X_1$ and $X_2$ each represents O or NH; $Z_1$ represents an atom group necessary to form a 5- or 6-membered heterocyclic group; W represents $N(R_{10})R_{11}$ or OH; $R_{10}$ and $R_{11}$ each represents a hydrogen atom, an alkyl group, an aryl group or a heterocyclic group; COUP represents a coupler residue capable of causing a coupling reaction with an oxidation product of an aromatic primary amine developing agent; H represents a coupling position of a coupler; Tm represents a timing group; $m_1$ and $p_1$ each represents and integer of 0 to 3; $q_1$ represents an integer of 0 to 3; n represents 0 or 1; and PUG represents a development inhibitor.

In the above-mentioned Formulas 1, 2, 3, 4, 5 or 6, as an alkyl group, an aryl group and a heterocyclic group represented by $R_1$, $R_5$ through $R_{11}$, a methyl group, a p-methoxyphenyl group and a pyridyl group are preferably cited. Among an acyl group, a carbamoyl group, a cyano group, a nitro group, a sulfonyl group, an aryl group, an oxalyl group a heterocyclic group, an alkoxycarbonyl group an aryloxycarbonyl group, represented by $R_2$ and $R_3$ the acyl group, the carbamoyl group and the cyano group are preferably cited. The sum of carbon numbers in the above-mentioned groups is preferably 1 to 20. $R_1$ through $R_{11}$ may further have a substituent. As the aforesaid substituent, for example, halogen atoms (a chlorine atom and a bromine atom), alkyl groups (for example, a methyl group, an ethyl group, an isopropyl group, a hydroxyethyl group, a methoxymethyl group, a trifluoromethyl group and a t-butyl group), cycloalkyl groups (for example, a cyclopentyl group and a cyclohexyl group), aralkyl groups (for example, a benzyl group and a 2-phenetyl group), aryl groups (for example, a phenyl group, a naphtyl group, a p-tolyl group and a p-chlorophenyl group), alkoxy groups (for example, a methoxy group, an ethoxy group, an isopropoxy group and a buthoxy group), aryloxy groups (for example, a phenoxy group), a cyano group, acylamino groups (for example, an acetylamino group and a propionyl amino group), alkylthio groups (for example, a methylthio group, an ethylthio group and a buthylthio group), arylthio groups (for example, a phenylthio group), sulfonylamino groups (for example, a methansulfonylamino group and a benzene sulfonylamino group), ureido groups (for example, a 3-methylureido group, a 3,3-dimethylureido group and a 1,3-dimethylureido group), sulfamoyl amino groups (a dimethylsulfamoylamino group), sulfamoylamino groups (a dimethylsulfamoylamino group), carbamoyl groups (for example, a methylcabamoyl group, an ethylcarbamoyl group and a dimethylcarbamoyl group), sulfamoyl groups (for example, an ethylsulfamoyl group and a dimethylsulfamoyl group), alkoxycarbonyl groups (for example, a methoxycarbonyl group and an ethoxycarbonyl group), aryloxy carbonyl groups (for example, a phenoxycarbonyl group), sulfonyl groups (for example, a methansulfonyl group, a buthansulfonyl group and a phenyl sulfonyl group), acyl groups (for example, an acetyl group, a propanoyl group and a butyloyl group), amino groups (a methylamino group, an ethylamino group and a dimethylamino group), a hydroxy group, a nitro group, imido groups (for example a phthalimido group) and heterocyclic groups (for example, a pyridyl group, a benzimidazolyl group, a benzthiazolyl group and a benzoxazolyl group) are cited.

As a coupler residue group represented by Coup, the following can be cited. As a cyan coupler residue, a phenol coupler and a naphthol coupler are cited. As a magenta coupler, a 5-pyrazolone coupler, a pyrazolone coupler, a cyanoacetylcoumarone coupler, an open-chained acetonitrile coupler and an indazolone coupler are cited. As a yellow coupler residue, a benzoyl acetoanilido coupler, a pivaloyl acetoanilido coupler and a malonic dianilido coupler are cited. As a non-coloration coupler residue, open-chained or cyclic active methylene compounds (for example, indanone, cyclopentanone, diester of malonic acid, imidazolinone, oxazolinone and thiazolinone) are cited. In addition, among coupler residue represented by Coup, the ones preferably used can be represented by Formula (Coup-1) through (Coup-8).

Formula (Coup-1)

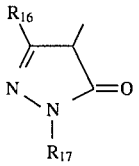

wherein $R_{16}$ represents an acylamido group, an anilino group or an ureido group; and $R_{17}$ represents a phenyl group which may be substituted by one or more halogen atom, an alkyl group, an alkoxy group or a cyano group.

Formula (Coup-2)

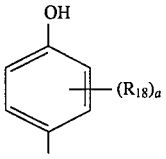

Formula (Coup-3)

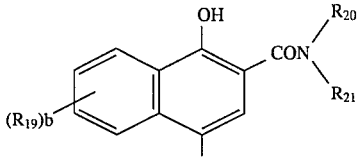

wherein $R_{18}$ and $R_{19}$ each represents a halogen atom, an acylamido group, an alkoxycarbonyl amido group, a sulfoureido group, an alkoxy group, an alkylthio group, a hydroxy group or an aliphatic group; $R_{20}$ and $R_{21}$ each represents an aliphatic group, an aromatic group or a heterocyclic group; either of $R_{20}$ or $R_{21}$ may be a hydrogen atom; a is an integer of 1 through 4; b represents an integer of 0 through 5; when a and b are plural, $R_{18}$ may be the same or different from each other; and $R_{19}$ may also be the same or different.

Formula (Coup-4)

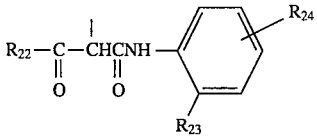

Formula (Coup-5)

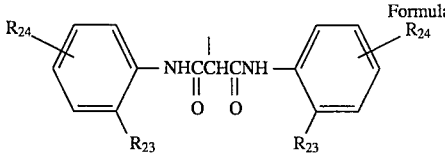

wherein $R_{22}$ represents a tertiary alkyl group or an aromatic group; $R_{23}$ represents a hydrogen atom, a halogen atom or an alkoxy group; $R_{24}$ represents an acylamido group, an aliphatic group, an alkoxycarbonyl group, a sulfamoyl group, a carbamoyl group, an alkoxy group, a halogen atom or a sulfonamido group.

Formula (Coup-6)

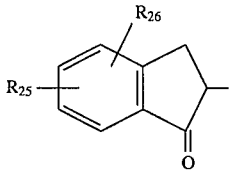

wherein $R_{25}$ represents an aliphatic group, an alkoxy group, an acylamido group, a sulfonamido grooup, a sulfamoyl group, a diacylamino group; and $R_{26}$ represents a hydrogen atom, a halogen atom and a nitro group.

Formula (Coup-7)

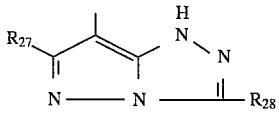

Formula (Coup-8)

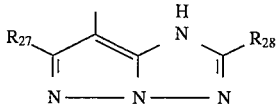

$R_{27}$ and $R_{28}$ each represents a hydrogen atom, an aliphatic group, an aromatic group and a heterocyclic group.

As a 5- or 6-membered heterocyclic group represented by $Z_1$, a mono-ring and a condensed-ring may be employed. A 5 or 6-membered heterocyclic group having at least one kind of O, S and N atom inside the ring are cited. A substituent may be provided on the ring thereof. Practically, the above-mentioned substituent may be cited.

As a timing group represented by Tm, preferably, —$OCH_2$— or another divalent timing group such as those described in U.S. Pat. Nos. 4,248,962, 4,409,323 or 3,674,478, Research disclosure 21228 (December, 1981), or Japanese Patent O.P.I. Publication Nos. 56837/1982 and 438/1992 are cited.

As a preferable development inhibitor as PUG, development inhibitors described in U.S. Pat. No. 4,477,563 and Japanese Patent O.P.I. Publication Nos. 218644/1985, 221750/1985, 233650/1985 or 11743/1986 are cited.

Hereunder, practical examples of compounds represented by Formulas 1 through 6 are exemplified. However, the present invention is not limited thereto.

Tm-1

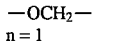

Tm-2

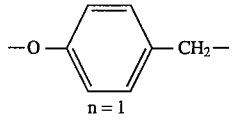

Tm-3

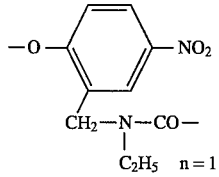

Tm-4

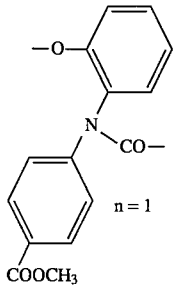

Tm-5

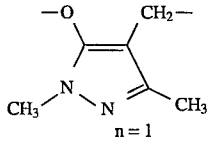

Tm-6

-continued
PUG1
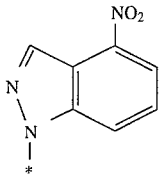
PUG2
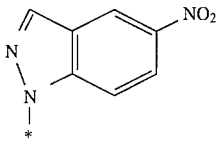
PUG3
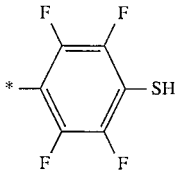
PUG4
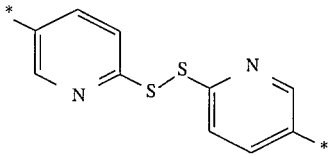
PUG5
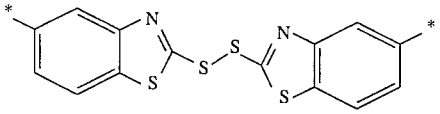
PUG6
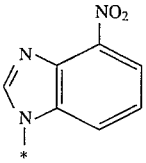
PUG7
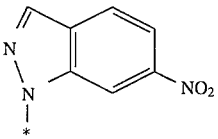
PUG8
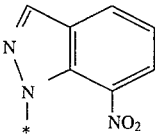
PUG9
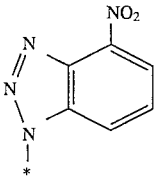
PUG10
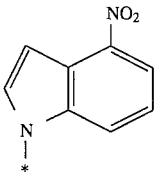
-continued
*: Coupling position
| Compound No. | PUG | Tm |
|---|---|---|
| | 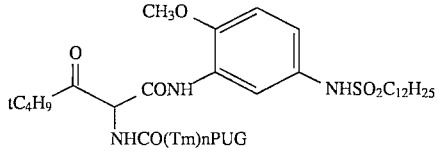 | |
| 1 | 1 | 6 |
| 2 | 3 | 6 |
| 3 | 4 | 2 |
| 4 | 6 | 2 |
| 5 | 7 | 3 |
| | 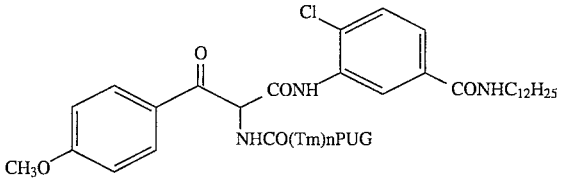 | |
| 6 | 1 | 6 |
| 7 | 2 | 6 |
| 8 | 3 | 1 |
| 9 | 5 | 1 |
| 10 | 8 | 2 |
| | 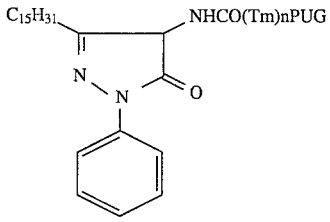 | |
| 11 | 1 | 6 |
| 12 | 3 | 6 |
| 13 | 4 | 1 |
| 14 | 7 | 2 |
| 15 | 10 | 4 |
| | 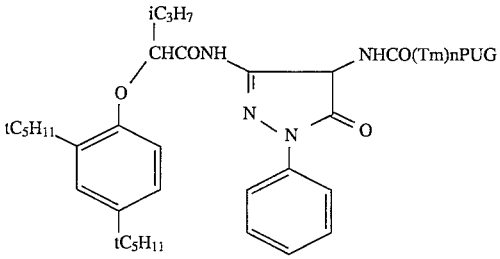 | |
| 16 | 1 | 6 |
| 17 | 3 | 6 |
| 18 | 4 | 1 |
| 19 | 8 | 2 |
| 20 | 9 | 5 |

| Compound No. | PUG | Tm |
|---|---|---|
| 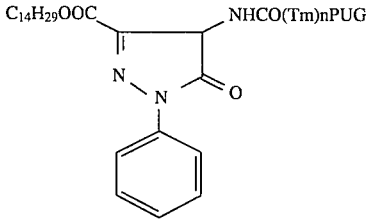 | | |
| 21 | 1 | 6 |
| 22 | 3 | 1 |
| 23 | 4 | 2 |
| 24 | 7 | 4 |
| 25 | 9 | 5 |
| 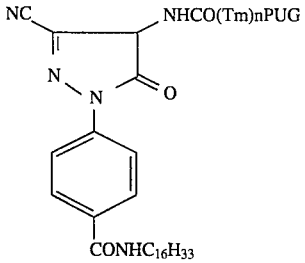 | | |
| 26 | 1 | 6 |
| 27 | 4 | 6 |
| 28 | 5 | 2 |
| 29 | 6 | 4 |
| 30 | 8 | 5 |
| 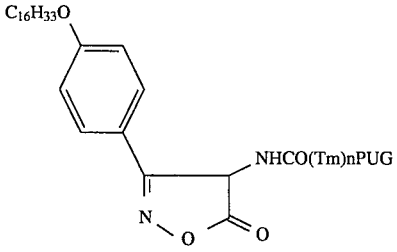 | | |
| 31 | 2 | 6 |
| 32 | 4 | 6 |
| 33 | 8 | 1 |
| 34 | 9 | 2 |
| 35 | 10 | 5 |
| 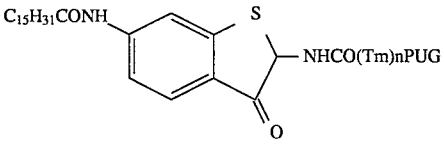 | | |
| 36 | 2 | 6 |
| 37 | 3 | 6 |
| 38 | 6 | 4 |
| 39 | 8 | 5 |
| 40 | 10 | 1 |
| 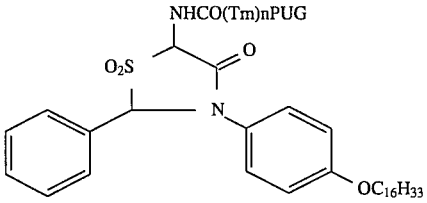 | | |
| Compound No. | PUG | Tm |
|---|---|---|
| 41 | 1 | 6 |
| 42 | 3 | 6 |
| 43 | 4 | 3 |
| 44 | 7 | 4 |
| 45 | 8 | 2 |
| 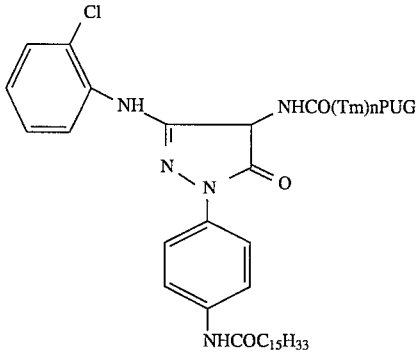 | | |
| 46 | 1 | 6 |
| 47 | 2 | 1 |
| 48 | 4 | 2 |
| 49 | 6 | 4 |
| 50 | 9 | 5 |
| 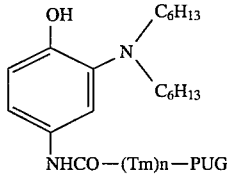 | | |
| 51 | 1 | 6 |
| 52 | 3 | 6 |
| 53 | 4 | 2 |
| 54 | 6 | 2 |
| 55 | 7 | 3 |
| 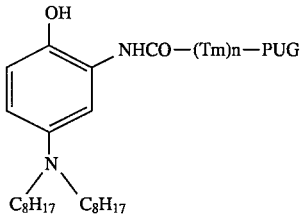 | | |
| 56 | 1 | 6 |
| 57 | 2 | 6 |
| 58 | 3 | 1 |
| 59 | 5 | 1 |
| 60 | 8 | 2 |
| 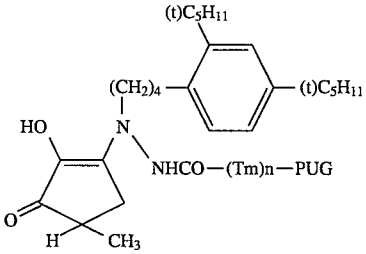 | | |
| 61 | 1 | 6 |
| 62 | 3 | 6 |
| 63 | 4 | 1 |
| 64 | 7 | 2 |

-continued
| Compound No. | PUG | Tm |
|---|---|---|
| 65 | 10 | 4 |
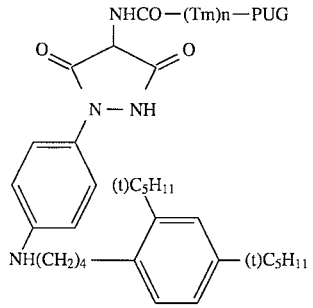
| | | |
|---|---|---|
| 66 | 1 | 6 |
| 67 | 3 | 6 |
| 68 | 4 | 1 |
| 69 | 8 | 2 |
| 70 | 9 | 5 |
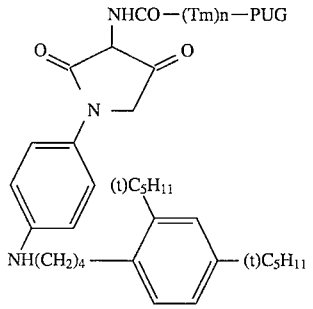
| | | |
|---|---|---|
| 71 | 1 | 6 |
| 72 | 3 | 1 |
| 73 | 4 | 2 |
| 74 | 7 | 4 |
| 75 | 9 | 5 |
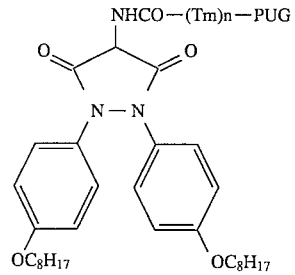
| | | |
|---|---|---|
| 76 | 1 | 6 |
| 77 | 4 | 6 |
| 78 | 5 | 6 |
| 79 | 6 | 4 |
| 80 | 8 | 5 |
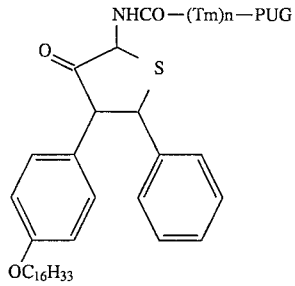
-continued
| Compound No. | PUG | Tm |
|---|---|---|
| 81 | 2 | 6 |
| 82 | 4 | 6 |
| 83 | 8 | 1 |
| 84 | 9 | 2 |
| 85 | 10 | 5 |
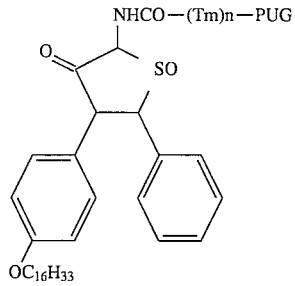
| | | |
|---|---|---|
| 86 | 2 | 6 |
| 87 | 3 | 6 |
| 88 | 6 | 4 |
| 89 | 8 | 5 |
| 90 | 10 | 1 |
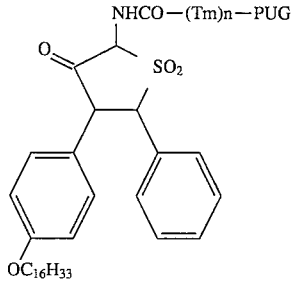
| | | |
|---|---|---|
| 91 | 1 | 6 |
| 92 | 3 | 6 |
| 93 | 4 | 3 |
| 94 | 7 | 4 |
| 95 | 8 | 2 |
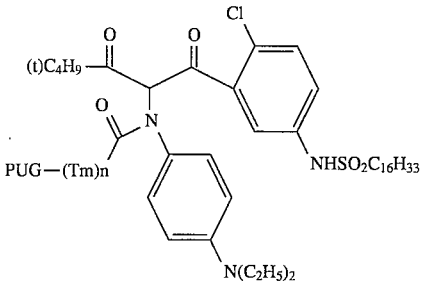
| | | |
|---|---|---|
| 96 | 1 | 6 |
| 97 | 2 | 1 |
| 98 | 4 | 2 |
| 99 | 6 | 4 |
| 100 | 9 | 5 |

-continued
| Compound No. | PUG | Tm |
|---|---|---|
| 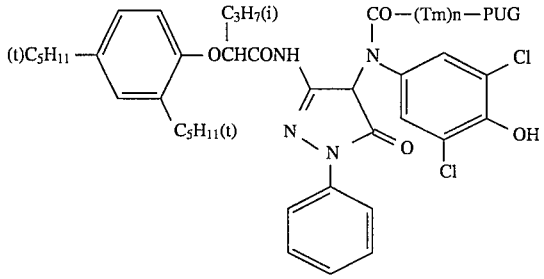 | | |
| 101 | 2 | 6 |
| 102 | 3 | 6 |
| 103 | 4 | 3 |
| 104 | 5 | 4 |
| 105 | 9 | 5 |
| 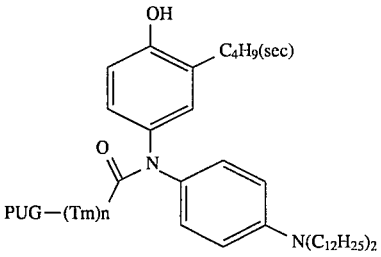 | | |
| 106 | 3 | 6 |
| 107 | 6 | 6 |
| 108 | 5 | 3 |
| 109 | 8 | 4 |
| 110 | 10 | 2 |
| 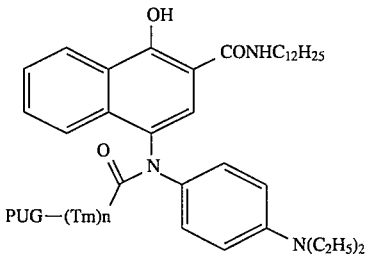 | | |
| 111 | 1 | 6 |
| 112 | 3 | 6 |
| 113 | 4 | 1 |
| 114 | 8 | 1 |
| 115 | 10 | 3 |
| 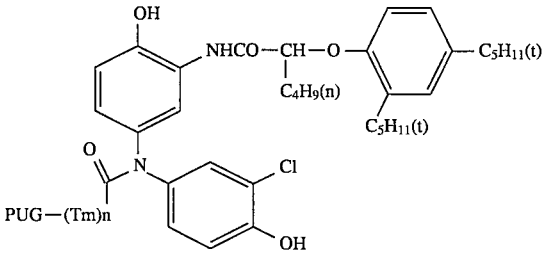 | | |
| 116 | 1 | 6 |
| 117 | 3 | 6 |
| 118 | 4 | 1 |
| 119 | 5 | 2 |
| 120 | 6 | 3 |
| | |
|---|---|
| $-OCH_2-*$ | Tm-1 |
| 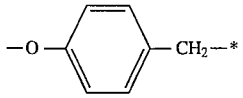 | Tm-2 |
| 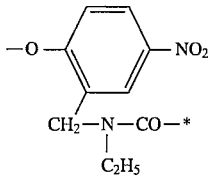 | Tm-3 |
| 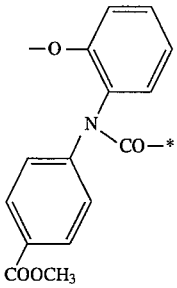 | Tm-4 |
| 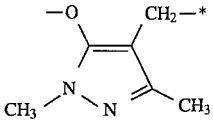 | Tm-5 |
| 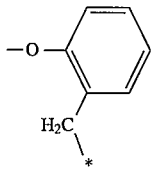 | Tm-6 |
| 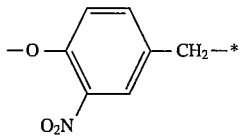 | Tm-7 |
| 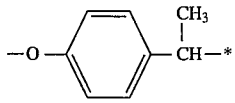 | Tm-8 |
| 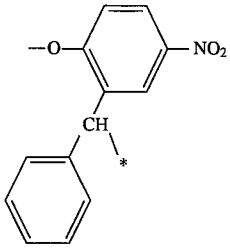 | Tm-9 |
| 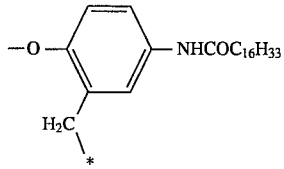 | Tm-10 |

-continued
Tm-11
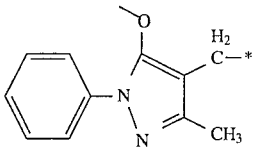
Tm-12
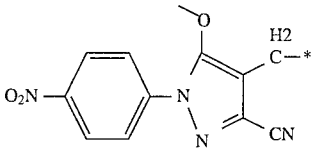
Tm-13
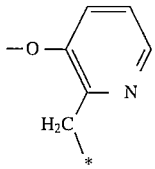
Tm-14
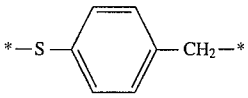
Tm-15
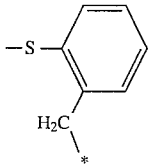
Tm-16
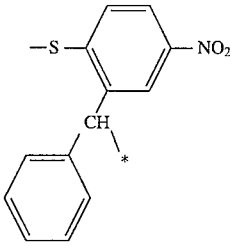
Tm-17
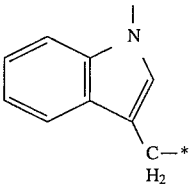
Tm-18
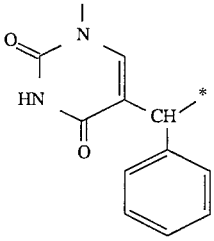
Tm-19
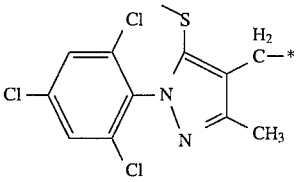
-continued
Tm-20
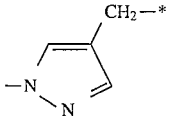
Tm-21
n = 0
*Coupling position
*—PUG
1
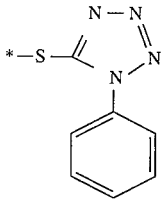
2
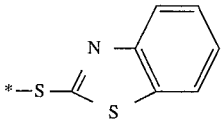
3
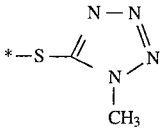
4
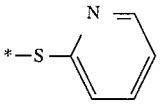
5
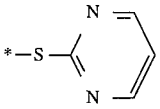
6
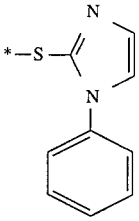
7
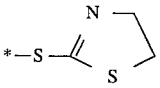
8
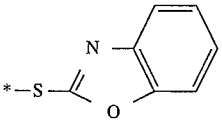
9
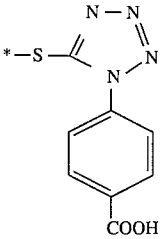

-continued
10
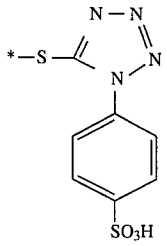
11
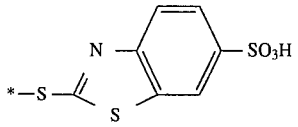
12
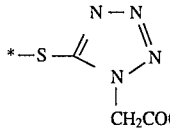
13
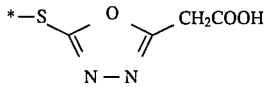
14
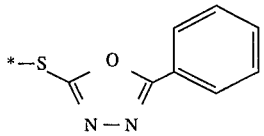
15
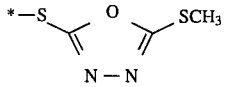
16
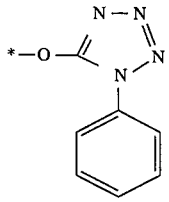
17
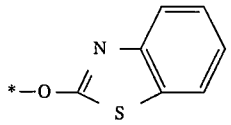
18
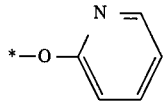
19
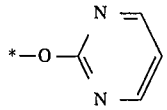
-continued
20
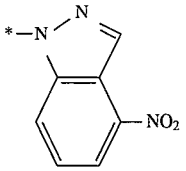
21
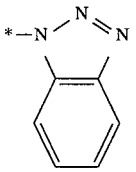
22
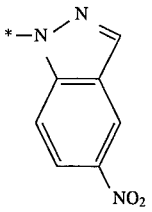
23
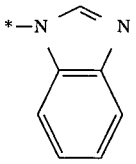
24
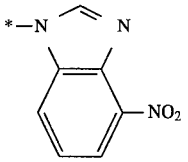
25
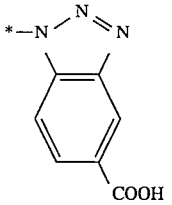
26
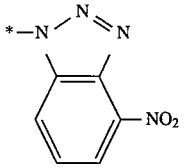
27
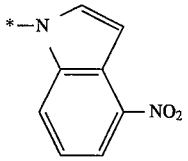
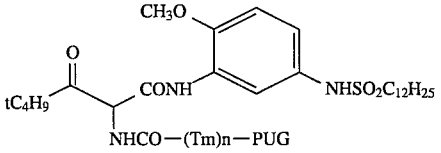
Compound No. 1A–No. 5A -continued
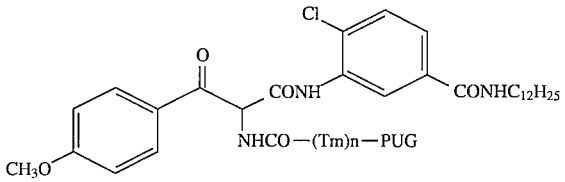
Compound No. 6A–No. 10A
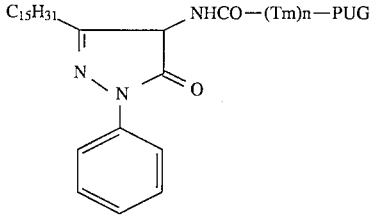
Compound No. 11A–No. 15A
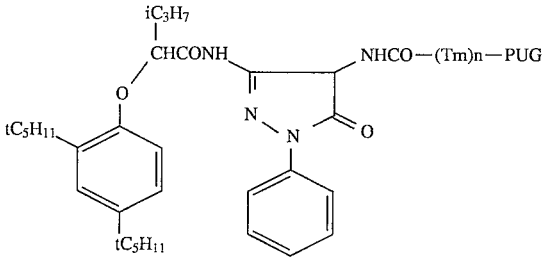
Compound No. 16A–No. 25A
Compound No. 26A–No. 30A
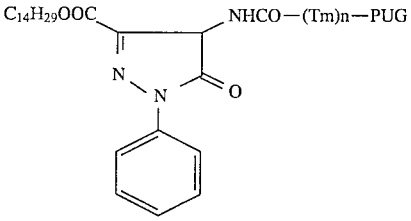
Compound No. 31A–No. 35A
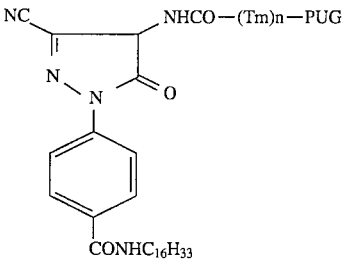
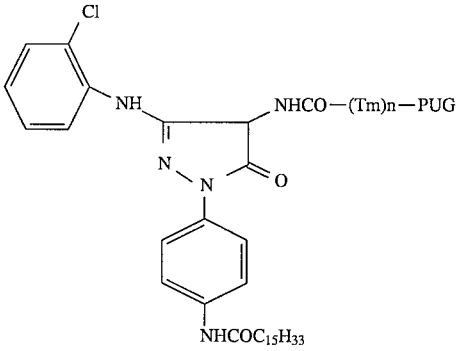
Compound No. 36A–No. 40A
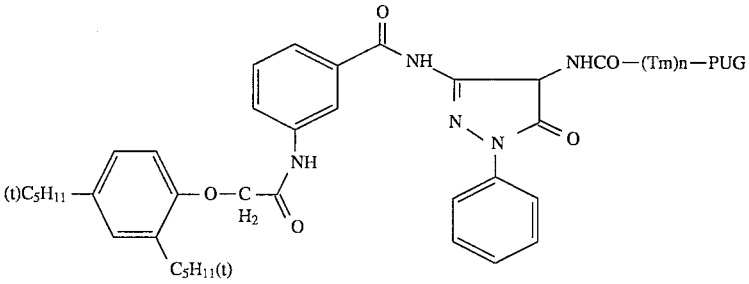
Compound No. 41A–No. 45A -continued
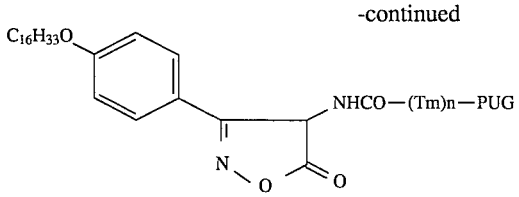
Compound No. 46A–50A
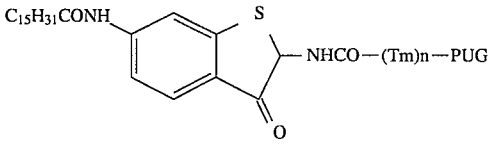
Compound No. 51A–No. 55A
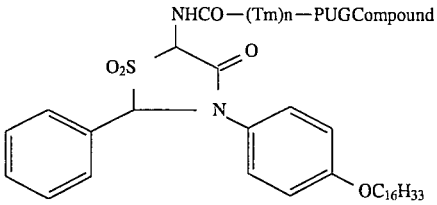
Compound No. 56A–No. 60A
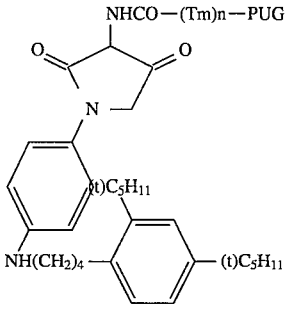
Compound No. 61A–No. 65A
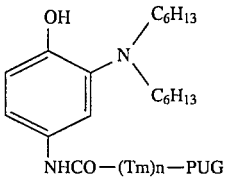
Compound No. 66A–No. 70A
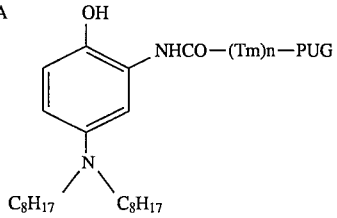
Compound No. 71A–No. 75A
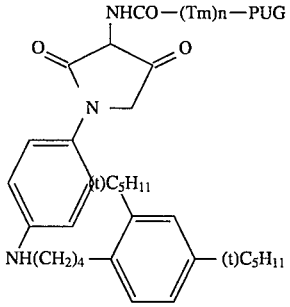
Compound No. 76A–80A
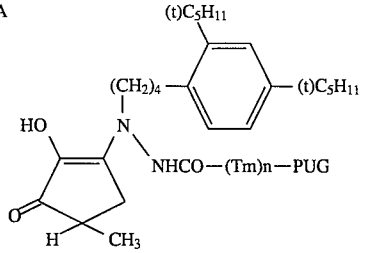
Compound No. 81A–No. 85A
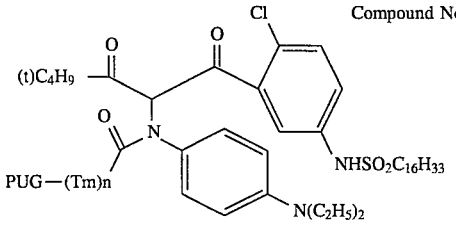
Compound No. 86A–No. 90A
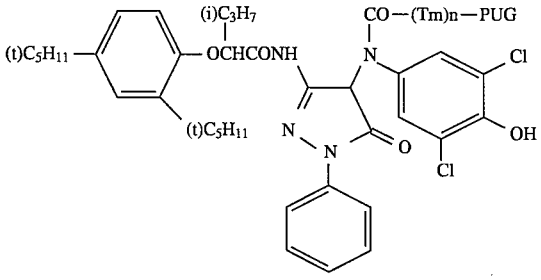
Compound No. 91A–No. 95A -continued
Compound No. 96A–No. 100A
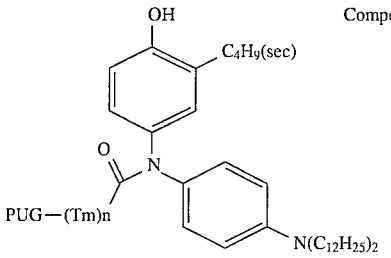
Compound No. 101A–No. 105A
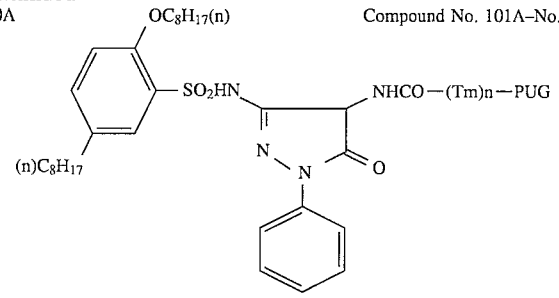
Compound No. 106A–No. 110A
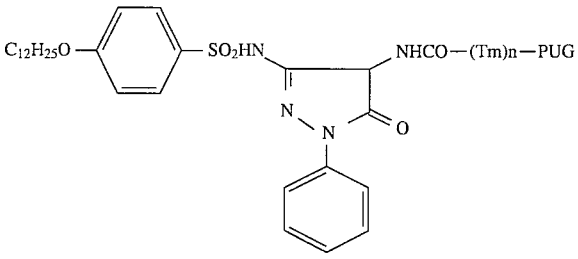
| Compound No. | Tm | PUG |
|---|---|---|
| 1A | 1 | 1 |
| 2A | 2 | 4 |
| 3A | 4 | 14 |
| 4A | 17 | 17 |
| 5A | 21 | 22 |
| 6A | 2 | 2 |
| 7A | 3 | 6 |
| 8A | 6 | 10 |
| 9A | 11 | 13 |
| 10A | 20 | 24 |
| 11A | 1 | 1 |
| 12A | 2 | 5 |
| 13A | 5 | 2 |
| 14A | 6 | 15 |
| 15A | 17 | 3 |
| 16A | 1 | 1 |
| 17A | 2 | 1 |
| 18A | 2 | 4 |
| 19A | 2 | 5 |
| 20A | 6 | 2 |
| 21A | 8 | 5 |
| 22A | 8 | 1 |
| 23A | 18 | 22 |
| 24A | 20 | 2 |
| 25A | 21 | 20 |
| 26A | 2 | 4 |
| 27A | 4 | 8 |
| 28A | 12 | 9 |
| 29A | 13 | 12 |
| 30A | 16 | 16 |
| 31A | 2 | 3 |
| 32A | 7 | 7 |
| 33A | 8 | 11 |
| 34A | 14 | 14 |
| 35A | 19 | 18 |
| 36A | 2 | 2 |
| 37A | 5 | 8 |
| 38A | 9 | 18 |
| 39A | 10 | 21 |
| 40A | 19 | 27 |
| 41A | 2 | 4 |
| 42A | 2 | 5 |
| 43A | 5 | 15 |
| 44A | 6 | 6 |
| 45A | 21 | 26 |
| 46A | 1 | 2 |
| 47A | 2 | 4 |
| 48A | 8 | 8 |
-continued
| Compound No. | Tm | PUG |
|---|---|---|
| 49A | 14 | 12 |
| 50A | 20 | 19 |
| 51A | 2 | 1 |
| 52A | 5 | 3 |
| 53A | 9 | 2 |
| 54A | 16 | 7 |
| 55A | 18 | 13 |
| 56A | 2 | 24 |
| 57A | 3 | 1 |
| 58A | 9 | 8 |
| 59A | 18 | 7 |
| 60A | 21 | 20 |
| 61A | 2 | 2 |
| 62A | 3 | 17 |
| 63A | 6 | 15 |
| 64A | 12 | 11 |
| 65A | 15 | 6 |
| 66A | 1 | 1 |
| 67A | 5 | 5 |
| 68A | 6 | 23 |
| 69A | 9 | 21 |
| 70A | 14 | 3 |
| 71A | 2 | 22 |
| 72A | 8 | 13 |
| 73A | 10 | 1 |
| 74A | 13 | 4 |
| 75A | 17 | 9 |
| 76A | 2 | 12 |
| 77A | 5 | 24 |
| 78A | 16 | 15 |
| 79A | 18 | 17 |
| 80A | 20 | 2 |
| 81A | 1 | 2 |
| 82A | 3 | 6 |
| 83A | 8 | 9 |
| 84A | 13 | 4 |
| 85A | 17 | 19 |
| 86A | 1 | 15 |
| 87A | 2 | 1 |
| 88A | 4 | 2 |
| 89A | 7 | 4 |
| 90A | 11 | 8 |
| 91A | 3 | 27 |
| 92A | 6 | 25 |
| 93A | 14 | 9 |
| 94A | 20 | 1 |
| 95A | 21 | 5 |
| 96A | 1 | 14 |

-continued
| Compound No. | Tm | PUG |
|---|---|---|
| 97A | 3 | 15 |
| 98A | 18 | 1 |
| 99A | 19 | 6 |
| 100A | 21 | 5 |
| 101A | 2 | 4 |
| 102A | 8 | 5 |
| 103A | 8 | 1 |
| 104A | 1 | 15 |
-continued
| Compound No. | Tm | PUG |
|---|---|---|
| 105A | 17 | 18 |
| 106A | 2 | 4 |
| 107A | 8 | 5 |
| 108A | 8 | 1 |
| 109A | 1 | 20 |
| 110A | 14 | 23 |
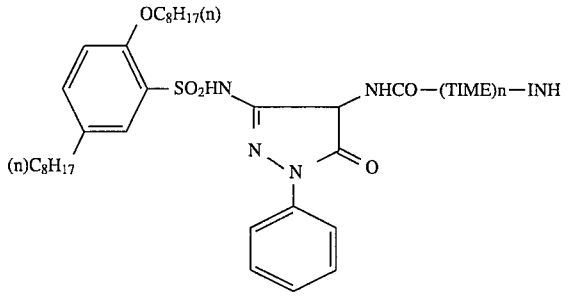
Compound No.1B–No. 10B
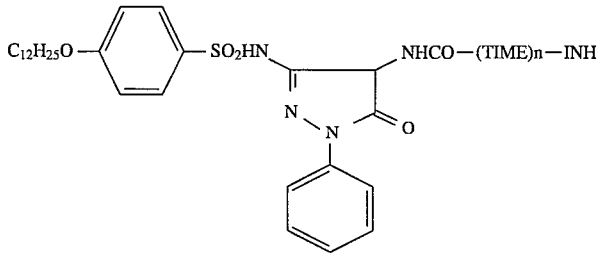
Compound No.11B–No.20B
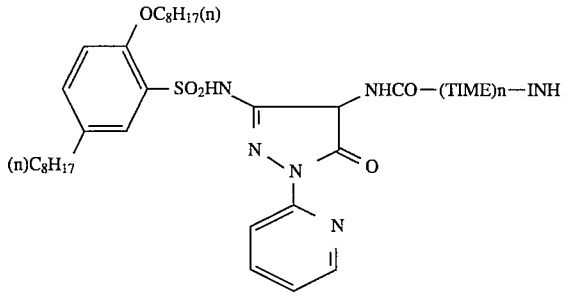
Compound No.21B–No.25B
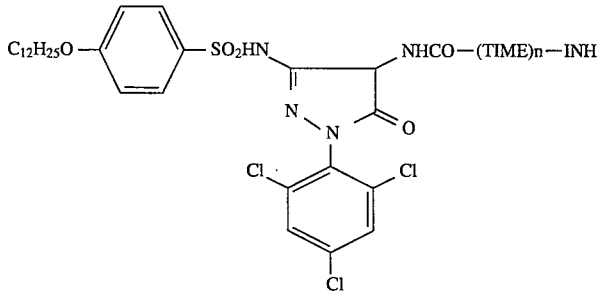
Compound No.26B–No.30B
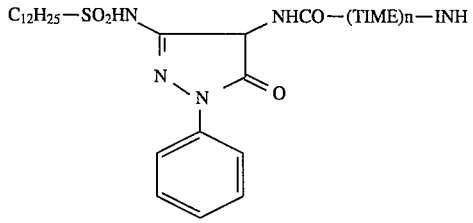
Compound No.31B–No.35B

| Compound No. | TIME | PUG |
|---|---|---|
| 1B | 8 | 5 |
| 2B | 8 | 1 |
| 3B | 2 | 5 |
| 4B | 2 | 1 |
| 5B | 8 | 2 |
| 6B | 8 | 4 |
| 7B | 17 | 15 |
| 8B | 20 | 10 |
| 9B | 21 | 20 |
| 10B | 21 | 5 |
| 11B | 8 | 5 |
| 12B | 8 | 1 |
| 13B | 2 | 5 |
| 14B | 2 | 1 |
| 15B | 1 | 1 |
| 16B | 6 | 8 |
| 17B | 11 | 3 |
| 18B | 13 | 11 |
| 19B | 19 | 16 |
| 20B | 20 | 6 |
| 21B | 8 | 5 |
| 22B | 2 | 1 |
| 23B | 7 | 9 |
| 24B | 14 | 18 |
| 25B | 17 | 4 |
| 26B | 8 | 5 |
| 27B | 2 | 1 |
| 28B | 4 | 2 |
| 29B | 9 | 12 |
| 30B | 10 | 23 |
| 31B | 8 | 5 |
| 32B | 2 | 1 |
| 33B | 16 | 14 |
| 34B | 18 | 16 |
| 35B | 20 | 2 |

Compounds represented by Formula 1 through 6 of the present invention are preferably $1\times10^{-6}$ mol to $5\times10^{-2}$ mol and specifically preferably $1\times10^{-4}$ mol to $2\times10^{-2}$ mol per mol of silver halide.

The compounds of the present invention can be used by being dissolved in a suitable organic solvent capable of mixing with water, for example, alcohols, ketones, dimethylsulfoxide, dimethylformamide and methylcellosolve. In addition, they can be added in the form of an emulsified and dispersed product using a conventional oil. In addition, by means of a method known as a solid dispersion method, powder of the compounds are dispersed in water by the use of a ball mill, colloid mill, impeller dispersion machine or supersonic wave prior to using.

The redox compound of the present invention can be present in a silver halide emulsion layer, in a layer adjacent to the emulsion layer and in other layer through the adjacent layers. In order to enhance the effects of the development inhibitor released from the redox compound, it is preferable that a layer wherein the redox compound exists is set to be adjacent to the emulsion layer through an intermediate layer. Practical layer structure from a support is an adhesive layer/a crossing light shielding layer or an anti-halation layer/the emulsion layer/the intermediate layer/a layer containing a redox compound/a protective layer. In addition, it is also possible to use an order from the support that the adhesive layer/the crossing light shielding layer or an anti-halation layer/a layer containing a redox compound/the intermediate layer/the emulsion layer/the protective layer. Gelatin used for the above-mentioned layers can be swelled by a conventional crosslinking agent. In order to crosslink each layer separately, it is preferable to adjust the molecular weight or to use a crosslinking promoting agent. The amount of gelatin ordinarily used is 0.1 g to 2.0 g/m$^2$. It is preferable that the crosslinking agent is used by 0.01 mmol to 1 mmol per 1 gram of gelatin.

In the present invention, as a hydrazine derivative, it is preferable to use compounds represented by the following Formula H.

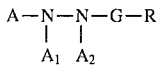

Formula H wherein A represents an aryl group or a heterocyclic group containing at least one sulfur atom or an oxygen atom; G represents a —(CO)$_n$— group, a sulfony group, a sulfonyloxy

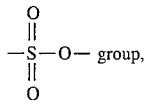

a —P(=O)R$_2$— group or an iminomethylene group; n represents an integer of 1 or 2; $A_1$ and $A_2$ are a hydrogen atom or either one represents a hydrogen atom and the other represents a alkylsulfonyl group or a acyl group; R represents a hydrogen atom or an alkyl, alkenyl, aryl alkoxy, alkenyloxy, aryloxy, heterocyclic oxy, amino, cabamoyl or oxycarbonyl group; $R_2$ represents an alkyl, alkenyl, aryl alkoxy, alkenyloxy, aryloxy and amino group.

Among compounds represented by Formula H, compounds represented by the following Formula Ha are more preferably employed.

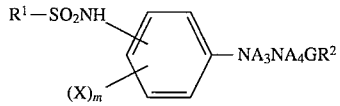

Formula Ha wherein $R^1$ represents an aliphatic group (for example, an octyl group and a decyl group), an aromatic group (for example, a phenyl group, a 2-hydroxyphenyl group and a chlorophenyl group) or a heterocyclic group (for example, a pyridyl group, a thienyl group and a furyl group). In addition, those wherein the above-mentioned groups are substituted by a suitable substituent are preferably used. In addition, it is preferable that $R_1$ contains at least one balast group or a silver halide absorption promoting group.

As a ballast group, a balast group conventionally used in immobile additives for photography such as a coupler is preferable. As a balast group, an alkyl group, an alkenyl group, an alkinyl group, an alkoxy group, a phenyl group, a phenoxy group and an alkylphenoxy group which have 8 or more carbon atoms and which are relatively inactive photographic properties are cited.

As a silver halide absorption promoting group, thiourea, a thiourethane group, a mercapto group, a thioether group, a thion group, a heterocyclic group, a thioamide heterocyclic group, a mercapto heterocyclic group or an absorption group described in Japanese Patent O.P.I. Publication No. 90439/1989 can be cited.

In Formula Ha, X represents a group capable of substituting on a phenyl group. m represents an integer of 0 through 4. When m is 2 or more, X may be the same or different.

In Formula Ha, $A_3$ and $A_4$ are respectively the same as $A_1$ and $A_2$ in Formula H. It is preferable that both are a hydrogen atom.

In Formula Ha, G represents a carbonyl group, a sulfonyl group, a sulfonyloxy

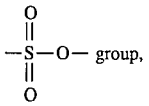

a phosphoryl group or an iminomethylene group. G is preferably a carbonyl group.

In Formula Ha, $R^2$ represents a hydrogen atom, an alkyl group, an alkenyl group, an alkinyl group, an aryl group, a heterocyclic group, an alkoxy group, a hydroxide group, an amino group, a carbamoyl group and an oxycarbonyl group. The most preferable $R^2$ are a —$COOR^3$ group and a —$CON(R^4)(R^5)$ group ($R^3$ represents an alkinyl group or a saturated heterocyclic group. $R^4$ represents a hydrogen atom, an alkenyl group, an alkinyl group, an aryl group or a heterocyclic group. $R^5$ represents an alkenyl group, an alkinyl group, a saturated heterocyclic group, a hydroxy group or an alkoxy group.).

Next, practical examples of compounds represented by Formula H are shown below. However, the present invention is not limited thereto.

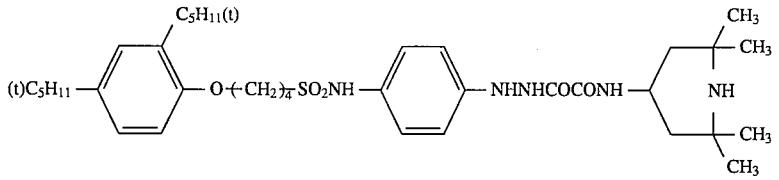

H-1

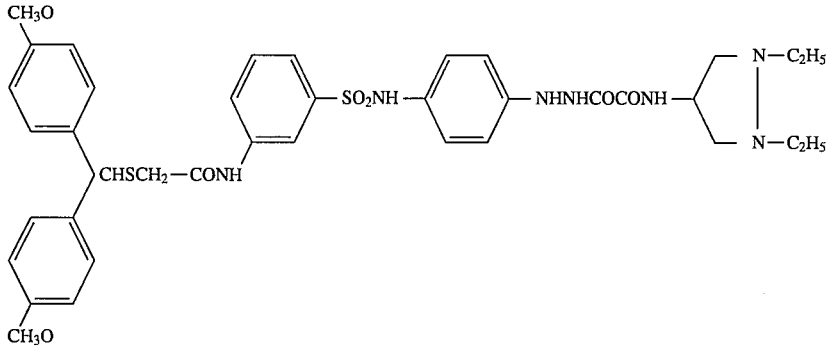

H-2

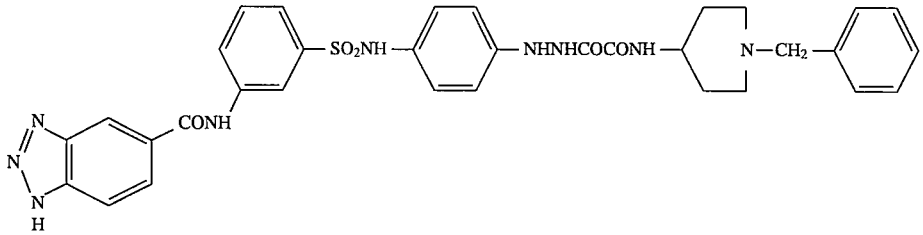

H-3

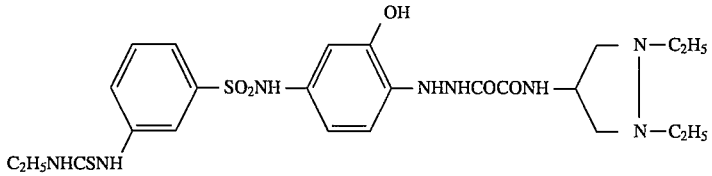

H-4

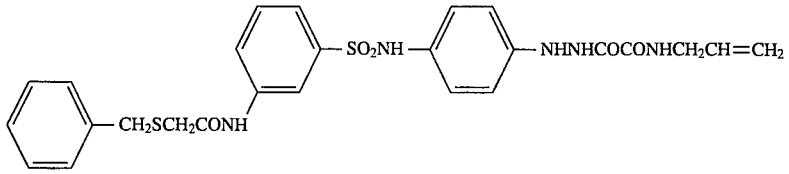

H-5

-continued
H-6
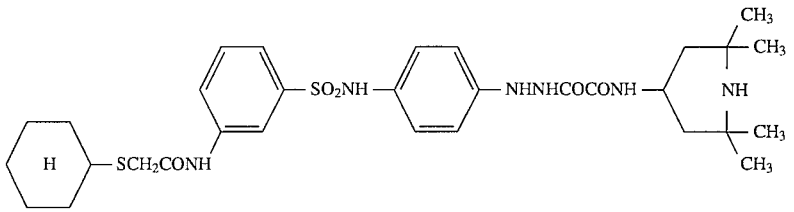
H-7
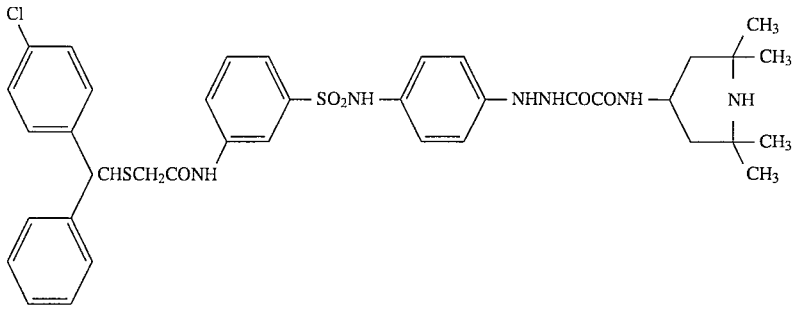
H-8
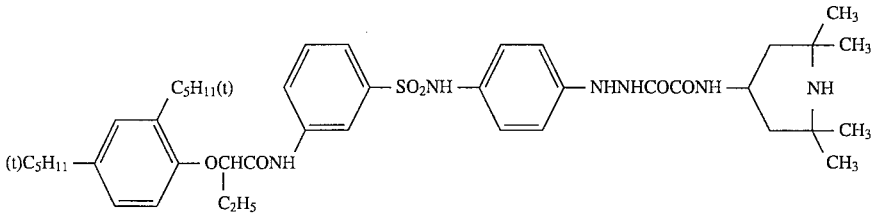
H-9
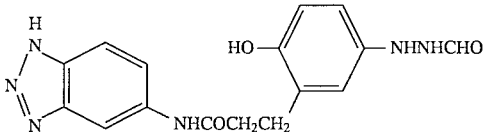
H-10
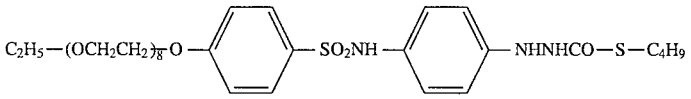
H-11
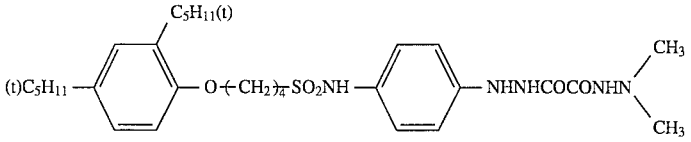
H-12
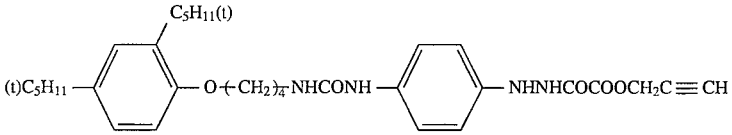
H-13
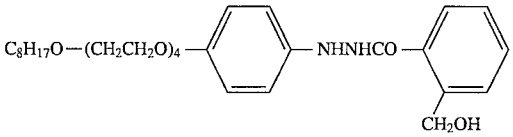
H-14
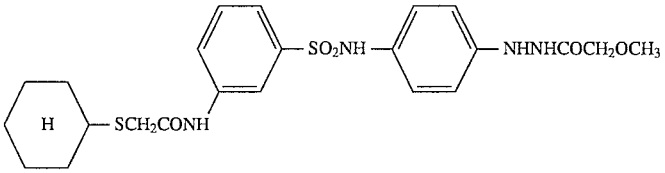

-continued
H-15
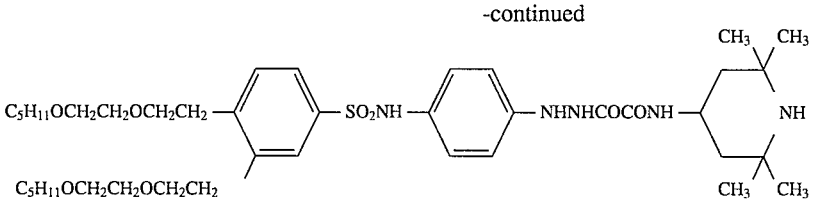
H-16
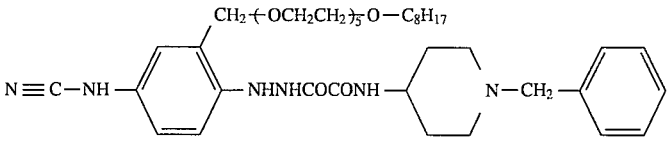
H-17
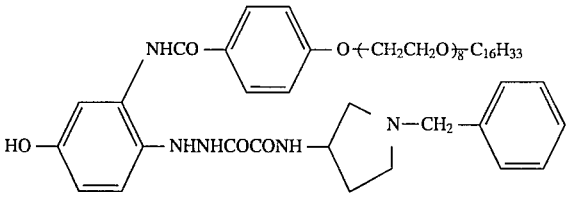
H-18
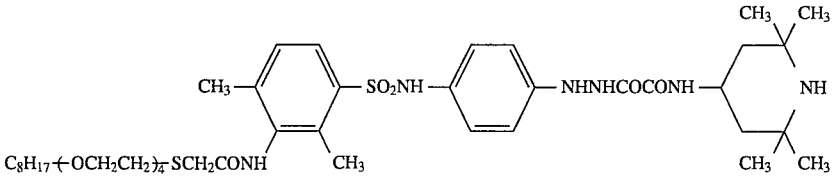
H-19
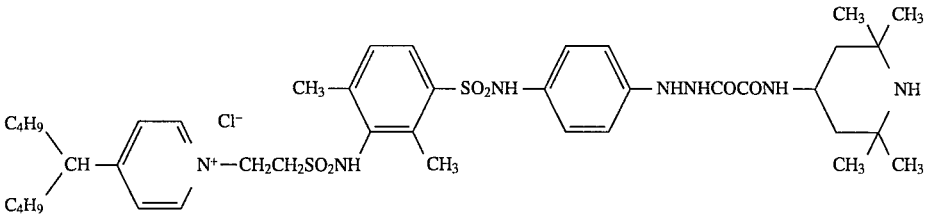
H-20
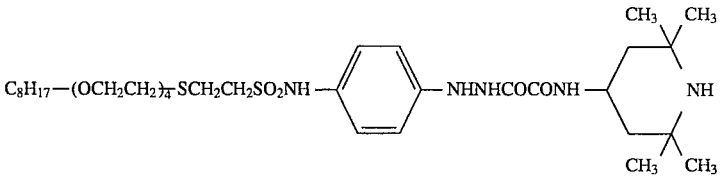
H-21
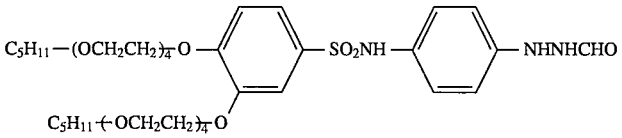
H-22
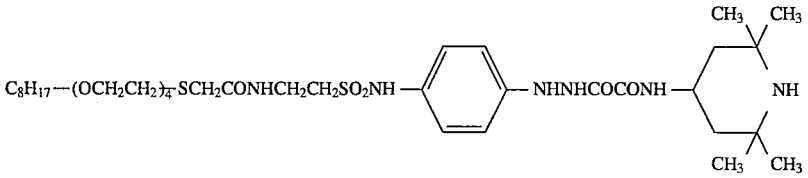

-continued

H-23

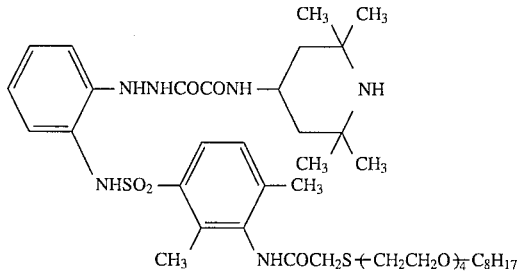

H-24

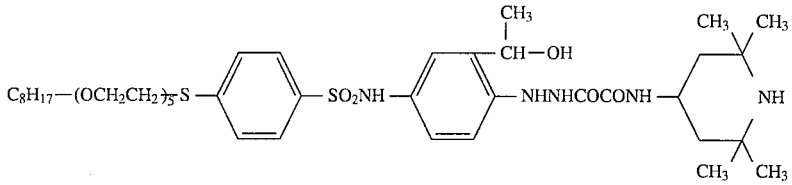

H-25

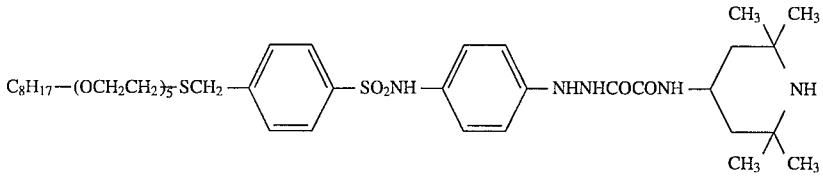

H-26

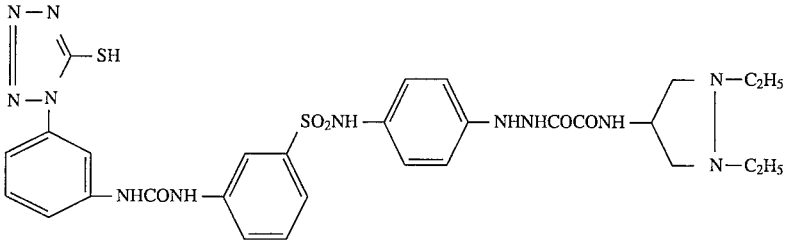

H-27

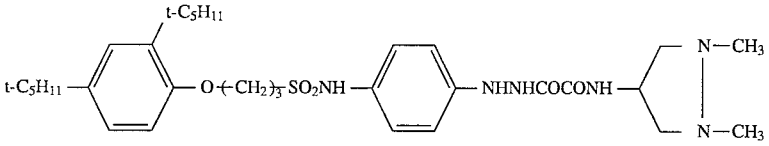

H-28

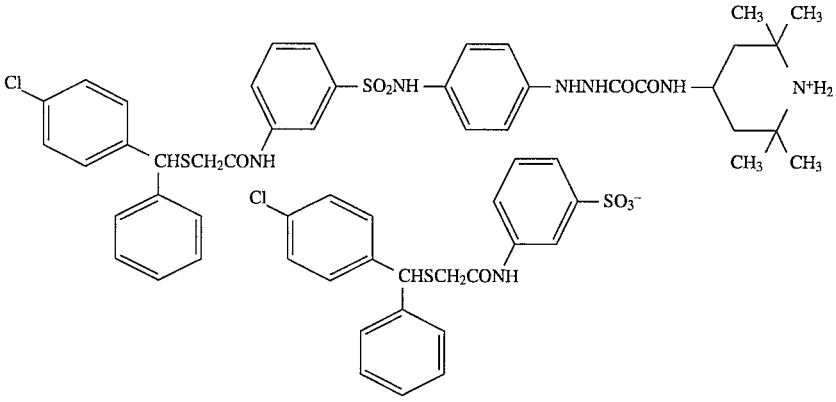

Practical examples of other preferable hydrazine derivatives are described in (1) through (252) shown in U.S. Pat. No. 5,229,248, Column 4 through 60.

The hydrazine derivatives of the present invention can be synthesized by any conventional method. For example, they can be synthesized by a method described in U.S. Pat. No. 5,229,248, Column 59 through 80.

The addition amount is allowed as far as it hardens (Amount of contrast increasing). The most suitable amount is different depending upon the grain size of the silver halide grains, halogen composition, the degree of chemical sensitization and the kind of inhibitor. It is generally in the range of $10^{-6}$ to $10^{-1}$ mol and preferably in the range of $10^{-5}$ to $10^{-2}$ mol per mol of silver halide.

A hydrazine derivative used in the present invention is added to a silver halide emulsion layer or its adjacent layer.

In order to promote hardening by means of the hydrazine derivative effectively, it is preferable to use a nucleation promoting agent represented by the following Formula Na or Nb.

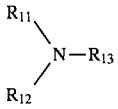

Formula Na

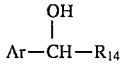

Formula Nb

In Formula Na, $R_{11}$, $R_{12}$ and $R_{13}$ each represents a hydrogen, an alkyl group, an alkenyl group, and an aryl group. $R_{11}$, $R_{12}$ and $R_{13}$ can form a ring. It is preferably an aliphatic tertiary amine compound. It is also preferable that these compounds have a ballast group or a silver halide absorption group in their molecule. In order to have a ballast property, compounds having a molecular weight of 100 or more are preferable. In addition, those having a molecular weight of 300 or more are more preferable. In addition, as a preferable absorption group, a heterocyclic group, a mercapto group, a thioether, a thion group and a thiourea group are cited. As Formula Na, the especially preferable is a compound having at least one thioether group in the molecule as a silver halide absorption group.

Hereunder, practical examples of the above-mentioned nucleation promoting agent Na are cited.

Na-1

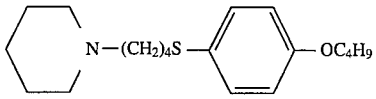

Na-2

$[(C_3H_7)_2N(CH_2)_3OCH_2CH_2]_2S$

Na-3

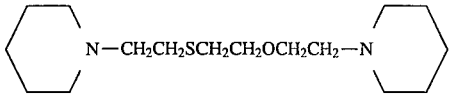

Na-4

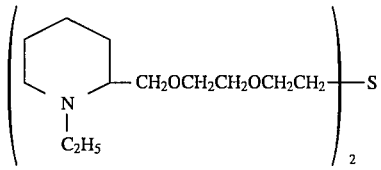

Na-5

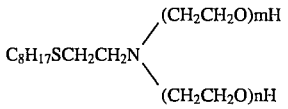

Na-6

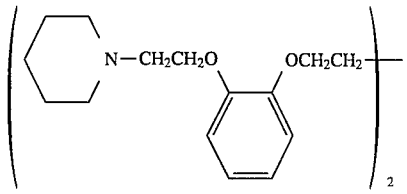

Na-7

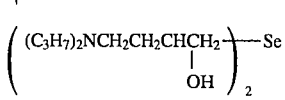

-continued

Na-8

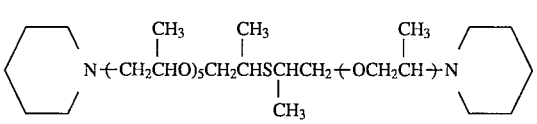

Na-9

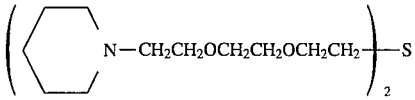

Na-10

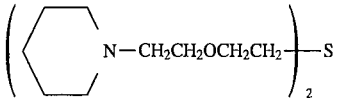

Na-11

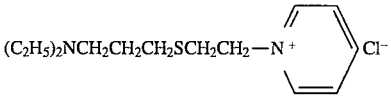

Na-12

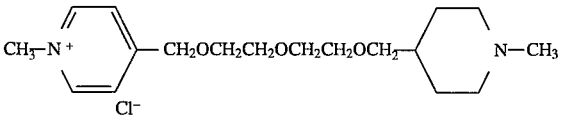

Na-13

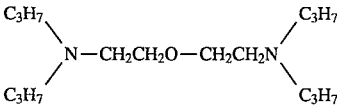

Na-14

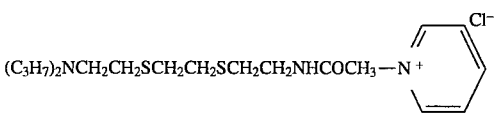

Na-15

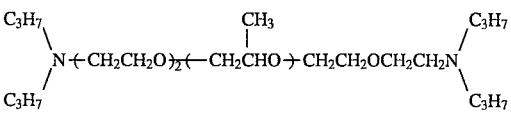

Na-16

$((C_2H_5)_2N(CH_2)_3NHCOCH_2)_2Se$

Na-17

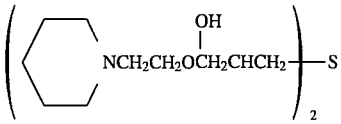

Na-18

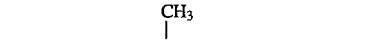

Na-19

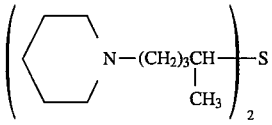

Na-20

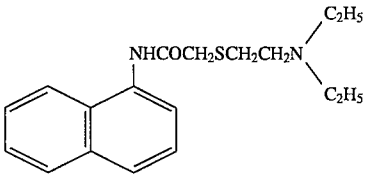

-continued

Na-21

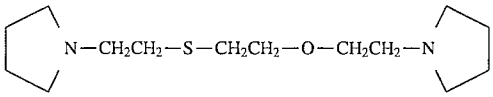

Na-22

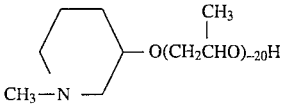

Na-23

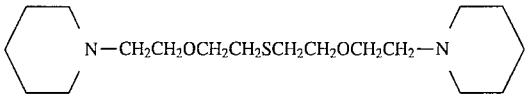

In Formula Nb, Ar represents an aromatic group or a heterocyclic group. $R_{14}$ represents a hydrogen atom, an alkyl group, an alkinyl group and an aryl group, provided that Ar and $R_{14}$ may form a ring through combination with a combination group. It is preferable that the above-mentioned compounds have a ballast group or a silver halide absorption group inside the molecule. In order to have a preferable a ballast property, the molecular weight is preferably 120 or more and especially preferably 300 or more. As a preferable silver halide absorption group, groups the same as a silver halide absorption group of a compound represented by Formula H.

As a practical compound of Formula Nb, the following are cited.

Nb-1

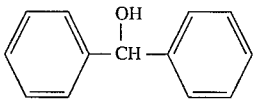

Nb-2

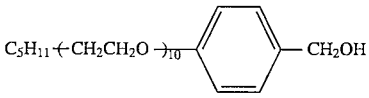

Nb-3

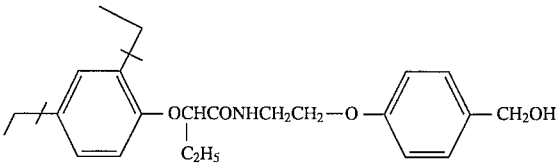

Nb-4

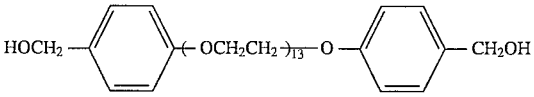

Nb-5

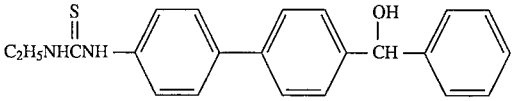

Nb-6

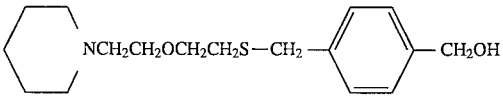

Nb-7

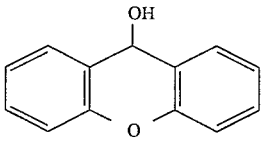

Nb-8

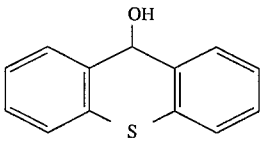

Nb-9

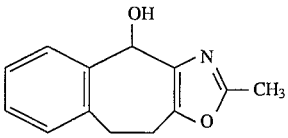

-continued

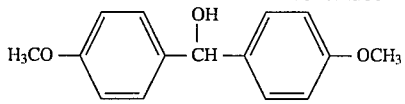

Nb-10

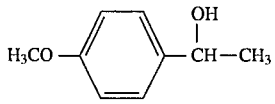

Nb-11

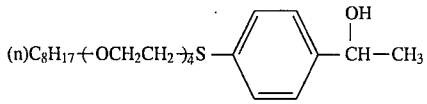

Nb-12

Other practical examples of preferable nucleation promoting compounds are compounds (2-1) through (2-20) described in Japanese Patent O.P.I. Publication No. 258751/1994, page (13), "0062" through page (15), "0065", and compounds 3-1 through 3-6 described in Japanese Patent O.P.I. Publication No. 258751/1994, page (15), "0067" through page (16), "0068".

These nucleation promoting compounds can be used for any layers provided that they are on the silver halide emulsion layer side. It is preferable that they are used in the silver halide emulsion layer or its adjacent layer.

In the present invention, it is preferable that a solid dispersed fine particles are contained in at least one layer at the silver halide emulsion layer side. As a dye made to be a solid dispersed fine particle, compounds represented by Formula 7 through 12 are preferably used.

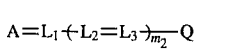

Formula 7

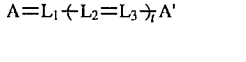

Formula 8

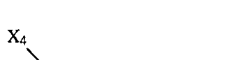

Formula 9

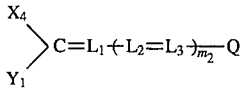

Formula 10

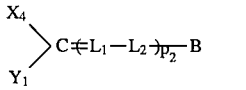

Formula 11

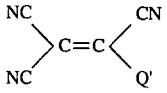

Formula 12 wherein A and A', each represents an acid nucleus, provided that A and A', may be the same or different; B represents a basic nucleus; Q represents an aryl group or a heterocyclic group; Q' represents a heterocyclic group; $X_4$ and $Y_1$, each represents an electron absorption group, provided that $X_4$ and $Y_1$ may be the same or different; $L_1$, $L_2$ and $L_3$ respectively represent a methine group; $m_2$ represents 0 or 1; t represents 0, 1 or 2; $P_2$ represents 0 or 1; and dyes represented by Formulas I through VI have at least one group selected from a carboxy group, a sulfonamido group and a sulfamoyl group in their molecule.

As an acid nucleus represented by A and A' of Formula 7, 8 and 9, 5-pyrazolone, barbituric acid, thiobarbituric acid, rhodanine, hydantoin, thiohydantoin, oxazolone, isooxazolone, indanedione, pyrazolizinedion, oxazolinzinedion, hydroxypyridone and pyrazolopyridone are preferably cited.

As a basic nucleus represented by B of Formulas 9 and 11, pyridine, quinoline, oxazole, benzoxazole, naphthooxazole, thiazole, benzthiazole, naphthothiazole, indolenine, pyrrole and indole are preferably cited.

As an aryl group represented by Q of Formulas 7 and 10, for example, a phenyl group and a naphtyl group are cited. In addition, as a heterocyclic group represented by Q and Q' of Formulas I, IV and VI, for example, a pyridyl group, a quinolyl group, an isoquinolyl group, a pyrrolyl group, a pyrazolyl group, an imidazolyl group, an indolyl group, a furyl group and a thienyl group are cited. Aforesaid aryl group and heterocyclic group include those having a substituent. As aforesaid substituents, those illustrated as a substituent of amino groups and heterocyclic groups of the above-mentioned compound represented by Formulas (1) through (5), and the above-mentioned substituents. It is allowed that two or more of the above-mentioned substituents are used in combination. Preferable substituents are alkyl groups having 1 to 8 carbons (for example, a methyl group, an ethyl group, a t-butyl group, an octyl group, a 2-hydroxyethyl group and a 2-methoxyethyl group), a hydroxy group, a cyano group, halogen atom (for example, a fluorine atom and a chlorine atom), alkoxy group having 1 to 6 carbons (for example, a methoxy group, an ethoxy group, a 2-hydroxyethoxy group, a methylenedioxy group and a buthoxy group), amino group (for example, a dimethylamino group, a diethylamino group, a di(n-butyl)amino group, an N-ethyl-N-hydroxyethylamino group, an N-ethyl-N-methanesulfonamidoethylamino group, a morphorino group, a pyperidino group and a pyrrolizino group), a carboxyl group, sulfonamido groups (for example, a methanesulfonamido group and a benzenesulfonamido group) and sulfamoyl groups (for example, a sulfamoyl group, a methylsulfamoyl group and a phenylsulfamoyl group). They may be combined to be used.

An electron attractive group represented by $X_4$ and $Y_1$ of Formula 10 and 11 may be the same or different. Groups whose Hammett's $\sigma_p$value of a sunstituent constant (described in "Kagaku no ryoiki" Extra Number No. 122 - Structural Active Correlationship", pp. 96 to 103 (1979) edited by Norio Fujita and published by Nankoh-Doh) is 0.3 or more is preferable. For example, a cyano group, alkoxycarbonyl groups (for example, a methoxycarbonyl group, an ethoxycarbonyl group, a buthoxycarbonyl group and an octyloxycarbonyl group), aryloxycarbonyl groups (for example, a phenoxycarbonyl group and a 4-hydroxyphenoxycarbonyl group), carbamoyl groups (for example, a carbamoyl group, a dimethylcarbamoyl group, a phenylcarbamoyl group and a 4-carboxyphenylcarbamoyl group), acyl groups (for example, a methylcarbonyl group, an ethylcarbonyl group, a butylcarbonyl group, a phenylcarbonyl group and a 4-ethylsulfonamidecarbonyl group), alkylsulfonyl groups (for example, a methylsulfonyl group, an ethylsulfonyl group, a butylsulfonyl group and an octylsulfonyl group) and arylsulfonyl groups (for example, a phenylsulfonyl group and a 4-chlorosulfonyl group) are cited.

Methine groups represented by $L_1$, $L_2$ and $L_3$ of Formulas 7 through 11 include those having a substituent. As aforesaid substituents, alkyl group having 1 to 6 carbons (for example, a methyl group, an ethyl group and a hexyl group), aryl groups (for example, a phenyl group, a tolyl group and a 4-hydroxyphenyl group), aralkyl groups (for example, a benzyl group and a phenetyl group), heterocyclic group (for example, a pyridyl group, a furyl group and a thienyl group), amino group (for example, a dimethylamino group, a diethyl amino group and an anilino group) and alkylthio groups (for example, a methylthio group) are cited.

In the present invention, among dyes represented by Formulas 7 through 12, dyes having at least one carboxyl group in their molecules are preferably used. The more preferable are dyes represented by Formula 7. The especially preferable are dyes wherein Q is a furyl group in Formula 7.

Hereunder, practical examples of dyes preferably used are shown below. However, the present invention isnot limited thereto.

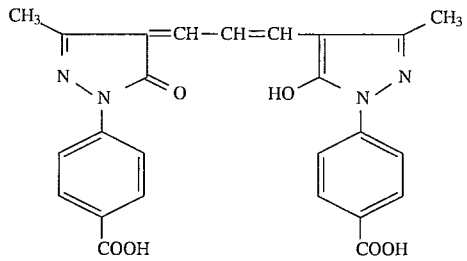

AD-1

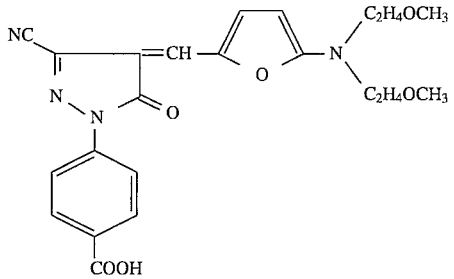

AD-2

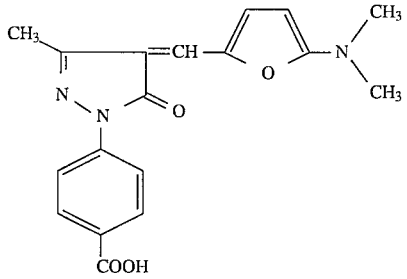

AD-3

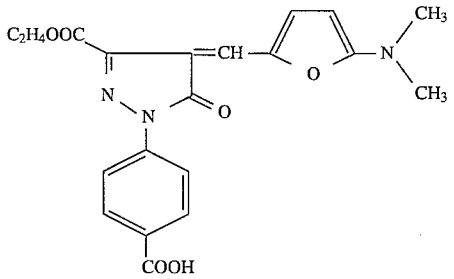

AD-4

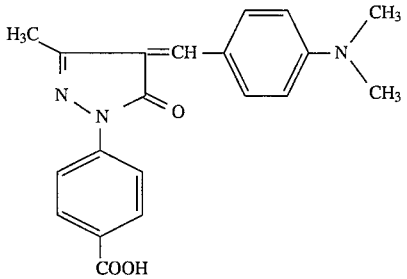

AD-5

-continued
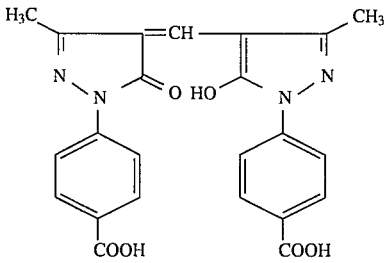
AD-6
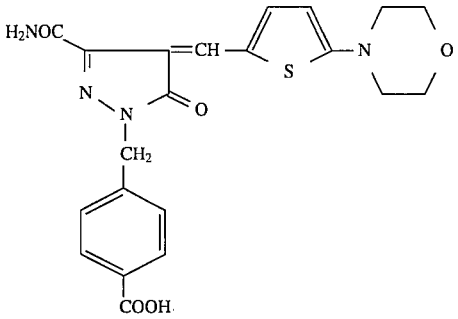
AD-7
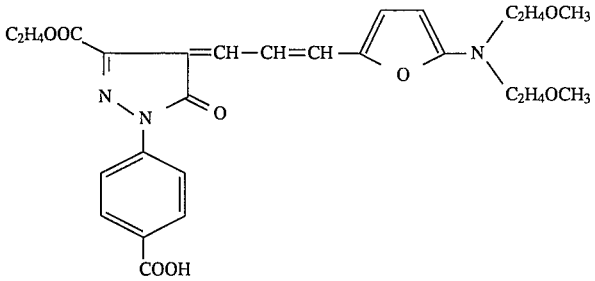
AD-8
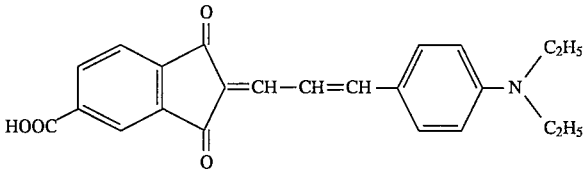
AD-9
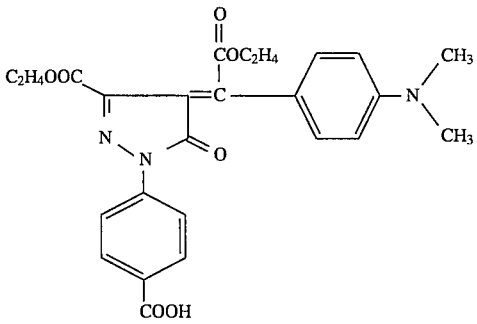
AD-10
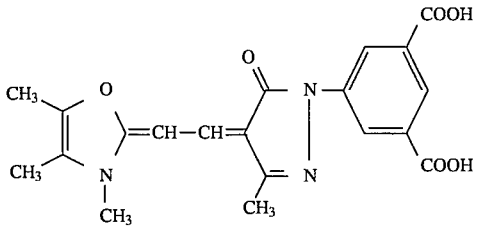
AD-11

-continued

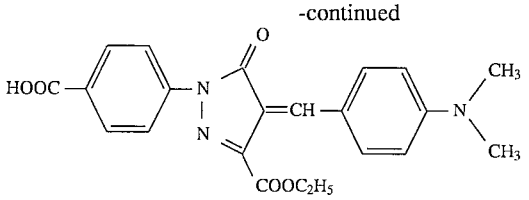

AD-12

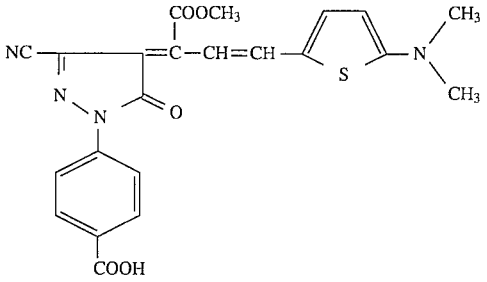

AD-13

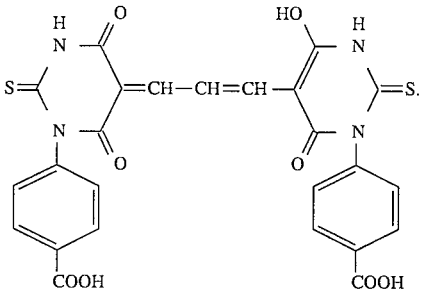

AD-14

Other practical and practical examples of the compouds represented by Formulas 7 through 12 include Nos. I-1 through I-30, III-1 through II-12, II-1 through III-8, IV-1 through IV-9, V-1 through V-8 and VI-1 through VI-5 described in Japanese Patent O.P.I. Publication No. 277011/1993. However, the present invention is not limited thereto.

As a method for producing the solid fine particle of the dyes of the present invention, those described in Japanese Patent O.P.I. Publication Nos. 92716/1977, 155350/1980, 155351/1980, 197943/1988 and 182743/1991 and World Patent WO88/04794 can be used. Practically, they can be produced by the use of a fine dispersion machine such as a ball mill, a planetary mill, a vibration mill, a sand mill, a roller mill, a jet mill and a disc impeller mill. When a compound wherein solid fine particles are dispersed is water-insoluble at a relatively low pH and water-soluble at relatively high pH, a dispersion of aforesaid compound can be obtained by a method which coagulates fine particle solid by reducing pH to be weak-acid after dissolving aforesaid compound in an aqueous weak alkaline solution or a method which prepares fine particles solid by mixing simultaneously a weak alkaline dissolved solution and an aqueous acid solution of aforesaid compound while regulating pH. The solid fine particles dispersed product of the present invention may be used independently, or two or more thereof can be used mixedly. In addition, it may be used by mixing with a solid fine particles dispersed product other than the present invention. When 2 or more kinds are mixed to be used, they may be mixed after being dispersed independently, or they may be dispersed concurrently.

When the solid fine particles dispersed product of the present invention is produced in the presence of a water dispersion medium, it is preferable to make a surfactant to coexist during dispersing or after dispersion. As the above-mentioned surfactant, any of an anionic surfactant, a non-ionic surfactant, a cationic surfactant and an amphoteric surfactant can be used. The preferable are anionic surfactants such as alkylsulfonic acid salt, alkylbenzene sulfonic acid salt, alkylnaphthalene sulfonic acid, alkylsulfuric acid esters, sulfosuccinic acid esters, sulfoalkylpolyoxyethylene alkylphenyl ethers and N-acyl-N-alkyl taurine and nonionic surfactants such as saponin alkylene oxide derivatives and alkylesters of sugar. As preferable examples of surfactants, compound Nos. 1 through 32 described in Japanese Patent Application No. 277011/1993, on pp. 32 through 46 are cited. However, the present invention is not limited thereto.

Used amount of an anionic surfactant and/or a nonionic surfactant are not constant depending upon the kind of the surfactant or the conditions of a dispersing solution of the above-mentioned dye. It is ordinarily allowed to be 0.1 mg to 2000 mg per 1 g of the dye, preferably 0.5 mg to 1000 mg, and especially preferably 1 mg to 500 mg. The density of the dye in the dispersing solution is ordinarily 0.01 to 10 wt %, and preferably 0.1 to 5 wt %. The surfactant may be added before the start of the dispersion of dye. If necessary, it may also be added to the dye dispersion solution after the finish of the dispersion. The above-mentioned anionic surfactant and/or nonionic surfactant may be used independently, or two or more thereof may be added in combination. In addition both types of surfactant may be combined to be used.

With regard to the solid fine particles dispersed product of the present invention, it is preferably dispersed in a manner that the average particle size will be 0.01 μm to 5 μm, more preferable 0.01 μm to 1 μm and especially preferably 0.01 μm to 0.5 μm. With regard to the variation coefficient of the particle size distribuion of the solid fine particle dispersed product, 50% or less is preferable, 40% or less is more preferable and 30% or less is especially more preferable. Here, the variation coefficient of the particle size distribution is a value defined by the following equation.

(Standard deviation of the particle size)/(Average value of particle size)×100

Before or after dispersion, to the solid fine particles dispersed product of the present invention, hyrophilic colloid used as a binder for a photogrpahic constituting layer can be added. As a hydrophilic colloid, it is advantageous to use gelatin. In addition, gelatin derivatives such as phenylcarbamylized gelatin, acylized gelatin and phthalized gelatin, cellulose derivatives such as graft polymer of gelatin and a monomer having an ethylene group capable of polymerizing, carboxymethylcellulose, hydroxymethylcellulose and cellulose sufuric acid ester, synthetic hydrophilic polymers such as polyvinyl alcohol, polyvinyl acetate partically oxidized, polyacrylic amide, poly-N,N-dimethylacrylic amide, poly-N-vinylpyrrolidone and polymethacrylic acid, agar, arabic rubber, alginic acid, alubmin and casein can be used. Two or more thereof can be combined to be used. An amount of hydrophilic colloid added to the solid fine particles dispersed product of the present invention is preferably 0.1% to 12%, and more preferably 0.5% to 8%.

The solid fine particles dispersed product of the present invention is preferably added to a layer constituting a photographic material such as a light-sensitive silver halide emulsion layer, an upper emulsion layer, a lower emulsion layer, a protective layer, a support-subbing layer and a backing layer. In order to enhance anti-halation effect specifically, it is preferable to add the solid fine particles dispersed product to a layer positioned between the support and the emulsion layer or to a constituting layer opposite to the emulsion layer. In addition, in order to improve safelight property specifically, it is preferable to add it to the upper layer of the emulsion layer.

The preferable amount of the solid fine particles dispersed product of dye used is not constant depending upon the kind of dye and characteristics of a photographic light-sensitive material. It is ordinarily 1 mg to 1 g, preferably 5 mg to 800 mg and more preferably 10 mg to 500 mg per 1 $m^2$ of the photographic light-sensitive material.

There is no limit to halogen composition of silver halide in the silver halide emulsion used in the present invention. Silver chloride, silver bromochloride containing 60 mol % or more of silver chloride and silver bromoiodochloride containing 60 mol % or more of silver chloride are preferable.

Average grain size of silver halide is preferably 1.2 μm or less and more preferably 0.8 to 0.1 μm. The average grain size is conventionally used by those skilled in the art of photographic science so that it can easily be understood. Grain size means a diameter of a grain when the grain is spherical or similar to spherical. When a grain is cubic, it is converted to sphere, and the diameter of the sphere is defined to be the grain size. For details on a method to calculate an average grain size, see The Theory of the Photographic Process written by C. E. Mees & T. H. James, 3rd edition, pp. 36 to 43 (published by Macmillan in 1966).

There is no limit to the form of a silver halide grain. Any of tabular, spherical, cubic, tetradecahedral, regular octahedral and others forms is allowed. The distribution of grain size is preferably narrow. Specifically, a mono-dispersed emulsion wherein 90% and preferably 95% of all grains are included in the grain size region of the average grain size ±40% is preferable.

As a method of reacting a soluble silver salt and a soluble halogen salt, a one-side mixing method, a double jet method and their mixture method are cited. A method which forms grains under presence of excessive silver ion (so-called, a reverse mixing method) can also be used. As one method of double jet methods, a method which keeps pAg in a liquid phase producing silver halide constant, namely a controlled double jet method can be used. According to this method, a silver halide emulsion wherein the form of crystals is regular and the size of grains is close to uniform can be obtained.

In order to provide the effects of the present invention prominently, it is preferable that a silver halide emulsion in at least one silver halide emulsion layer contains a tabular grains and that 50% or more of the sum of the projected area of all grains of the emulsion layer using the tabular grains is tabular grains whose aspect ratio is 2 or more. Especially, the more the ratio of the tabular grains is increased to 60%, 70% and 80%, the more preferable results can be obtained. The aspect ratio represents a ratio between a diameter of a circle having the same area as the projected area of the tabular grains and the distance between two parallel planes of the grain. In the tabular grains of the present invention, the main plane of the grains composed of 50 mol % or more of silver chloride is (100), it can be represented not by the aspect ratio but by a longitudinal/transversal ratio. This ratio is preferably 1.2 to 8. In addition, iodine can be incorporated in an inside nuclei forming site in the rage of 0.001 to 1 mol %. Tabular grains containing silver chloride at the greater rate can be formed in referance to a method described in U.S. Pat. No. 5,320,938. In terms of improving pressure durability of grains, it is preferable that a high silver iodide part of 0.001 mol % or more and less than 10mol % exists inside the silver halide grains or that there are silver nulei. The greater the aspect ratio or the longitudinal/transversal ratio is, the more flat the grain is. Though the preserable thickness of tabular grain is 0.01 to 0.5μ, it can be arbitrarily selected due to setting the aspect ratio and the volume-average grain size. In addition, with regard to the dispersion of tabular grain size, a mono-dispersed emulsion whose variation coefficient frequently used (a 100 times of a value of a standard deviation S when the projected area is brought into close with a circle divided by a diameter D (S/D)) is 30% or less, preferably 20% or less is preferable. In addition, two or more kinds of tabular grain and normal crystal grain can be mixed.

Since tabular grains are described in U.S. Pat. Nos. 4,439,520, 4,425,425 and 4,414,304, tabular grain targeted can easily be obtained. For the tabular grain, silver halides having different composition can be subjected to epitaxial growth at a specific surface part or subjected to sherring. In addition, in order to control a light-sensitive nucleus, it is possible to let the surface or inside of the tabular grains have a transition line. In order to let them have a transition line, it is possible to form by causing a fine grain of silver iodide to exist in the course of chemical sensitizing or adding an iodine ion thereto. Grains can be prepared by an acid method, a neutral method and an ammonia method selected appropriately. When doping metal, it is preferable to form a grain under pH of 1 to 5 especially. In order to control the growth of grain when forming a tabular grain, as a silver halide solvent, for example, ammonia, thioether, thiourea compounds and thion compounds can be used. As a thioether compound, 3,6,9,15,18,21-hexoxa-12-thiatrikosane, 3,9,15-trioxa-6,12,dithiaheptadecane, 1,17-dioxy-3,9-15-trioxa-6,12-dithiaheptadecane-4,14-dion, 1,20-dioxy-3,9,12,18-tetroxa-6,15-dithiaeikosane-4,17-dione and 7,10,dioxa-4,13-dithiahexadecane-2,15-dicarboxamide described in German Patent No. 1,147,845, oxathioether compounds described in Japanese Patent O.P.I. Publication Nos. 94347/1981 and 121847/1989 and cyclic oxathioether compounds described in Japanese Patent O.P.I. Publication Nos. 259653/1988 and 301939/1988 are cited. As a thiourea, specifically, those described in Japanese Patent O.P.I. Publication No. 82408/1988 are useful. Practically, tetramethylthiourea, tetraethylthiourea, dimethylpipperidinothiourea, dimolphorinothiourea, 1,3-dimethyl imidazole-2-thione, 1,3-dimethylimidazole-4-phenyl-2-thion and tetrapropyl thiourea are cited.

When conducting physical ripening or chemical ripening, metallic salts of zinc, lead, thalium, iridium, rhodium, rutenium, osmium, paradium and platinum can coexist. In order to obtain high illuminance property, it is ordinarily used in the silver halide emulsion to dope iridium in a range from $10^{-9}$ to $10^{-3}$. In the present invention, in order to obtain a high cotrast emulsion, it is preferable to dope rhodium, rutenium, osmium and/or lenium in a range from $10^{-9}$ to $10^{-3}$ per mol of silver halide.

It is preferable to add a rhodium compound, a rhutenium compound and/or a lenium compound during forming a silver halide grain. As an addition position, a method which distributes the compounds uniformly in a grain and a method which localizes much compounds in a core portion or a shell portion in a core/shell structure are available.

When adding much of them in the shell portion, preferable resutls can frequently be obtained. In addition to localizing in a discontinuous layer structure, a method wherein the amount of adding is increased continuously the adding location moves to the outer side of the grain can be used. Amount of adding can appropriately be selected in a range from $10^{-9}$ to $10^{-3}$ mol per mol of silver halide.

Practical examples are shown below. However, the present invention is not limited to examples below.

| | |
|---|---|
| $[Ru(CN)_6]^{-4}$ | $[RuBr(CN)_5]^{-4}$ |
| $[RuF(CN)_5]^{-4}$ | $[RuF(CN)_4]^{-4}$ |
| $[RuCl(CN)_5]^{-4}$ | $[RuCl_2(CN)_4]^{-4}$ |
| $[RuBr_2(CN)_4]^{-4}$ | $[RuI_2(CN)_4]^{-4}$ |
| $[Ru(NO)Cl_5]^{-2}$ | $[Ru(NO)Br_5]^{-2}$ |
| $[Ru(NO)I_5]^{-2}$ | $[Ru(NO)F_5]^{-2}$ |
| $[Ru(CN)Cl_5]^{-2}$ | $[Ru(CN)Br_5]^{-2}$ |
| $[Ru(CN)I_5]^{-2}$ | $[Ru(CN)F_5]^{-2}$ |
| $[Ru(SCN)Cl_5]^{-2}$ | $[Ru(SCN)Br_5]^{-2}$ |
| $[Ru(SCN)I_5]^{-2}$ | $[Ru(SCN)F_5]^{-2}$ |
| $[Ru(SeCN)Cl_5]^{-2}$ | $[Ru(SeCN)Br_5]^{-2}$ |
| $[Ru(SeCN)I_5]^{-2}$ | $[Ru(SeCN)F_5]^{-2}$ |
| $[Ru(TeCN)Cl_5]^{-2}$ | $[Ru(TeCN)Br_5]^{-2}$ |
| $[Ru(TeCN)I_5]^{-2}$ | $[Ru(TeCN)F_5]^{-2}$ |
| $[Ru(CO)Cl_5]^{-2}$ | $[Ru(CO)Br_5]^{-2}$ |
| $[Ru(CO)I_5]^{-2}$ | $[Ru(CO)F_5]^{-2}$ |
| $[Ru(NH_3)Cl_5]^{-2}$ | $[Ru(NH_3)Br_5]^{-2}$ |
| $[Ru(NH_3)I_5]^{-2}$ | $[Ru(NH_3)F_5]^{-2}$ |
| $[RuCl_6]^{-2}$ | $[RuBr_6]^{-2}$ |
| $[RuI_6]^{-2}$ | $[RuF_6]^{-2}$ |
| $[Ru(NO)Cl_2(H_2O)_2]^{-1}$ | $[Ru(NO)Br_2(H_2O)_2]^{-1}$ |
| $[RU(NO)F_2(H_2O)_2]^{-1}$ | $[Ru(NO)I_2(H_2O)_2]^{-1}$ |
| $[Ru(NO)Cl_4(CN)]^{-2}$ | $[Ru(NO)Cl_4(SCN)]^{-2}$ |
| $[Ru(NO)Cl_4(SeCN)]^{-2}$ | $[Ru(NO)Br_4(SeCN)]^{-2}$ |
| $[Ru(NO)Cl_3(CN)_2]^{-2}$ | $[Ru(NO)Br_3(CN)_2]^{-2}$ |
| $[Ru(NO)Cl_5]^{-4}$ | $[Ru(NO)Br_5]^{-4}$ |
| $[Ru(NO)I_5]^{-4}$ | $[Ru(NO)F_5]^{-4}$ |
| $[Ru(CN)Cl_5]^{-4}$ | $[Ru(CN)Br_5]^{-4}$ |
| $[Ru(CN)I_5]^{-4}$ | $[Ru(CN)F_5]^{-4}$ |
| $[Ru(SCN)Cl_5]^{-4}$ | $[Ru(SCN)Br_5]^{-4}$ |
| $[Ru(SCN)I_5]^{-4}$ | $[Ru(SCN)F_5]^{-4}$ |
| $[Ru(SeCN)Cl_5]^{-4}$ | $[Ru(SeCN)Br_5]^{-4}$ |
| $[Ru(SeCN)I_5]^{-4}$ | $[Ru(SeCN)F_5]^{-4}$ |
| $[Ru(TeCN)Cl_5]^{-4}$ | $[Ru(TeCN)Br_5]^{-4}$ |
| $[Ru(TeCN)I_5]^{-4}$ | $[Ru(TeCN)F_5]^{-4}$ |
| $[Ru(CO)Cl_5]^{-4}$ | $[Ru(CO)Br_5]^{-4}$ |
| $[Ru(CO)I_5]^{-4}$ | $[Ru(CO)F_5]^{-4}$ |
| $[Ru(NH_3)Cl_5]^{-4}$ | $[Ru(NH_3)Br_5]^{-4}$ |
| $[Ru(NH_3)I_5]^{-4}$ | $[Ru(NH_3)F_5]^{-4}$ |
| $[RuCl_6]^{-4}$ | $[RuBr_6]^{-4}$ |
| $[RuI_6]^{-4}$ | $[RuF_6]^{-4}$ |
| $[Ru(NO)Cl_4(CN)]^{-4}$ | $[Ru(NO)Cl_4(SCN)]^{-4}$ |
| $[Ru(NO)Cl_4(SeCN)]^{-4}$ | $[Ru(NO)Br_4(SeCN)]^{-4}$ |
| $[Ru(NO)Cl_3(CN)_2]^{-4}$ | $[Ru(NO)Br_3(CN)_2]^{-4}$ |
| $[Ru(NH_3)_6]Cl_3$ | $[Ru(NH_3)_6]Br_3$ |

With regard to other metals such as osmium (Os), renium (Re), rhodium (Rh), iridium (Ir), paradium (Pd) and platinum (Pt), each compound can be represented by substituting Ru with Os, Re, Rh, Ir, Pa and Pt. Therefore, they are omitted. With regard to 6-membered ligends and transition metal compounds, see Japanese Patent O.P.I. Publication Nos. 2082/1990, 20853/1990, 20854/1990 and 20855/1990. In addition, as an alkaline complex salt, ordinary sodium salts, potassium salts or cesium salts can be selected. In addition thereto, the primary, the secondary and the tertiary amines may also be used. For example, $K_2[RuCl_6]$, $(NH_4)_2[RuCl_6]$, $K_4[Ru_2Cl_{10}O]XH_2O$ and $K_2[RuCl_5(H_2O]$ can be used. In "Large Chemical Dictionary" Volume 9 publishd by Kyoritsu Publication Inc., on page 847, there is observed an explanation about Rhutenium. Before it, there is observed a description about cyan-configured, carbonyl-configured and nitrocyl-configured rhutenium, and to have these ligands is introduced.

Rhutenium compounds will be explained in detail. With regard to this metal compound, O-valent to octa-valent compounds are generally known. Ordinary, tri-valent and tetra-valent compounds can be relatively stable. Di-valent compounds are unstable in an aqueous solution. When a tri-valent rhutenium compound is subjected to electrolytic reduction, a di-valent compound can be generated. Since complex salts of hexacyano rhutenium, orthophenanethrone, dipyridyl, tripyridyl, pentachloronitrocyl, pentaammonia nitrocyl and hexaammonia are relatively stable, they can be used preferably in the present invention. As a tri-valent rhutenium, nitrocyl rhutenium is also a table compound. Therefore, it is useful for the present invention. As a penta-valent rhutenium, fluorinated rhutenium is cited. Rhutenium configured with carbonyl and nitrocy are refractory to water. When using them, they can be added in a state of fine particle. In addition, since they are unstable in an alkaline state, it is preferable that they are incorporated in grains in an acid state. When they are doped inside grains, pH is preferably 1 to 8 and more preferably 2 to 7. After doping inside the grains, their metallic complex salts may be added again in gold-sulfur-selenium chemical sensitization for bolstering sensitization.

In the present invention, nickel, cobalt, rhodium, paradium, platinum, iron copper, iridium, vanadium, chromum, manganese, ittorium, dilconium, niobium, molybdenum, tantalum, tangusten, celium and praseodymium can be used in combination. These combined metallic compounds are used preferably in a range of $10^{-9}$ to $10^{-3}$ mol.

When adding a metallic compound in a grain, to a metal, halogen, carbonyl, nitrocyl, thionitrocyl, amine, cyan, thiocyan, ammonia, tellulocyan, selenocyan, dipyridyl, tripyridyl and phenanthrone or a mixture of the above-mentioned compounds are combined for configurating. A status of oxidation of metal can be selected arbitrarily from the minimum level to the maximum level.

Silver halide emulsions and their preparation methods are described in detail in Research Disclosure No. 176, 17643, pp. 22 to 23 (December, 1978) or in documents referred therein.

The silver halide emulsion may or may not be chemically sensitized. As a method of chemical sensitization, a sulfur sensitization method, a selenium sensitization method, a telulium sensitization method, a reduction sensitization method and a noble metal sensitization method are known. These can be used independently, or two or more thereof can be used in combination. As a sulfur sensitizer, conventional sulfur sensitizaers can be used. The preferable sensitizers are, in addition to sulfur compounds contained in gelatin, various sulfur compounds, for example, thiosulfate, thioureas, rhodanines and polysulfide compounds can be used. As a selenium sensitizer, conventional selenium sensitizers can be used. For example, compounds described in U.S. Pat. No. 1,623,499 and Japanese Patent O.P.I. Publication Nos. 71325/1975 and 150046/1985 are preferably used.

As a telulium sensitizer, conventional telulium sensitizers can be used. For example, compounds described in U.S. Pat. Nos. 1,623,499, 3,772,031 and 3,320,069 are preferably used.

Among noble metal sensitization methods, a gold sensitization method is a typical one. Gold compounds, mainly gold complex salts, are used. Noble metals other than gold, such as complex salts of platinum, paradium and rhodium are allowed to be incorporated.

As a reduction sensitizer, primary tin salt, amines, formamidine sulfinic acid and cyan compounds can be used.

The effects of these sensitizers can be enhanced when they are added after being dispersed to fine grains. In addition, when AgI grains are dispersed to fine grains and added in the course of chemical ripening, AgI is formed on the surface of a grain so that the effects of dye sensitization can be enhanced. When a tabular AgI grain is formed, contribution of 0 to 1000 transition lines is often utilized.

In the present invention, selenium sensitizers usable include various selenium compounds. They are described in U.S. Pat. Nos. 1,574,944, 1,602,592 and 1,623,499 and Japanese Patent O.P.I. Publication Nos. 1550046/1985, 25832/1992, 109240/1992 and 147250/1992. Useful selenium sensitizers include colloid selenium metals, isoselenocyates (for example, alylisoselenocyanate), selenoureas (for example, N,N-dimethylselenourea, N,N,N'-triethyl selenourea, N,N,N'-trimethyl-N'-heptafluoroselenourea, N,N,N'-trimethyl-N'-4-nitrophenyl carbonylselenourea), selenoketones (for example, selenoacetone and selenoacetophenone), selenoamidos (for example, selenoacetoamido and N,N-dimethylselenobenzamido), seleno carbonic acid, seleno esters (for example, 2-seleno propionic acid and methyl-3-seleno butylate), selenophosphates (for example, tri-p-triseleno phosphate and diphenyl tetrafluorophenyl selenophosphate) and selenides (for example, diethyl selenide and diethyl diselenide) are cited. The specifically preferable selenium sensitizers are seleno ureas, selenoamidos and selenium ketones.

Practical examples of using technology of these selenium sensitizers are disclosed in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385.

Used amount of selenium sensitizer is changed depending upon a selenium compound used, silver halide grains and chemical ripening. Ordinarily, $10^{-8}$ to $10^{-3}$ mol per mol of silver halide is used. With regard to an addition method, various methods can be used depending upon the characteristics of a selenium compound used. For example, a method which dissolves in water or an organic solvent such as methanol and ethanol independently or mixedly and adds, a method which mixes a selenium compound with a gelatin solution in advance and adds and a method disclosed in Japanese Patent O.P.I. Publication No. 140739/1992, namely a method which adds on a form of an emulsified and dispersed product of a mixed solution with an polymer which is soluble in an organic solvent can be used. In addition, the selenium compounds can be used in a form of a solid dispersion having a grain size of 0.01 to 500μ. The method of solid dispersion can be applied correspondingly to a method of the solid dispersion of dye and pigment. The temperature of chemical ripening using a selenium sensitizer of the present invention is preferably in a range from 40° C. to 90° C., and more preferably 45° C. or more and 80° C. or less. In addition, pH is preferably 4 to 9, and pAg is preferably 5 to 10 by regulating with a water-soluble halogenated product such as potassium bromide and sodium chloride and silver nitrate.

In addition to the selenium compounds, tellurium compounds can be used. The tellurium compounds can be represented by substituting Se of the selenium compounds with Te atom. For example, N,N-dimethyltellurourea, N,N,N'-triethyltellurourea, N,N,N'-trimethyl-N'-heptafluorotellurourea, N,N,N'-trimethyl-N'-4-nitrophenylcarbonyltellurourea, diphenyltetrafluorophenyltellurophosphate, diphenylpentafluorophenyltellurophosphate and triphenylphosphine selenide are cited.

The silver halide emulsion can be subjected to spectral sensitizing to a desired wavelength by the use of a sensitizing dye. Sensitizing dyes capable of being used include a cyanine dye, a merocyanine dye, a heterocycnine dye, a heteromerocyanine dye, a holopolar cyanine dye, a hemicyanine dye, a styryl dye and a hemioxonol dye. To these dyes, as a basic heterocyclic nucleus, any nuclei ordinarily utilized to cyanine dyes can be applied. Namely, a pyrroline nucleus, an oxazoline nucleus, a thiazoline nucleus, a pyrrole nucleus, a oxazol nucleus, a thiazole nucleus, a selenazole nucleus, an imidazole nucleus, a tetrazole nucleus and a pyrydine nucleus; a nucleus wherein an alicyclic hydrogen carbon ring is fused; and a nucleus wherein an aromatic hydrogen carbon is fused such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus and a quinoline nucleus are applied. These nuclea may be substituted on a carbon atom. For a merocyanine dye or a heteromerocyanine dye, as a nuclei having a ketomethilene structure, 5-membered to 6-membered heterocyclic groups such as a pyrazoline-5-on nuclei, a thiohydantoine nuclei, a 2-thiooxazolidine-2,4-dion nuclei, a thiazolidine-2,4-dion nuclei, a rhodanine nuclei and a thiobarbituric acid can be applied. Practically, those described in Research Disclosure Volume 176, RD-17643 (December, 1978), on pp. 2 and 3, U.S. Pat. Nos. 4,425,425 and 4,425,426 can be used. In addition, sensitizing dyes can be dissolved by the use of a supersonic vibration described in U.S. Pat. No. 3,485,634. As a method for adding the sensitizing dyes of the present invention to the emulsion by dissolving or dispersing, methods described in U.S. Pat. Nos. 3,482,981, 3,585,195, 3,469,987, 3,425,835 and 3,342,605, British Patent Nos. 1,271,329, 1,038,029 and 1,121,174 and U.S. Pat. Nos. 3,660,101 and 3,658,546 can be used. These sensitizing dyes can be used independently, or two or more thereof can be used in combination. Sensitizing dyes are frequently combined for super sensitization. Combination of dye for useful supersensitization and materials showing super sensitization are described in Research Disclosure Volume 176, 17643 (issued in December, 1978), on page 23IV, Item J.

When they are used for a light-sensitive material for graphic plate-making use of the present invention, a desensitizing dye can be used for controlling sensitivity and safe-light property. Specifically, for preparing a day-light light-sensitive material, it is especially useful to use a desensitizing dye.

Used amount of an organic desensitizer is ordinarily 10 to 5 g and preferably 50 to 3 g per mol of silver halide. As an addition method, in addition to adding with an aqueous solution, it can be added by dissolving in an organic solvent. In addition, it can be added in a form of fine grains by the use of a sand mill, a ball mill and impeller dispersion. The size of fine grain is suitably 0.001 to 20μ, and preferably 0.01μ to 1μ. The organic desensitizer is characterized by a half-way potential of a polarograph. Namely, the total of the potential of the anode and that of the cathode of polarograph is positive. The measurement method thereof is described in U.S. Pat. No. 3,501,307.

To a light-sensitive material of th present invention, various compounds can be incorporated for preventing fogging during manufacturing step of the light-sensitive material, during storage thereof or during photographic processing or for stabilizing photographic performance. Namely, many compounds known as an anti-foggant or a stabilizer including azoles such as a benzothiazolium salt, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (especially, 1-phenyl-5-mercaptotetrazole); mercaptopyrymidines and mercaptotriazines; thioketones such as oxazolinethione; azaindenes such as triazaindenes, tetrazaindenes (especially, 4-hydroxy substituted-1,3,3a,7-tetrazaindenes) and pentazaindenes; ananti-foggant benzenethiosulfonic acid, benzenesulfinic acid and benzene sulfonic acid amide or many compounds known as a stabilizer can be added.

As a binder or a protective colloid for a photographic emulsion of the present invention, it is advantageous to use gelatin. Hydrophilic colloids other than gelatin can also be used. For example, gelatin derivatives, graft polymer between gelatin and the other polymer, protein such as alubumin and casein; cellulose derivatives such as hydroxyethyl cellulose, carboxymethyl cellulose and cellulose sulfate ester, sodium alginic acid and sugar derivatives such as starch derivatives; and various synthetic hydrophilic polymers such as monopolymer or copolymer including polyvinyl alcohol, polyvinyl alcohol partial acetal, poly-N-vinylpyrrolidone, polyacrylic acid, polyvinyl imidazole and polyvinyl pyrazole can be used.

As gelatin, in addition to lime-processed gelatin, acid-processed gelatin may be used. In addition, gelatin hydrolysis product and gelatin enzyme-decomposed product can also be used.

To the photographic emulsion of the present invention, for the purpose of dimension stability, dispersed product of a water-insoluble or refractory synthetic polymer can be incorporated. For example, alkyl(metha)acrylate, alkoxyacrylic(metha)acrylate, glycidyl(metha)acrylate, (metha)acrylic amide, vinylester (for example, vinyl acetate), acrylonitrile, orephin and stylene are used independently or two or more thereof can be used in combination. In addition, polymers wherein the combination of the above-mentioned polymers and acrylic acid, methacrylic acid, α, β-unsaturated dicarboxylic acid, hydroxyalkyl(metha)acrylate, sulfoalkyl(metha)acrylate and stylenesulfonic acid is used as a monomer component can be used.

As a preferable hydrophilic polymer, starch, glucose, dextrine, dextrane, cyclodextrine, saccharose, maltose, xanthanegum and carageenan are cited. The molecular weight of the hydrophilic polymer can be appropriately selected from 600 to 1,000,000. When processing, in order to dilute in a processing solution rapidly, the less the molecular weight is, the better for diluting. However, when the molecular weight is too low, the layer strength of the film is deteriorated. Therefore, 400 or mor eis necessary. When a hydrophlic polymer is used, durability to film scratches is deteriorated. Therefore, it is preferable to add inorganic colloidal silica, colloidal tin, colloidal zinc, colloidal titanium, colloidal ittlium, colloidal praseodymium, neodymium, zeolite and apatite. As a zeolite, analcite, erionite, mordenite, shabacite, gmelinite, levynite and synthetic are cited. As a synthetic zeolite, zeolite A, X, Y and L are cited. As an apatite, hydroxyapatite, fluorine apatite, fluorine apatite and chlorine apatite are cited. The preferable amount added is 1% to 200% by weight per a hydrophilic binder. When the above-mentioned inorganic compounds are processed with a silane coupling agent, they are difficult to be coagulated even when they are added to an emulsion and they can stabilize a coating solution. In addition, cracking due to the inorganic compound can be prevented. As a silane coupling agent, triethoxysilanovinyl, trimethoxysilanovinyl, trimethoxypropyl methaacrylate, trimethoxysilanopropylglycidyl, 1-mercapto-3-triethoxysilanopropane, 1-amino-3-triethoxysilanopropane, triethoxysilanophenyl and triethoxymethylsilane are cited. The silane coupling agent can improve its properties by processing with the above-mentioned inorganic compound at high temperature compared to simple mixing. The mixing ratio is allowed to be selected from 1:100 to 100:1.

In order to provide the effects of the present invention more remarkably, it is preferable that a light-sensitive material of the present invention has at least one hydrophilic colloidal layer on the opposite side of the silver halide photographic emulsion layer and that it has at least one hydrophobic polymer layer on the outside of aforesaid hydrophilic colloidal layer. Here, the hydrophilic colloidal layer on the opposite side of the silver halide photographic emulsion layer includes so-called a backing layer. In the present invention, a constitution which has at least one hydrophobic layer outside the backing layer is preferable. In the present invention, a hydrophobic layer means a layer using a hydrophobic polymer as a binder. As practical example of the binder of the polymer layer, fluorine type resins such as polyethylene, polypropylene, polystylene, vinyl polychloride, vinylidene polychloride, polyacrylonitrile, vinyl polyacetate, urethane resins, urea resins, melamine resisns, phenol resins, epoxy resins, tetrafluoroethylene and polyfluoride vinylidene, rubbers such as butadiene rubber, chloropulene rubber and natural rubber, ester of acrylic acid or methacryli acid such as polymethyl methacrylate and polyethyl acrylate, polyester resins such as polyethylene phthalate, polyamide resins such as nylon 6 and nylon 66, cellulose resins such as cellulose triacetate, water-insoluble polymers such as silicone resin or their derivative are cited. As a binder for the polymer layer, both of a homopolymer composed of one kind of monomer and a copolymer composed of two or more kinds of monomer are allowed. As a preferable binder, a copolymer of alkyl acrylate or alkyl methacrylate and arylici acid or methacrylic acid (arylic acid or methacrylic acid is preferably 5 mol % or less), stylene-butadiene copolymer, stylene-butadiene-divinyl benzene-methacrylic acid copolymer (methacrylic acid is preferably 5 mol % or less), vinyl acetate-ethylene-acrylic acid copolymer (acrylic acid is 5 mol % or less), vinylidene chloride-acrylonitrile-methylmethacrylate-ethylacrylateacrylic acid copolymer (acrylic acid is 5 mol % or less) and ethylacrylate-glycidylmethacrylate-acrylic acid copolymer are cited. These can be used independently, or two or more thereof can be used in combination.

To the hydrophobic polymer layer of the present invention, if necessary, an additive for photographic use such as inorganic fine particles including a matting agent, a surfactant, a dye, a lubricant, a bridging agent, a viscosity-increasing agent, a UV absorber and colloidal silica may be added. With regard to the above-mentioned additives, Research disclosure Volume 176, Item 17646 (December, 1978) can be referred.

The hydrophobic polymer layer of the present invention may be one layer or two or more layers. There is no specific limit to the thickness of the polymer layer of the present invention. However, when the thickness of the hydrophobic layer is too small, moisture-durability of the hydrophobic layer becomes insufficient so that the backing layer becomes swollen with the processing solution. This is unappropriate. On the contrary, when the thickness of the hydrophobic layer is too large, vapor moisture permeability becomes insufficient so that dehumidifying of the hydrophilic colloidal layer in the backing layer is hindered, resulting in poor curling property. It goes without saying that the thickness of the hydrophobic polymer layer depends upon the physical value of the binder used. Therefore, it is necessary to determine the thickness of hydrophobic polymer considering both factors. Preferable hydrophobic polymer layer depends upon the kind of the hydrophobic polymer layer. It is ordinarily 0.05 to 10 μm, preferably 0.1 to 5 μm. When the hydrophobic polymer layer of the present invention is composed of 2 or more layers, the total of all hydrophobic polymer layers is defined to be the thickness of the hydrophobic polymer layer of the silver halide photographic light-sensitive material.

There is no limit to a method of coating the hydrophobic polymer layer in the present invention. A polymer layer may be coated on a backing layer after coating and drying the backing layer, and then, dried. In addition, the backing layer and the hydrophobic polymer layer may be coated concurrently, and then, dried. The hydrophobic polymer layer may be dissolved in a solvent of a binder of the polymer layer and coated in a solvent system, and may also be coated in a water system by the use of a water-dispersed product of the polymer of the binder.

On the opposite side of the emulsion layer of the black-and-white silver halide photographic light-sensitive material of the present invention, it is preferable to provide an adhesive layer/an anti-static layer/a backing layer containing a hydrophilic colloid/a hydrophobic layer in this order on a support. In addition, a protective layer may be provided thereon. The adhesive layer can be obtained by coating a gelatin layer containing tin oxide doped with indium or phosphorous whose average particle size is 0.01μ to 1μ and fine particles of vanadium pentaoxide after coating a vinylidene copolymer or a stylene-glycidyl acrylate copolymer in a thickness of 0.1 to 1μ a support subjected to corona discharge. In addition, it can also be provided by making a layer of stylene sulfonic acid and a maleic acid copolymer with aziridine or a carbonyl active type bridging agent. On the above-mentioned anti-static layer, a dye backing layer can be provided. In the above-mentioned layer, an inorganic filling substance for stabilizing dimension such as colloidal silica, silica and a methacrylic acid methyl matting agent for preventing adhesion and a silicone lubricant or a peeling agent for controlling conveyance property can be incorporated. In the backing layer, a backing dye may be incorporated. As a backing dye, a benzilidene dye and an oxonol dye are used. These alkaline-soluble or decompositional dye can be fixed in a state of fine particles.. As a density for preventing halation, 0.1 to 2.0 in each light-sensitive wavelength is preferable.

In a photographic emulsion layer and a nonsensitive hydrophilic colloidal layer of the present invention, an inorganic or organic hardener can be added as a bridging agent of a hydrophilic colloid such as gelatin. For example, chromium salts (chromium alum and acetic acid chromo), aldehydes (formaldehyde, glyoxal and glutaric aldehyde), N-methylol compounds (dimethylol urea and methylol dimethyl hydantoine), dioxane derivatives (2,3-dihydroxydioxane), active vinyl compounds (1,3,5-triacryloyl-hexahydro-s-triazine, bis(vinylsulfonyl)methylether and N,N'-methylenebis[β-(vinylsulfonyl)propioneamide]), active halogen compounds (2,4-dichloro-6-hydroxy-s-triazine), mucohalogen acids (mucochloro acid and phenoxymucochloro acid), isooxazoles, dialdehyde stark, 2-chloro-6-hydroxytriazinylized gelatin and a carboxyl group activated hardener can be used independently, or two ro more thereof can be used in combination. The above-mentioned hardeners are described in Research Disclosure Volume 176, 17643 (issued in December, 1978), page 26, Items A through C. Of these, the preferable is carboxyl group active type hardeners, and compounds represented by Formulas (1) through (7) described in Japanese Patent O.P.I. Publication, on pp. 3 through 5 are preferable. As practical compounds thereof, H-1 through H-39 described in aforesaid specification, on pp. 6 to 14 are cited. In order to provide the effects of the present invention more prominently, a hardener used for the silver halide photographic light-sensitive material of the present invention is preferably a compound represented by the following Formula 13.

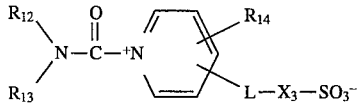

Formula 13

In a compound represented by Formula 13, $R_{12}$ and $R_{13}$ each represents a straight, branched or cyclic alkyl group having 1 to 20 carbons (for example, a methyl group, an ethyl group, a butyl group, a cyclohexyl group, a 2-ethylhexyl group and a dodecyl group) and an aryl group having 6 to 20 carbons (for example, a phenyl group and a naphtyl group). In addition, $R_{12}$ and $R_{13}$ may have a substituent. As an example thereof, those cited as an substituent of $R_1$ through $R_{11}$ represented by Formulas 1 through 6 in Japanese Patent O.P.I. Publication No. 289219 are cited. In addition, it is also preferable that $R_{12}$ and $R_{13}$ are linked together for forming a ring together with a nitrogen atom. Especially preferable examples are occasions when a morphorine ring and a pyrrolidine ring are formed. $R_{14}$ represents a hydrogen atom or a substituent. As examples of the substituent, those cited as substituents for $R_1$ through $R_{11}$ represented by Formula 1 through 6 in Japanese Patent O.P.I. Publication No. 289219/1993 are cited. Of these, a hydrogen atom is especially preferable. L rpresents a mono-linkage. In addition, L represents an alkylene group having 1 to 20 carbons (for example, a methylene group, an ethylene group, a trimethylene group and a propylene group), an arylene group having 6 to 20 carbons (for example, a phenylene group) and a divalent group obtained through combination thereof (for example, a baraxylene group), an acylamino group (for example, a —$NHCOCH_2$— group), a divalent group including a sulfonamide group (for example, a —$NHSO_2CH_2$— group). The preferable are a mono-linkage, an alkylene group such as a methylene group and an ethylene group and an acylamino group. $X_3$ represents a mono-linkage, —O— or —$N(R_{15})$—. $R_{15}$ represents a hydrogen atom, an alkyl group having 1 to 20 carbons (for example, a methyl group, an ethyl group and a benzyl group), an aryl group having 6 to 20 carbons (for example, a phenyl group) and an alkoxy group having 1 to 20 carbons (for example, a methoxy group). A hydrogen atom is especially preferable. Practical examples of preferable hardener are cited below.

K-1

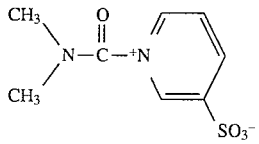

K-2

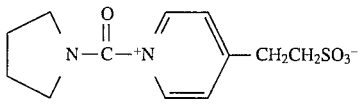

K-3

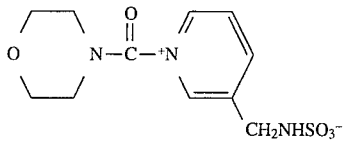

K-4

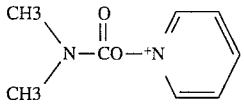

K-5

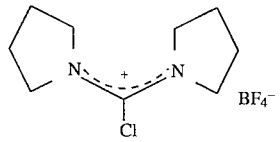

K-6

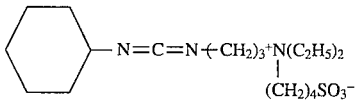

K-7

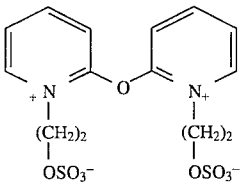

K-8

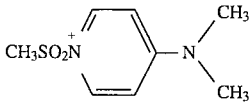

K-9

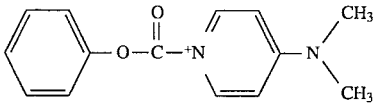

K-10

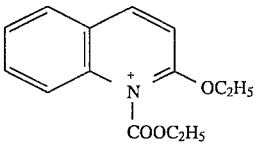

As other hardeners, preferable compounds are compounds of (1) through (17) described in Japanese Patent Application No. 144823/1994, on pp. 11 through 13.

To a light-sensitive emulsion layer and/or a nonsensitive hydrophilic colloidal layer of the present invention, various conventional surfactants may be used for various purposes such as a coating aid, anti-static, improvement in sliding property, emulsifying and dispersion, adhesion preventing and improvement in photographic properties.

To each layer, in addition to gelatin, hydrophilic polymers such as dextrines, starch and glucose and a hydrophobic latex can be introduced for adjusting the degree of swelling. As the degree of swelling, 120 to about 200 is ordinary. For drying each layer, temperature and time are adjusted corresponding to the speed of the evaporation of moisture. Temperature of 25° C. to 200° C. and time of 0.1 second to about 200 seconds are ordinarily applied. The degree of swelling can be calculated by immersing the light-sensitive material and measuring it with a microscope or by the use of swelling-meter. As the degree of swelling, 100 times of a thickness Lw swollen in water of 23° C. against dried layer thickness=Ld (layer thickness after being regulated at 23° C. and 50% for 24 hours) (Lw/Ld) can be an index.

Surface tension and wettability index can be calculated in reference to JIS.

pH on the layer surface on the silver halide photographic emulsion layer side of the present invention is preferably 4.5 or more and 5.8 or less. pH on the layer surface is defined to be pH measured after coating and drying. It is measured by a pH meter wherein 1 cc of pure water is dropped on 1 $cm^2$ of measured portion. When reducing pH, acids such as citric acid, oxalic acid, hydrochloric acid, sulfuric acid, nitric acid, acetic acid and carbonic acid can be used. When increasing pH, alkaline agents, such as sodium hydroxide, potassium hydroxide, sodium carbonate, sodium hydrogen carbonate and sodium acetic acid can be used. When a photographic additive is used too, the above-mentioned methods can be applied when regulating pH.

To the light-sensitive material of the present invention, varous other additives are used. For example, a desensitizing agent, a plasticizer, a lubricant, a development accelerator and oil are cited.

A support used in the present invention may either be transparent or opaque. Considering the objects of the present invention, a transparent plastic support is preferable. For a plastic suport, a support composed of polyethylene compounds (for example, polyethylene terephthalate and polyethylene naphthalate), triacetate compounds (for example, triacetate cellulose) and polystylene compounds are used. Of them, in order to provide the effects of the present invention more prominently, a support composed of an oriented film composed of a stylene polymer having a syndiotactic structure or a compound containing it (hereinafter, abbreviated as SPS) is especially preferable. SPS is defined to be a homopolymer constituted by an SPS unit having a syndiotactic cubic regularity. It also includes an SPS modified by the second component having 20 mol % or less, preferably 10 mol % or less and especially preferably 5 mol % or less. As the second component, those containing a orephin monomer such as ethylene, propylene, butene and hexene, dienmonomer such as butadiene and isoprene and polar vinyl monomer such as a cyclic orephin monomer, a cyclic diene monomer, methacrylic acid methyl, maleic acid anhydrate and acrylo nitrile are cited. Ordinarily, they are produced by polymerizing from stylene or its derivative under an appropriate reaction condition by the use of an organic metal catalyst. Syndiotactic polystylene has 75% or more and preferably 80% or more of cubic regularity for racemic dyad, and also has 30% or more and preferably 50% or more of cubic regularity for racemic pendad. In such an occasion, they can be added in a range which does not deteriorate bending elasticity as the second component. This is conducted for obtaining an appropriate bending elasticity.

The SPS can be synthesized by polymerizating stylene or its derivative in the presence of a catalyst of a condensed product of titanium compound and trialkyl aluminum at a suitable reaction temperature. for it, methods described in Japanese Patent O.P.I. Publication Nos. 187708/1987, 46912/1989 and 178505/1989. There is no specific limit to the degree of the polymerization of the SPS. Ten thousand or more and 5 million or less are preferably used. In order to increase the bending elasticity of the SPS, it is necessary to select the most suitable orientation condition. At temperature plus 30° C.±25° C. from the glass transition point of the unorientaed film, namely, at 120° X±25° C., the SPS is oriented 3.3±0.3 times longitudinally. Next, under the same temperature condition, it is oriented 3.6±0.6 times transversally. Heat processing after orientation is conducted at 230°±18° C. When heat processing is conducted by two step in addition to one step, favorable results can be obtained. Thus, the SPS film having a bending elesticity of 350 kg/mm$^2$ or more is produced.

To the above-mentioned film having high curling property, it is difficult to coat a photographic layer for obtaining strong adhesivity. Regarding this method, Japanese Patent O.P.I. Publication No. 54551/1991 described from page 3 to page 4 that there are many patents and documents, which can be referenced.

For example, with regard to surface processing, corona discharge and coating a subbing layer in addition are described. As a subbing layer, vinylidene chloride, methacrylic acid, acrylic acid, itaconic acid and maleic acid anhydrate are cited.

Thickness of s support is preferably 50 to 250 μm, and preferably 70 to 200 μm.

In addition, for improving winding property, i.e. curling of a support, it is preferable to conduct heat procesing after producing a layer. The most preferable timing is between after casting and before emulsion coating. It is also allowed to be after emulsion coating. The conditions of heat processing is 45° C. or more and not more than the glass transition temperature. It is preferable to be from 1 second to 10 days. From viewpoint of productivity, it is preferable to be within 1 hour.

As additives, the above-mentioned additives and other conventional additives, various compounds described in (RD) No. 1743, (RD)No. 18716 and (RD) No. 308119 (December, 1989) can be used. Kinds of compounds and places described in the above-mentioned three (RD) Research Disclosures will be described below.

| | RD-17643 | | | RD-308119 | |
|---|---|---|---|---|---|
| Additive | Page | Classification | RD-18716 Page | Page | Classification |
| Chemical sensitizer | 23 | III | 648 upper right | 996 | III |
| Sensitizing dye | 23 | IV | 648–649 | 996–8 | IVA |
| Desensitizing dye | 23 | IV | | 998 | IVB |
| Dye | 25–26 | VIII | 649–650 | 1003 | VIII |
| Development accelerator | 29 | XXI | 648 upper right | | |
| Anti-foggant, stabilizer | 24 | IV | 649 upper right | 1006–7 | VI |
| Brightening agent | 24 | V | | 998 | V |
| Hardener | 26 | X | 651 left | 1004–5 | X |
| Surfactant | 26–27 | XI | 650 right | 1005–6 | XI |
| Plasticizer | 27 | XII | 650 right | 1006 | XII |
| Lubricant | 27 | XII | | | |
| Matting agent | 28 | XVI | 650 right | 1008-9 | XVI |
| Binder | 26 | XXII | | 1003–4 | IX |
| Support | 28 | XVII | | 1009 | XVII |

Each additive for photographic use used in the present invention may be used by dissolving in an aqueous solution and an organic solvent. When it is refractory to water, it can be used in a fine particle state and by dispersing in water, gelatin, a hydrophilic or hydrophobic polymer. In order to disperse a dye, pigment, desensitizing dye, hydrazine, a redox compound, an anti-fogging agent and a UV absorber, they can be dispersed by a conventional dispersing machine. Practically, ball mill, sand mill, colloid mill, supersonic dispersing machine and a high speed impeller dispersing machine are cited. In the present invention, the above-mentioned photographic additives dispersed are fine particles having an average particle size of 100μ or less. Ordinarily, they are used in a state of 0.02 to 10μ. As a dispersion method, a method which stirs at high speed mechanically (Japanese Patent O.P.I. Publication No. 105141/1983), a method wherein an additive is heated and dissolved with an organic solvent and it is dispersed for remove an organic solvent while adding the above-mentioned surfactant, gelatin containing an anti-foaming agent and ahydrophilic polymer (Japanese Patent O.P.I. Publication No. 22948/1969), a method wherein an additive dissolved in citric acid, acetic acid, sulfuric acid, hydrochloric acid and malic acid is dispersed in a polymer whose pH is 4.5 to 7.5 for coagulating crystals (Japanese Patent O.P.I. Publication No. 80119/1975) and a method wherein an additive is dissolved in alkali such as sodium hydroxide, sodium hydrogen carbonate and sodium carbonate and dissolved in a polymer such as gelatin whose pH is 4.5 to 7.5 for coagulating crystals can be applied. For example, hydrazine which is refractory to water can be dissolved in reference to Japanese Patent O.P.I. Publication No. 3033/1990. This method can be applied to other additives. In addition, dyes having a carboxyl, sensitizing dyes And inhibitors can increase solidifying ratio of fine particle crystals by utilizing chelating ability of a carboxyl group. Namely, by adding calsium ion and magnesium ion to a hydrophilic colloidal layer of 200 to 4000 ppm, it is preferable to make a refractory salt. If a refraqctory salt can be formed, there is no limit to use other salts. The method of dispersing fine particles of photographic additive can be applied to a sensitizer, dye, inhibitor, accelerator, hardener and ahardening aid arbitrarily depending upon their chemical and physical properties.

In order to coat two to ten plural constituting layers of the present invention concurrently at high speed of 30 to 1000 meters per minute, a conventional slide hopper method or a curtain coating method described in U.S. Pat. Nos. 3,636,374 and 3,508,947 can be used. In order to reduce unevenness when coating, it is preferable to reduce surface tension of the coating solution and to use the above-mentioned hydrophilic polymer which can provide thixotropic property wherein viscosity is reduced due to blading force.

To the light-sensitive material of the present invention, a crossover cut layer, an antistatic layer, an antihalation layer and a backing layer may be provided.

As a method of packaigng a photographic light-sensitive material composed of photographic elements of the present invention, conventional methods are used.

It is preferable to avoid to store a silver halide photographic light-sensitive material under a severe condition because it is weak in heat and humidity. Ordinary, it is allowed to store at from 5° C. to 30° C. With regard to humidity, 35% to 60% in terms of relative humidity is desirable. In order to protect from humidity, it is ordinary conducted to package in polyethylene of 1 to 2000μ. Polyethylene can inhibit transmission of moisture by improving regularity of crystal due to using a metharosene catalyst. In addition, it also can inhibit transmission of moisture by depositing and laminating the surfae of polyethylene with silica with a thickness of 0.1 to 1000 μm.

It is preferable that the black-and-white silver halide photographic light-sensitive material of the present invention is, after being exposed, subjected to photographic processing in an automatic processing machine having at least 4 processes of development, fixing, washing (or stabilizing bath) and drying.

As a developing agent capable of being used in the present invention, dihydroxybenzenes (for example, hydroquinone, chlorohydroquinone, bromohydroquinone, 2,3-dichlorohydroquinone, methylhydroquinone, isopropylhydroquinone and 2,5-dimethylhydroquinone), 3-pyrazolidones (for example, 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone and 1-phenyl-5-methyl-3-pyrazolidone), aminophenols (for example, o-aminophenol, p-aminophenol, N-methyl-o-aminophenol, N-methyl-p-aminophenol and 2,4-diaminophenol), pyrrogarol, ascorbic acids (for example, ascorbic acid and erythrobic acid), 1-aryl-3-pyrazolines (for example, 1-(p-hydroxyphenyl)-3-aminopyrazoline, 1-(p-methylaminophenyl)-3-aminopyrazoline, 1-(p-aminophenyl)-3-aminopyrazoline and 1-(p-amino-N-methylphenyl)-3-aminopyrazoline), complex salts of transition metals (complex salts of transition metals such as Ti, V, Cr, Mn, Fe, Co, Ni and Co. Since they are used as a developing solution, they are allowed to have a form having a reduction force. For example, they take a form of the complex salts of $Ti^{3+}$, $V^{2+}$, $Cr^{2+}$ and $Fe^{2+}$. As a legand, aminopolycarbonic acid such as ethylenediamine tetraacetic acid (EDTA) and diethylenetriamine pentaacetic acid (DTPA) and their salts and phosphoric acid such as hexametapolyphosphoric acid and tetrapolyphosphoric acid and their salts are cited.) can be used independently or two or more thereof can be used in combination. Of them, a combination of 3-pyrazolidones and dihydroxybenzenes, a combination of aminophenols and dihydroxybenzenes, a combination of 3-pyrazolidones and ascorbic acids, a combination of aminophenol and ascorbic acid, a combination of 3-pyrazolidones and complex salts of transition metals and a combination of aminophenols and complex salts of transition metals are preferable. In addition, with regard to a developing agent, it is ordinarily preferable to be used in an amount from 0.01 to 1.4 mol/liter.

In the present invention, as an anti-silver-sludge agent, compounds described in Japanese Patent Publication No. 4702/1987 and Japanese Patent O.P.I. Publication Nos. 51844/1991, 26838/1992, 362942/1992 and 319031/1989 are cited.

As sulfite and methabisulfite used as a preserver of the present invention, sodium sulfite, potassium sulfite, ammonium sulfite and sodium methabisulfite are cited. Sulfite is preferably 0.25 mol/liter or more and especially preferably 0.4 mol/liter or more.

To the developing solution, if necessary, alkaline agents (sodium hydroxide and potassium hydroxide), pH buffer agents (for example, carbonate salt, phosphate salt, borate salt, boric acid, acetic acid, citric acid and alkanol amine), sensitizers (for example, non-ion surfactants containing polyoxyethylenes and quartenary ammonium compounds), surfactants, anti-foaming agents, anti-fogging agents (for example, halogenated compounds such as potassium bromide, sodium bromide, nitrobenzindazole, nitrobenzimidazole, benztriazole, benzthiazole, tetrazoles and thiazoles), chelating agents (for example, ethylenediamine tetraacetic acid or its alkaline metal salt, nitroliro triacetate salt and polyphosphoric acid salt), development accelerators (compounds described in U.S. Pat. No. 2,304,025 and Japanese Patent Publication No. 45541/1972), hardeners (for example, glutaric aldehyde or its bisulfite additive) or anti-foaming agent can be added. In order to reduce the total processing time (Dry to Dry) to 60 seconds or less, it is preferable to regulate pH of the developing solution to 8.5 to 10.5.

The compound of the present invention may be used for an activator processing solution wherein a developing agent is incorporated in an emulsion layer and a light-sensitive material is processed in an aqueous alkaline solution, as a special style of photographic processing. The above-mentioned photographic processing is frequently utilized as one rapid processing method of the light-sensitive material in combination with silver salt stabilizing processing by the use of thiocyanate salt. It can be applied to such a processing solution. In such rapid processing, the effects of the present invention is specifically remarkable.

As a fixing solution, those having a component ordinarily used can be used. The fixing solution is ordinarily an aqueous solution composed of a fixing agent and other components. pH is ordinarily 3.8 to 5.8. As the fixing agent, those among organic sulfur compounds capable of producing soluble stabilizing silver complex salt known as the fixing agent can be used in addition to thio sulfate salts such as sodium thiosulfate, potassium thiosulfate and ammonium thiosulfate and thiocyanate salts such as sodium thiocyanate, potassium thiocyanate and ammonium thiocyanate.

To the fixing solution, a water-soluble aluminum salt effecting as a hardener for example aluminum chloride, aluminum sulfate and potassium alum can be added.

In the fixing solution, compounds such as preservers (for example, sulfite salt and bisulfite salt), pH buffer agents (for example, acetic acid), pH regulators (for example, sulfuric acid) and chelating agents having hard-water-softening ability can be incorporated.

The developing solution may be a mixture of solid components, an aqueous organic solution containing glucol and amine or a half-kneaded solution having high viscosity. In addition, it may be diluted to be used when using or it may be used as it is.

With regard to the photographic processing of the present invention, development temperature may be conditioned to an ordinary temperature range from 20° to 30° C., or it may be conditiond to high temperature of 30° to 40° C.

EXAMPLES

Example 1

Hereunder, the present invention will be explained practically referring to the examples. Incidentally, it goes without saying that the present invention is not limited thereto.

Preparation of Silver Halide Emulsion A

By the use of a double jet method, a silver bromochloride grain having an average diameter of 0.15 μm and composed of silver chloride of 70 mol % and silver bromide of the remaining was prepared. When mixing a core grain, $K_3RuCl_6$ was added by $8\times10^{-8}$ mol per mol of silver. To this core grain, a shell was provided by the use of a double jet method. In this occasion, $K_2IrCl_6$ was added by $3\times10^{-7}$ mol per mol of silver. The resulting emulsion was a core-shell type mono-dispersed (the variation coefficient was 10%) silver bromochloride (silver chloride was 90 mol %, silver bromoiodide was 0.2 mol % and the remaining was silver bromide) cubic crystal emulsion whose average diameter was 0.25 μm. Next, by the use of a denatured gelatin (an amino group in gelatin was substituted with phenylcarbamyl. For example, illustrated compound G-8 in Japanese Patent O.P.I. Publication No. 280139/1990, on page 287 (3)) described in Japanese Patent O.P.I. Publication No. 280139/

1990, the emulsion was desalted. EAg after being desalted was 190 mV at 50° C.

To the resulting emulsion, 4-hydroxy-6-methyl-1,3,3a7-tetrazaindene was added by $1\times10^{-3}$ mol per mol of silver, and then, potassium bromide and citric acid were added. Ph was regulated to 5.6 and EAg was regulated to 123 mV. Next, chloro aurate was added by $2\times10^{-5}$ mol thereto, and then, an inorganic sulfur was added by $3\times10^{-6}$ mol thereto. The resulting mixture was subjected to chemical ripening at 60° C. until the optimal sensitivity appears. After ripening finishes, 4-hydroxy-6-methyl-1,3,3a7-tetrazaindene of $2\times10^{-3}$ mol per mol of silver, 1-phenyl-5-mercapto tetrazole of $3\times10^{-4}$ mol and gelatin were added.

Preparation of Silver Halide Emulsion B

By the use of a double jet method, a silver bromochloride grain having an average diameter of 0.05 μm and composed of silver chloride of 60 mol %, silver iodide of 1.5 mol % and silver bromide of the remaining was prepared. When mixing a core grain, $K_3Rh(H_2O)Br_5$ was added by $2\times10^{-8}$ mol per mol of silver. To this core grain, a shell was provided by the use of a double jet method. In this occasion, $K_2IrCl_6$ was added by $3\times10^{-7}$ mol per mol of silver. The resulting emulsion was a core-shell type mono-dispersed (the variation coefficient was 10%) silver bromochloride (silver chloride was 90 mol %, silver bromoiodide was 0.2 mol % and the remaining was silver bromide) cubic crystal emulsion whose average diameter was 0.10 μm. Next, by the use of a denatured gelatin (an amino group in gelatin was substituted with phenylcarbamyl. For example, illustrated compound G-8 in Japanese Patent O.P.I. Publication No. 280139/1990, on page 287 (3)) described in Japanese Patent O.P.I. Publication No. 280139/1990, the emulsion was desalted. EAg after bein desalted was 190 mV at 50° C.

To the resulting emulsion, 4-hydroxy-6-methyl-1,3,3a7-tetrazaindene was added by $1\times10^{-3}$ mol per mol of silver, and then, potassium bromide and citric acid were added. Ph was regulated to 5.6 and EAg was regulated to 123 mV. Next, chloro aurate was added by $2\times10^{-5}$ mol thereto, and then, N,N,N'-trimethyl-N'heptafluoro selenourea was added by $3\times10^{-5}$ mol thereto. The resulting mixture was subjected to chemical ripening at 60° C. until the optimal sensitivity appears. After ripening finishes, 4-hydroxy-6-methyl-1,3,3a7-tetrazaindene of $2\times10^{-3}$ mol per mol of silver, 1-phenyl-5-mercapto tetrazole of $3\times10^{-4}$ mol and gelatin were added.

Preparation of a Silver Halide Photographic Light-Sensitiv Material for a Graphic Art Plate-Making Use for a HeNe Lazer Light-Source On one side of subbing layer on a support, a gelatin subbing layer having the following Formula 1 (the gelatin amount was 0.5 g/m$^2$), a silver halide emulsion layer having Formula 2 (the silver amount was 2.9 g/m$^2$ and the gelatin amount was 0.5 g/m$^2$), a coating solution having the following Formula 3 as an intermediate layer (the gelatin amount was 0.3 g/m$^2$), a silver halide emulsion layer 2 having Formula 4 (the silver amount was 0.2 g/m$^2$ and the gelatin amount was 0.4 g/m$^2$) and a coating solution having the following Formula 5 (the gelatin amount was 0.6 g/m$^2$) were coated in this order from the support concurrently. On a subbing layer on the opposite side, a backing layer having the following Formula 6 (the gelatin amount was 0.6 g/m$^2$), a hydrophobic polymer layer having the following Formula 7 and a backing protective layer having the following Formula 8 (the gelatin amount was 0.4 g/m$^2$) were coated in this order from the support conccurrently with coating the emulsion layer side.

| | |
|---|---|
| Composition 1 (A gelatin subbing layer) | |
| Gelatin | 0.5 g/m$^2$ |
| Solid dispersed fine particle of dye AD-13 (the average particle size was 0.1 μm) | 25 mg/m$^2$ |
| Solid dispersed fine particle of dye AD-14 (the average particle size was 0.1 μm) | 20 mg/m$^2$ |
| Sodium polystylene sulfonic acid (the molecular weight was 500,000) | 10 mg/m$^2$ |
| S-1 (sodium-iso-amyl-n-decylsulfosuccinate) | 0.4 mg/m$^2$ |
| Redox compound and comparative compound (described in Table 1) | described in Table 1 |
| Composition 2 (Silver halide emulsion layer 1) | |
| Silver halide emulsion A | 2.9 g/m$^2$ in terms of silver |
| Cyclodextrine (hydrophilic polymer) | 0.5 g/m$^2$ |
| Sensitizing dye d-1 | 6 mg/m$^2$ |
| Sensitizing dye d-2 | 3 mg/m$^2$ |
| Hydrazine derivative: illustrated compound H-7 | 30 mg/m$^2$ |
| Nucleation promoting agent: illustrated compound Na-21 | 40 mg/m$^2$ |
| Compound e | 100 mg/m$^2$ |
| Latex polymer f | 1.0 g/m$^2$ |
| Hardener g | 5 mg/m$^2$ |
| S-1 | 0.7 mg/m$^2$ |
| 2-mercapto-6-hydroxypurine | 10 mg/m$^2$ |
| EDTA | 50 mg/m$^2$ |
| Colloidal silica (the average particle size was 0.05μ) | 10 mg/m$^2$ |
| Composition 3 (An intermediate layer) | |
| Gelatin | 0.3 g/m$^2$ |
| S-1 | 2 mg/m$^2$ |
| Composition 4 (A silver halide emulsion layer 2) | |
| Silver halide emulsion A | 0.5 g/m$^2$ in terms of silver |
| Sensitizing dye d-1 | 1.7 mg/m$^2$ |
| S-1 | 1.7 mg/m$^2$ |
| Hydrazine derivative: illustrated compound H-6 | 40 mg/m$^2$ |
| Composition 5 (Emulsion protective layer) | |
| Gelatin | 0.6 g/m$^2$ |

-continued

| | |
|---|---|
| Solid dispersed product of dye AD-5 (the average particle size was 0.1 μm) | 40 mg/m$^2$ |
| S-1 | 12 mg/m$^2$ |
| Matting agent: Mono-dispersed silica whose average particle size was 3.5 μm | 25 mg/m$^2$ |
| 1,3-vinylsulfonyl-2-propanol | 40 mg/m$^2$ |
| Surfactant h | 1 mg/m$^2$ |
| Colloidal silica (the average particle size was 0.05 μm) | 10 mg/m$^2$ |
| Hardener: illustrated compound K-2 | 30 mg/m$^2$ |
| Nucleation promoting agent: illustrated compound Na-21 | 40 mg/m$^2$ |
| Composition 6 (Backing layer) | |
| Gelatin | 0.6 g/m$^2$ |
| S-1 | 5 mg/m$^2$ |
| Latex polymer f | 0.3 g/m$^2$ |
| Colloidal silica (the average particle size was 0.05μ) | 70 mg/m$^2$ |
| Sodium polystylene sulfonic acid | 20 mg/m$^2$ |
| Compound i | 100 mg/m$^2$ |
| Composition 7 (Hydrophobic polymer) | |
| Latex (Methylmethacrylate:acrylic acid = 97:3) | 1.0 g/m$^2$ |
| Hardener g | 6 mg/m$^2$ |
| Composition 8 (Backing protective layer) | |
| Gelatin | 0.4 g/m$^2$ |
| Matting agent: Mono-dispersed polymethylmethacrylate whose average particle size was 5 μm | 50 mg/m$^2$ |
| Sodium-di-(2-ethylhexyl)-sulfosuccinate | 10 mg/m$^2$ |
| Surfactant h | 1 mg/m$^2$ |
| Dye k | 20 mg/m$^2$ |
| $H-(OCH_2CH_2)_{68}-OH$ | 50 mg/m$^2$ |
| Hardener: illustrated compound K-2 | 20 mg/m$^2$ |

Sensitizing dye d-1

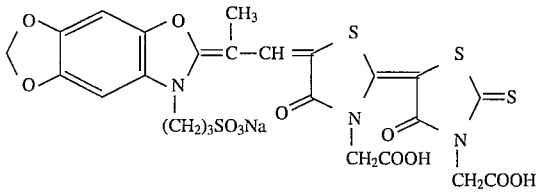

Sensitizing dye d-2

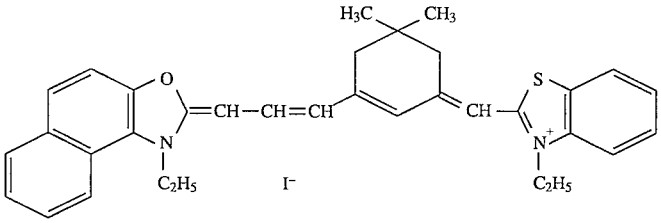

Compound e

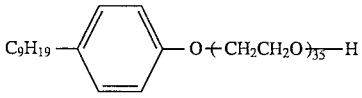

Latex polymer f

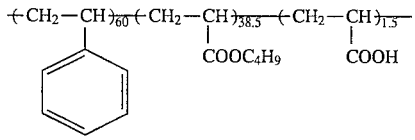

-continued

Hardener g

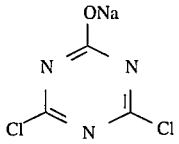

Surfactant h

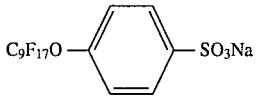

Compound i

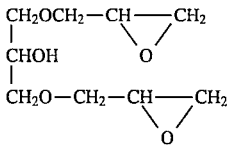

Dye k

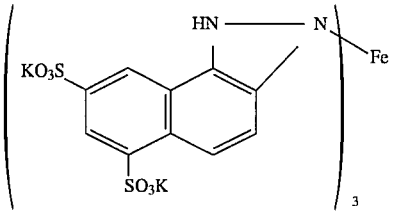

Incidentally, with regrd to a redox compound, after it is dissolved in ethyl acetate and it is added to a gelatin solution, a dispersion obtained by removing ethyl acetate was added.

Surface specific resistance value on the backing side after being coated and dried was $5\times10^{11}$ at 23° C. and 20% RH, and pH of layer surface on the emulsion side was 5.6.

The resulting sample was brought into contact with a step wedge and subjected to exposure to a light whose wavelength was 633 nm as a substituent characteristic of a HeNe laser beam. Next, it was processed in an automatic processing machine (GR-26SR, produced by Konica Corporation) for rapid processing by the use of a developing solution having the following composition and a fixing solution under the following conditions.

Incidentally, in order to evaluate fine dot quality, dots (FM screen) in a radom pattern of 8μ by the use of SG-747RU produced by DaiNippon Screen Co., Ltd. was exposed to light, and then the sample was subjected to the same processing. In addition, while replenishing 90 ml of a developing solution and a fixing solution respectively per 1 $m^2$ of a film, 100 sheets of 20×24 inch size wherein 80% of the area was blackened were processed every day. The running was continued for 8 days so that 800 sheets were processed in total. The performance of samples before running and that after running for 800 sheets were compared. Incidentally, the specific surface resistance value on the backing side after being processed was $9\times10^{11}$ at 23° C. and 20% RH.

(Conditions of photographic processing)

| (Step) | (Temperature) | (Time) |
|---|---|---|
| Developing | 38° C. | 12 seconds |
| Fixing | 35° C. | 10 seconds |
| Washing | 40° C. | 10 seconds |
| Drying | 50° C. | 12 seconds |
| Total | | 44 seconds |

with regard to the developing solution and a fixing solution, the following ones were used.

| (Developing solution) Amount per 1 liter of solution used | |
|---|---|
| Pure water (ion-exchanged water) | 800 ml |
| DTPA.5Na | 1 g |
| Sodium sulfite | 42.5 g |
| Potassium sulfite | 17.5 g |
| Potassium carbonate | 55 g |
| Hydroquinone | 20 g |
| 1-phenyl-5-mercapto tetrazole | 0.03 g |
| Dimezone S | 0.85 g |
| Potassium bromide | 4 g |
| Benzotriazole | 0.2 g |
| Boric acid | 8 g |
| Diethylene glycol | 40 g |
| Mercapto adenine | 0.78 g |
| Potassium hydroxide were added to the above-mentioned compounds to make 1 liter/pH 10.4. | |
| (Fixing solution) An amount per 1 liter of solution used | |
| Sodium thiosulfate (an aqueous 70% solution) | 200 ml |
| Sodium sulfite | 22 g |

-continued

| | |
|---|---|
| Sodium acetate.3 hydrate | 34 g |
| Acetic acid (an aqueous 90% solution) | 14.5 g |
| Boric acid | 9.8 g |
| Tartaric acid | 3.0 g |
| Aluminum sulfate (an aqueous 27% solution) | 25 ml |

To the above-mentioned compounds, pure water was added to make 1 liter. pH of the solution used was 4.9.

Evaluation on Sensitivity and γ

The resulting sample developed was measured with PDA-65 (Konica's digital densitometer). The sensitivity in the table was represented by relative sensitivity when the sensitivity of reference No. 1 at the density of 3.0 was defined to be 100. In addition, γ was represented by a tangent of density of 0.1 and 3.0. When the γ value in the table is less than 7, the sample cannot be used. When the γ value is 7 or more and less than 10, it is still insufficient. When the γ value is 10 or more, an ultra-hard images can be obtained, showing that it is a sufficiently practical light-sensitive material.

The sensitivity and γ of Nos. 101 and 102 at the initial solution level were independently 110, 20 and 100, 17.

Evaluation of Black Spots

The resulting samples developed were evaluated visually by the use of a magnifier of 100 times. The results were ranked as 5, 4, 3, 2 and 1 from less occurrence of the black spots. Ranks 1 and 2 are practically unfavorable levels.

Both of the levels of Nos. 101 and 102 at the initial solution levels were 5 respectively.

Evaluation Method of Linearity and Dot Quality

The dot quality (sharpness) of the middle point (the target was 50%) of dots in a random pattern of 8μ (FM screen) exposed with SG-747RU was evaluated by the use of a magnifier of 100 times. The highest rank was defined to be 5. According to the dot quality, the rank was reduced to 4, 3, 2 and 1. Ranks 1 and 2 were practically unfavorable levels. With regard to linearity, exposure amount was changed, and what % it is was measured by the use of 361T produced by X-Rite Inc. where it should theoretically be 95% at the exposure amount where it is actually be 2% where it should theoretically be 2%. The closer the value is to 95%, the more it is preferable.

The dot quality of Nos. 101 and 102 at the initial solution level was 5, and the linearity of them was respectively 99.5% and 97.8%.

Evaluation of the Development Inhibitor Releasing Rate

Condition (A): Under a constant temperature of 35° C., 5 parts of a 50 μM methanol - acetonitrile (1:1) solution of a compound capable of releasing a development inhibitor and 1 part of an aqueous 100 mM hydrogen peroxide solution are mixed. To the mixture, 2 parts of carbonic acid salt buffer with pH of 10.2 is added, and then, after 30 seconds, 1 part of methanol solution of a 100 mM acetic acid is added.

Condition (B): Under a constant temperature of 35° C., 5 parts of a 50 μM methanol - acetonitrile (1:1) solution of a compound capable of releasing a development inhibitor and 1 part of distilled water are mixed. To the mixture, 2 parts of carbonate buffer of pH of 10.2 is added, and then, after 30 seconds, 1 part of methanol solution of a 100 mM acetic acid is added.

The concentration of the development inhibitor released was determind by comparing a peak area to the development inhibitor solution whose concentration has been known, by the use of a high speed liquid chromatography (produced by Shimadzu Seisakusho).

TABLE 1

| Sample No. | Developing inhibitor releasing compound* | Releasing rate A % | Releasing rate B % | Ratio of A/B |
|---|---|---|---|---|
| 101 (Comp. A) | Comparative compound A | 93 | 60 | 1.55 |
| 102 (Comp. B) | Comparative compound B | 20 | 20 | 1.00 |
| 103 (Inv.) | No. 1 | 18 | 8 | 2.25 |
| 104 (Inv.) | No. 11 | 12 | 8 | 1.50 |
| 105 (Inv.) | No. 14 | 28 | 12 | 2.33 |
| 106 (Inv.) | No. 21 | 15 | 9 | 1.67 |
| 107 (Inv.) | No. 51 | 15 | 8 | 1.87 |
| 108 (Inv.) | No. 60 | 22 | 10 | 2.20 |
| 109 (Inv.) | No. 65 | 17 | 9 | 1.89 |
| 110 (Inv.) | No. 78 | 20 | 10 | 2.00 |
| 111 (Inv.) | No. 95 | 32 | 10 | 3.20 |
| 112 (Inv.) | No. 99 | 19 | 9 | 2.11 |
| 113 (Inv.) | No. 101 | 18 | 10 | 1.80 |
| 114 (Inv.) | No. 107 | 19 | 10 | 1.90 |
| 115 (Inv.) | No. 26 | 5 | 3 | 1.67 |
| 116 (Comp.) | Comparative compound C | 3 | 3 | 1.00 |

*Redox compound

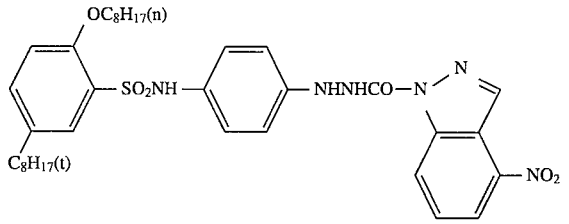

Comparitive compound A

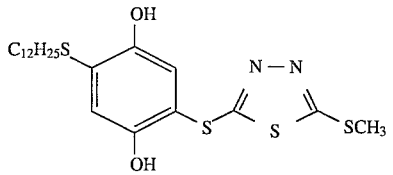

Comparitive compound B

-continued

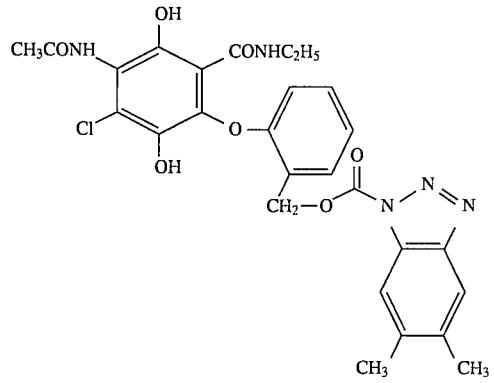

Comparitive compound C

TABLE 2

| Sample No. | Sensitivity | γ | Black spots | Linearity (%) | Dot quality |
|---|---|---|---|---|---|
| 101 (Comp.) | (110)63 | (20)9 | (5)5 | (99.5)100.0 | (5)2 |
| 102 (Comp.) | (100)54 | (17)7 | 5 | (97.8)99.8 | (5)1 |
| 103 (Inv.) | 93 | 20 | 5 | 97.3 | 4 |
| 104 (Inv.) | 89 | 17 | 5 | 98.2 | 5 |
| 105 (Inv.) | 85 | 18 | 4 | 96.9 | 5 |
| 106 (Inv.) | 95 | 19 | 4 | 97.6 | 4 |
| 107 (Inv.) | 103 | 15 | 5 | 97.8 | 4 |
| 108 (Inv.) | 101 | 18 | 5 | 96.9 | 5 |
| 109 (Inv.) | 85 | 17 | 5 | 97.4 | 5 |
| 110 (Inv.) | 90 | 17 | 4 | 97.0 | 5 |
| 111 (Inv.) | 93 | 25 | 4 | 96.8 | 4 |
| 112 (Inv.) | 94 | 18 | 4 | 97.2 | 5 |
| 113 (Inv.) | 93 | 20 | 5 | 97.3 | 4 |
| 114 (Inv.) | 94 | 20 | 5 | 97.7 | 4 |
| 115 (Inv.) | 83 | 13 | 4 | 98.4 | 4 |
| 116 (Comp.) | 71 | 9 | 2 | 99.8 | 3 |

Values in each parentheses are those when a sample is processed with a fresh solution.

As is apparent from Tables 1 and 2, the samples of the present invention has high sensitivity and hard tone, and also provide few occurrence of black spots. In addition, it can also be understood that, even when a large amount of light-sensitive materials are processed rapidly in an automatic processing machine while the replenishment amount of a developing solution and the replenishment amount of fixing solution were reduced, and even when sensitivity is fluctuated or fine spots are reproduced, dot quality and dot reproducibility are less deteriorated.

Example 2

Sample Nos. 101 through 116 were evaluated in the same manner as in Example 1 except that they were processed with the following developing solution, Sample Nos. 103 through 115 showed high sensitivity and hard-tone, and also caused less occurredn of black spots. In addition, there was no problem in terms of processing stability of running.

| (Developing solution) Amount per 1 liter of solution used | |
|---|---|
| Pure water | 800 ml |
| Potassium carbonate | 70 g |
| Ascorbic acid | 25 g |
| Dimesone S | 1.0 g |
| DTPA.5Na | 1.45 g |
| Potassium bromide | 5 g |
| 5-methylbenzotriazole | 0.2 g |
| 1-phenyl-5-mercapto tetrazole | 0.03 g |
| Sodium sulfite | 40 g |
| Diethylene glycol | 40 g |

pH was regulated to 9.8 with potassium hydroxide.

Pure water was added to make 1 liter in total.

Example 3

Preparation of Silver Halide Emulsion

Emulsion A

A silver bromochloride emulsion (silver chloride was 70 mol % per mol of silver) by the use of a double jet method. In this mixing, $K_2IrCl_6$ was added by $8\times10^{-7}$ mol per mol of silver. The resulting emulsion was composed of a cubic mono-dispersed grains (the variation coefficient was 12%) whose grain size was 0.20 μm.

To this emulsion, sensitizing dye D was added. Following this, the mixture was subjected to washing and desalting by a conventional method, and then, a mixture of compounds A, B and C was added. Next, sodium thiosulfate and potassium chloroaurate were added to the resulting mixture, and then, subjected to chemical sensitization.

Emulsion B

A silver bromochloride emulsion (silver chloride was 65 mol % per mol of silver) was prepared by the use of a double jet method. In this mixing, $K_2IrCl_6$ was added by $8\times10^{-7}$ mol per mol of silver and $Na_2RhCl_6$ was added by $1\times10^{-7}$ mol per mol of silver. The resulting emulsion was composed of a cubic mono-dispersed grains (the variation coefficient was 10%) whose grain size was 0.20 μm. To this emulsion, sensitizing dye D was added. Following this, the mixture was subjected to washing and desalting by a conventional method, and then, a mixture of compounds A, B and C was added. Next, inorganic sulfur and potassium chloroaurate were added to the resulting mixture, and then, subjected to chemical sensitization.

Preparation of Silver Halide Photographic Light-Sensitive Material

On a polyethylene terephthalate support, provided with a subbing layer of 0.1 μm thickness (see Example 1 of Japanese Patent O.P.I. Publication No. 19941/1984), whose thickness was 100 μm, emulsion B layer, intermediate layer, emulsion B layer and a protective layer respectively having the following Formulas was concurrently coated in this order from the support, and dried.

| | |
|---|---|
| <Emulsion B layer> | |
| Gelatin | 1.5 $g/m^2$ in terms of an emulsion layer |
| Emulsion B (silver amount) | 3.0 $g/m^2$ |
| 4-methyl-6-hydroxy-1,3,3a,7-tetrazaindene | 30 $mg/m^2$ |
| Adenine | 10 $mg/m^2$ |
| Sodium 5-sulfonic acid-2-mercapto benzimidazole | 5 $mg/m^2$ |
| Saponin | 0.1 $g/m^2$ |
| Surfactant (S-1) | 2 $mg/m^2$ |
| Hydrazine derivative (see Table 3) | 20 $mg/m^2$ |
| Nucleation promoting agent (23) | 20 $mg/m^2$ |
| Nucleation promoting agent (22) | 10 $mg/m^2$ |
| Methylacrylate-2-acrylamide-2-methyl-propan sulfonic acid-2-acetoacetoxy-ethylmethyl acrylate copolymer | 1.0 $g/m^2$ |
| Polyethylene glycol (the molecular weight was 4000) | 0.1 $g/m^2$ |
| <Intermediate layer> | |
| Gelatin | 1.0 $g/m^2$ |
| Surfactant (S-1) | 4 $mg/m^2$ |
| Methylacrylate-2-acrylamide-2-methyl-propan sulfonic acid-2-acetoacetoxy-ethylmethyl acrylate copolymer | 1.0 $g/m^2$ |
| 1,3-bisvinylsulfonyl-2-propanol | 20 $mg/m^2$ |
| <Emulsion A layer> | |
| Gelatin | 0.8 $g/m^2$ in terms of an emulsion layer |
| Emulsion A (silver amount) | 0.3 $g/m^2$ |
| 4-methyl-6-hydroxy-1,3,3a,7-tetrazaindene | 3 $mg/m^2$ |
| Adenine | 1 $mg/m^2$ |
| 5-methylbenztriazole | 0.5 $mg/m^2$ |
| Surfactant (S-2) | 2 $mg/m^2$ |
| Colloidal silica (the average grain size was 0.015 μm) | 20 $mg/m^2$ |
| Compounds represented by Formulas 1 and 2 | See Table 3 |
| <Protective layer> | |
| Gelatin | 0.5 $g/m^2$ in terms of an emulsion layer |
| Surfactant (S-2) | 10 $mg/m^2$ |
| Surfactant (S-3) | 2 $mg/m^2$ |
| Matting agent (Monodispersed silica whose average grain size was 3.5 μm) | 15 $mg/m^2$ |
| 1,3-bisvinylsulfonyl-2-propanol | 40 $mg/m^2$ |

Evaluation of Photographic Performance

The resulting sample was exposed to light through optical wedge with tangsten light of 3200° K. or through optical wedge and a contact screen for 5 seconds. Following this, the sample was processed in an automatic processing machine GR-26SR produced by Konica for rapid processing wherein a developing solution and a fixing solution respectively having the following component under the following conditions.

The density of the resulting sample was measured by the use of an optical densitometer PDA-65, and the gradation (γ) was represented by a tangent by values at density of 0.1 and 2.5. When the γ value is less than 8.0, hardening of tone is insufficient so that the sample cannot be used. In addition, dot gradation was represented by the following equation.

| Dot gradation = LogE (95%) - LogE (5%) | |
|---|---|
| LogE (95%): | Exposure amount providing dot area rate of 95% |
| LogE (5%): | Exposure amount providing dot area rate of 5% |

Therefore, the larger the dot gradation value is, the better the dot gradation is.

| <Composition of developing solution> | |
|---|---|
| Potassium sulfite | 50.0 g |
| Hydroquinone | 20.0 g |
| 4-methyl-4-hydroxymethyl-1-phenyl-3-pyrazolidone | 1.0 g |
| Disodium ethylenediamine tetraacetic acid salt | 2.0 g |
| Potassium carbonate | 12.0 g |
| Potassium bromide | 5.0 g |
| 5-methyl benzotriazole | 0.3 g |
| 5-mercaptopurine | 0.6 g |
| Diethylene glycol | 25.0 g |
| Compound (d) | 0.1 g |

Water was added to make 1 liter in total, and pH was regulated to 10.4 with potassium hydroxide.

| <Composition of fixing solution> | |
|---|---|
| Ammonium thiosulfate (an aqueous 72.5% W/V solution) | 200 ml |
| Sodium sulfite | 17 g |
| Sodium acetic acid.trihydrate | 6.5 g |
| Boric acid | 6.0 g |
| Sodium citric acid.dehydrate | 2.0 g |
| Pure water (ion-exchanged water) | 17 ml |
| Sulfuric acid (an aqueous 50% W/V solution) | 2.0 g |
| Aluminum sulfate (an aqueous 8.1% W/V solution in conversion to $Al_2O_3$) | 8.5 g |

When using the fixing solution, water was added thereto to make 1 liter in total. pH of the fixing solution was regulated to 4.8.

<conditions of photographic processing>
Time includes that for cross over.

| (Step) | (Temperature) | (Time) |
|---|---|---|
| Developing | 38° C. | 12 seconds |
| Fixing | 35° C. | 10 seconds |
| Washing | 30° C. | 10 seconds |
| Drying | 50° C. | 13 seconds |
| Total | | 45 seconds |

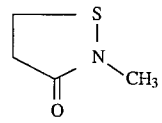
A

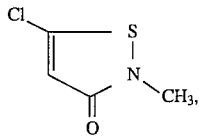
B

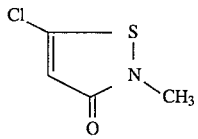
C

-continued
Sensitizing dye D
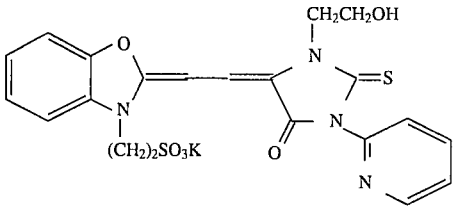
Surfactant: S-1
$CH_2COO(CH_2)_9CH_3$
|
$CHCOO(CH_2)_2C_3H_7(i)$
|
$SO_3Na$
Surfactant: S-2
$CH_2COOCH_2CH(C_2H_5)C_4H_9$
|
$CHCOOCH_2CH(C_2H_5)C_4H_9$
|
$SO_3Na$
Surfactant: S-3
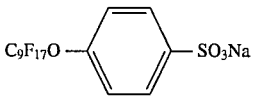
(d)
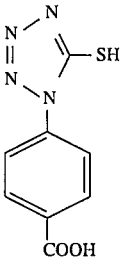
Comparative compound: A
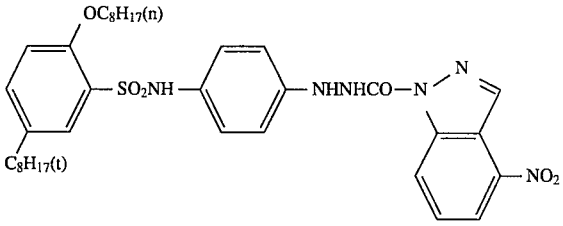
Comparative compound: B
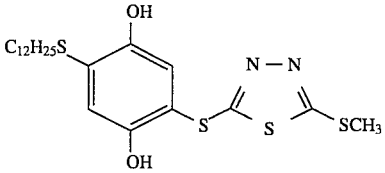

-continued

Comparative compound: C

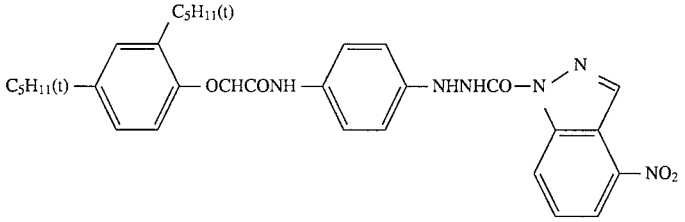

Table 3 shows the results.

TABLE 3

| Sample No. | Hydrazine derivative | Compound represented by Formula 1 and 2* No. | Amount (mmol/m²) | Photographic performance γ | Dot tone | Remarks |
|---|---|---|---|---|---|---|
| 1 | — | — | — | 5.0 | 1.25 | Comp. |
| 2 | H-26 | — | — | 12.5 | 1.18 | Comp. |
| 3 | H-27 | — | — | 12.0 | 1.16 | Comp. |
| 4 | H-28 | — | — | 12.6 | 1.18 | Comp. |
| 5 | H-28 | Comparative compound A | 0.040 | 10.0 | 1.22 | Comp. |
| 6 | H-28 | Comparative compound B | 0.040 | 11.5 | 1.26 | Comp. |
| 7 | H-28 | Comparative compound C | 0.040 | 11.0 | 1.24 | Comp. |
| 8 | H-28 | No. 1 | 0.025 | 12.0 | 1.32 | Inv. |
| 9 | H-28 | No. 7 | 0.020 | 12.2 | 1.31 | Inv. |
| 10 | H-28 | No. 12 | 0.020 | 12.9 | 1.37 | Inv. |
| 11 | H-28 | No. 16 | 0.025 | 12.4 | 1.35 | Inv. |
| 12 | H-28 | No. 18 | 0.025 | 12.7 | 1.35 | Inv. |
| 13 | H-28 | No. 22 | 0.025 | 12.7 | 1.36 | Inv. |
| 14 | H-28 | No. 27 | 0.025 | 12.4 | 1.34 | Inv. |
| 15 | H-28 | No. 33 | 0.025 | 12.2 | 1.33 | Inv. |
| 16 | H-28 | No. 37 | 0.030 | 12.1 | 1.30 | Inv. |
| 17 | H-26 | No. 44 | 0.025 | 12.2 | 1.29 | Inv. |
| 18 | H-27 | No. 47 | 0.030 | 12.3 | 1.30 | Inv. |
| 19 | H-28 | No. 1 | 0.015 | 12.6 | 1.30 | Inv. |
| | | No. 18 | 0.015 | | | |

*Redox compound

From the results of Table 3, it can be understood that Samples of the present invention Nos. 8 through 16 provide high γ value and images having wide dot gradation.

What is claimed is:

1. A silver halide photographic light-sensitive material comprising a support having on one side thereof hydrophilic colloid layers including a silver halide emulsion layer, wherein at least one of the hydrophilic colloid layers contains a redox compound having at least one carbonyl group, being selected from the group consisting of Formulae 1A through 6A:

Formula 1A

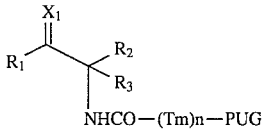

-continued

Formula 2A

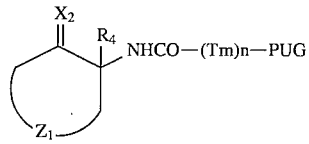

Formula 3A

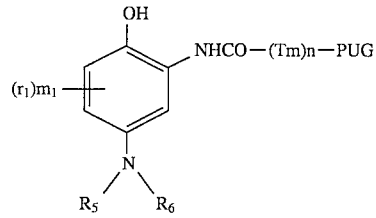

Formula 4A

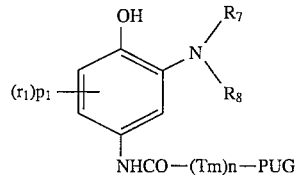

Formula 5A

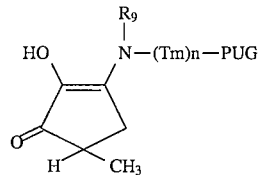

Formula 6A

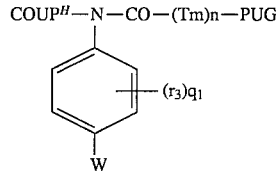

wherein $R_1$ represents an alkyl group, an aryl group or a heterocyclic group; $R_2$ and $R_3$ each represents a hydrogen atom, an acyl group, a carbamoyl group, a cyano group, a nitro group, a sulfonyl group, an aryl group, an oxalyl group, a heterocyclic group, an alkoxycarbonyl group or an aryloxycarbonyl group; $R_4$ represents a hydrogen atom; $R_5$ through $R_9$ each represents a hydrogen atom, an alkyl group, an aryl group or a heterocyclic group; $r^1$, $r^2$ and $r^3$ each represents a substituent capable of substituting with a benzene ring; $X_1$ and $X_2$ each represents O or NH; $Z_1$ represents an atom group necessary to form a 5- or 6-membered heterocyclic group; W represents $N(R_{10})R_{11}$ or OH; $R_{10}$ and $R_{11}$ each represents a hydrogen atom, an alkyl group, an aryl group or a heterocyclic group; COUP represents a coupler residue capable of causing a coupling reaction with an oxidized product of an aromatic primary amine developing agent; H represents a coupling position of a coupler; Tm represents a timing group; $m_1$ and $p_1$ each represents an integer of 0 to 3; $q_1$ represents an integer of 0 to 3; n represents an integer of 0 or 1; and PUG represents a development inhibitor, and wherein said redox compound is capable of being oxidized with an oxidized product of a developing agent in a photographic processing so as to release a development inhibitor, and wherein said redox compound satisfies the following Formulae 1 through 3:

Formula 1 a development inhibitor releasing rate (%) under a condition (A)≧4.5,

Formula 2 a development inhibitor releasing rate (%) under a condition (B)<15.0,

Formula 3 a development inhibitor releasing rate (%) under a condition (A)>a development inhibitor releasing rate (%) under condition (B), Condition (A): Under a constant temperature of 35° C., 5 parts of a 50 μM methanol - acetonitrile (1:1) solution of said redox compound capable of releasing the development inhibitor and 1 part of an aqueous 100 mM hydrogen peroxide solution are mixed, and, to the mixture, 2 parts of carbonate buffer of pH of 10.2 is added, and then, after 30 seconds, 1 part of methanol solution of a 100 mM acetic acid is added, Condition (B): Under a constant temperature of 35° C., 5 parts of a 50 μM methanol - acetonitrile (1:1) solution of said redox compound capable of releasing the development inhibitor and 1 part of distilled water are mixed and, to the mixture 2 parts of carbonate buffer of pH of 10.2 is added, and then, after 30 seconds, 1 part of methanol solution of a 100 mM acetic acid is added, and the development inhibitor releasing rate (%) in Formula 1, 2 or 3 are defined as the following Formula A, Formula A the development inhibitor releasing rate (%)=(a concentration of the development inhibitor measured/a concentration of the development inhibitor when released 100%)×100.

2. The silver halide photographic light-sensitive material of claim 1, wherein said redox compound further satisfies Formula 4:

Formula 4

{(a development inhibitor releasing rate (%) under the condition (A))/(a development inhibitor releasing rate (%) under the condition (B)))≧1.5.

3. The silver halide photographic light-sensitive material of claim 1, wherein at least one hydrazine compound is contained in at least one of said hydrophilic layers.

4. The silver halide photographic light-sensitive material of claim 1, wherein said hydrophilic layer containing said redox compound is adjacent to said silver halide emulsion layer.

5. The silver halide photographic light-sensitive material of claim 1, wherein said redox compound is contained in an amount of $10^{-6}$ to $10^{-1}$ mole per mole of silver halide.

6. The silver halide photographic light-sensitive material of claim 1, wherein said redox compound is contained in an amount of $10^{-4}$ to $10^{-2}$ mole per mole of silver halide.

7. The silver halide photographic light-sensitive material of claim 1, wherein said redox compound is selected from the group consisting of the following Formulae 1 and 2:

Formula 1

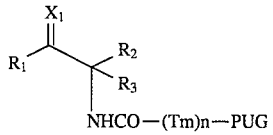

Formula 2

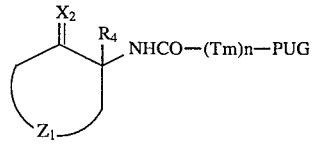

wherein $R_1$ represents an alkyl group, an aryl group or a heterocyclic group; $R_2$ and $R_3$ each represents a hydrogen atom, an acyl group, a carbamoyl group, a cyano group, a nitro group, a sulfonyl group, an aryl group, an oxalyl group, a heterocyclic group, an alkoxycarbonyl group or an aryloxycarbonyl group; $R_4$ represents a hydrogen atom; Tm represents a timing group; n represents an integer of 0 or 1; and PUG represents a development inhibitor; $X_1$ and $X_2$ each represents O or NH; $Z_1$ represents an atom group necessary to form a 5- or 6-membered heterocyclic group.

8. The silver halide photographic light-sensitive material of claim 1, wherein said COUP of the Formula 6 is selected from the group consisting of Formulas Coup-1 through Coup-8:

Formula (Coup-1)

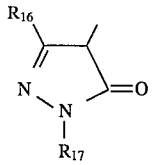

wherein $R_{16}$ represents an acylamido group, an anilino group or an ureido group; and $R_{17}$ represents one or more halogen atom, an alkyl group, an alkoxy group or a phenyl group which may be substituted by a cyano group, Formula (Coup-2)

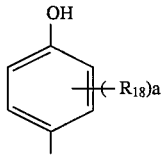

Formula (Coup-3)

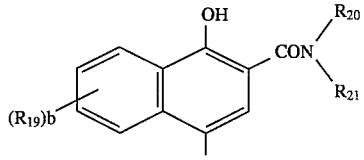

wherein $R_{18}$ and $R_{19}$ each represents a halogen atom, an acylamido group, an alkoxycarbonyl amido group, a sulfoureido group, an alkoxy group, an alkylthio group, a hydroxy group an aliphatic group; $R_{20}$ and $R_{21}$ each represents an aliphatic group, an aromatic group or a heterocyclic group; either of $R_{20}$ or $R_{21}$ may be a hydrogen atom; a is an integer of 1 through 4; b represents an integer of 0 through 5; when a and b are plural, $R_{18}$ may be the same or different from each other; and $R_{19}$ may also be the same or different,

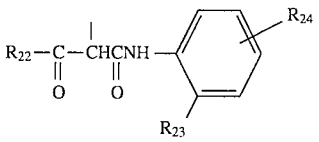

Formula (Coup-4)

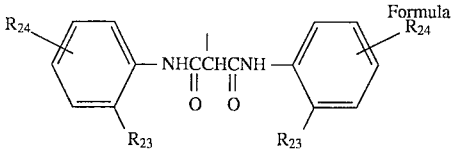

Formula (Coup-5)

wherein $R_{22}$ represents a tertiary alkyl group or an aromatic group; $R_{23}$ represents a hydrogen atom, a halogen atom or an alkoxy group; $R_{24}$ represents an acylamido group, an aliphatic group, an alkoxy carbonyl group, a sulfamoyl group, a carbamoyl group, an alkoxy group, a halogen atom or a sulfonamido group,

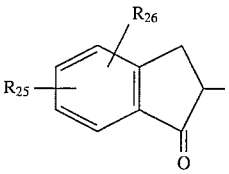

Formula (Coup-6)

wherein $R_{25}$ represents a n aliphatic group, an alkoxy group, an acylamino group, a sulfonamido group, a sulfamoyl group, a diacylamino group; and $R_{26}$ represents a hydrogen atom, a halogen atom and a nitro group,

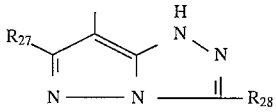

Formula (Coup-7)

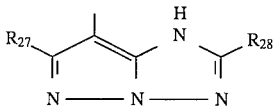

Formula (Coup-8)

$R_{27}$ and $R_{28}$ each represents a hydrogen atom, an aliphatic group, an aromatic group and a heterocyclic group.

* * * * *